US011391474B2

(12) United States Patent
Eplee

(10) Patent No.: US 11,391,474 B2
(45) Date of Patent: Jul. 19, 2022

(54) SYSTEM, COMPONENTS, AND METHODS FOR AIR, HEAT, AND HUMIDITY EXCHANGER

(71) Applicant: Dustin Eplee, Boalsburg, PA (US)

(72) Inventor: Dustin Eplee, Boalsburg, PA (US)

(73) Assignee: Energy Wall LLC, Lancaster, PA (US)

( * ) Notice: Subject to any disclaimer, the term of this patent is extended or adjusted under 35 U.S.C. 154(b) by 195 days.

(21) Appl. No.: 16/253,644

(22) Filed: Jan. 22, 2019

(65) Prior Publication Data

US 2019/0242595 A1 Aug. 8, 2019

Related U.S. Application Data

(63) Continuation-in-part of application No. 15/228,541, filed on Aug. 4, 2016, now abandoned.
(Continued)

(51) Int. Cl.

| | |
|---|---|
| ***F28D 7/02*** | (2006.01) |
| ***F24F 3/147*** | (2006.01) |
| ***F24F 1/0063*** | (2019.01) |
| ***F24F 13/30*** | (2006.01) |
| ***F24F 3/14*** | (2006.01) |
| ***F24F 13/28*** | (2006.01) |
| ***F28D 9/00*** | (2006.01) |

(Continued)

(52) U.S. Cl.

CPC ..... *F24F 3/147* (2013.01); *F24F 1/0063* (2019.02); *F24F 3/1417* (2013.01); *F24F 13/10* (2013.01); *F24F 13/20* (2013.01); *F24F 13/28* (2013.01); *F24F 13/30* (2013.01); *F28D 9/0025* (2013.01); *F28D 9/0087* (2013.01); *F28D 21/0014* (2013.01); *F28D 21/0015* (2013.01); *F24F 8/10* (2021.01); *F24F 2003/1435* (2013.01); *F24F 2003/1458* (2013.01); *F24F 2013/205* (2013.01)

(58) Field of Classification Search

CPC ..... F24F 3/147; F24F 1/0063; F24F 3/1417; F24F 13/10; F24F 13/20; F24F 13/28; F24F 13/30; F24F 8/10; F24F 2003/1435; F24F 2003/1458; F24F 2003/205; F28D 9/0025; F28D 9/0087; F28D 21/0014; F28D 21/0015

USPC ..... 165/165

See application file for complete search history.

(56) References Cited

U.S. PATENT DOCUMENTS 3,548,932 A * 12/1970 Menkus ..... F28F 3/02 165/173

5,564,626 A * 10/1996 Kettler ..... F24F 3/044 55/471

(Continued)

*Primary Examiner* — Claire E Rojohn, III

(74) *Attorney, Agent, or Firm* — Finnegan, Henderson, Farabow, Garrett & Dunner, LLP

(57) ABSTRACT

Embodiments of the present disclosure include an air handling module. The air handling module may comprise an exchanger within a housing, a first manifold positioned on a first side of the housing and including a first pair of ports on a first end and a second pair of ports on a second end, and a second manifold positioned on a second side of the housing and including a first pair of ports on a first end and a second pair of ports on a second end. The first pairs of ports may be in fluid communication to transfer air through the exchanger and between the first and second manifolds, and the second pairs of ports may be in fluid communication to transfer air through the exchanger and between the first and second manifolds.

4 Claims, 56 Drawing Sheets

Related U.S. Application Data

(60) Provisional application No. 62/620,386, filed on Jan. 22, 2018.

(51) Int. Cl.

| | |
|---|---|
| ***F24F 13/10*** | (2006.01) |
| ***F28D 21/00*** | (2006.01) |
| ***F24F 13/20*** | (2006.01) |
| *F24F 8/10* | (2021.01) |

(56) References Cited

U.S. PATENT DOCUMENTS 5,616,172 A * 4/1997 Tuckerman ..... F24F 1/0071 96/57
6,094,835 A * 8/2000 Cromer ..... D06F 58/206 62/271
6,575,228 B1 * 6/2003 Ragland ..... F24F 3/1423 165/59
9,234,665 B2 * 1/2016 Erb ..... F24F 12/002
9,835,340 B2 * 12/2017 Vandermeulen ..... F24F 3/1417
2005/0268585 A1 * 12/2005 Morse ..... B01D 46/10 55/502
2006/0021615 A1 * 2/2006 Kertzman ..... A61M 16/1075 128/201.13
2006/0243132 A1 * 11/2006 Morse ..... B01D 46/4272 95/23
2006/0252363 A1 * 11/2006 Charlebois ..... F24F 13/20 454/188
2007/0279861 A1 * 12/2007 Doll ..... G06F 1/20 361/679.48
2012/0125020 A1 * 5/2012 Vandermeulen ..... F28F 19/00 62/235.1
2013/0248160 A1 * 9/2013 Eplee ..... F28D 9/0025 165/165
2014/0041833 A1 * 2/2014 Breshears ..... F28D 21/0015 165/104.11
2014/0190037 A1 * 7/2014 Erb ..... F28D 21/0015 34/79
2014/0260371 A1 * 9/2014 Vandermeulen ..... F24F 3/1417 62/271
2014/0262125 A1 * 9/2014 Erb ..... B01D 63/082 165/10
2015/0111484 A1 * 4/2015 Son ..... F24F 13/20 454/261
2015/0111488 A1 * 4/2015 Son ..... F24F 13/20 454/329
2015/0338140 A1 * 11/2015 Vandermeulen ..... F24F 3/147 62/238.3
2016/0370029 A1 * 12/2016 Kurelowech ..... F24F 12/006
2018/0038658 A1 * 2/2018 Eplee ..... F28D 15/02
2018/0372349 A1 * 12/2018 Mosamkar ..... F24F 8/10
2019/0242595 A1 * 8/2019 Eplee ..... F28D 9/0025
2019/0299154 A1 * 10/2019 Meirav ..... B01D 53/0462
2020/0232665 A1 * 7/2020 Hirai ..... F24F 13/30
2020/0300498 A1 * 9/2020 Lopatinsky ..... F04D 17/04
2021/0172648 A1 * 6/2021 Oh ..... F24F 1/0011
2021/0333007 A1 * 10/2021 Conrad ..... G05B 15/02
2021/0389023 A1 * 12/2021 Salunkke ..... F24F 13/20

* cited by examiner

1500

SYSTEM, COMPONENTS, AND METHODS FOR AIR, HEAT, AND HUMIDITY EXCHANGER

CROSS-REFERENCE TO RELATED APPLICATIONS

This application claims the benefit of priority under 35 U.S.C. § 119 to U.S. Provisional Patent Application No. 62/620,386, filed on Jan. 22, 2018, and the benefit of priority under 35 U.S.C. § 120 to U.S. patent application Ser. No. 15/228,541, filed on Aug. 4, 2016, all of which are incorporated herein by reference in their entireties.

FIELD OF THE DISCLOSURE

Embodiments of the present disclosure include heat and moisture transfer systems and components thereof and, more particularly, heat and moisture exchangers, membranes for exchangers, methods of manufacturing exchangers, energy recovery ventilator (ERV) and evaporative cooling systems employing heat and moisture exchanges, and gas exchange systems and components thereof.

BACKGROUND OF THE DISCLOSURE

Heat and water vapor exchangers (also sometimes referred to as humidifiers, enthalpy exchangers, or energy recovery wheels) have been developed for a variety of applications. These include building ventilation (HVAC), medical and respiratory applications, gas drying or separation, automobile ventilation, airplane ventilation, and for the humidification of fuel cell reactants for electrical power generation. In various devices intended for the exchange of heat and/or water vapor between two airstreams, it may be desirable to have a thin, inexpensive heat or moisture transfer material. In some devices, it may desirable to transfer moisture across the material. In some devices, it may be desirable to transfer heat across the material. And, in some devices, it may be desirable to transfer both heat and moisture from one stream to the other. In each of these applications, it may be desirable that air and contaminants within one stream are not permitted to migrate to the other stream.

Planar plate-type heat and water vapor exchangers may use membrane plates that are constructed using discrete pieces of a planar, water-permeable membrane (for example, Nafion®, natural cellulose, sulfonated polymers or other synthetic or natural membranes) supported by a separator material (which may or may not be integrated into the membrane) and/or frame. The membrane plates may typically be stacked, sealed, and configured to accommodate fluid streams flowing in either cross-flow or counter-flow configurations between alternate plate pairs, so that heat and water vapor is transferred via the membrane, while limiting the cross-over or cross-contamination of the fluid streams. In some heat and water vapor exchanger designs, separate membrane plates may be replaced by a single membrane core made by folding a continuous strip of membrane in a concertina, zig-zag, or accordion fashion, with a series of parallel alternating folds. Similarly, for heat exchangers, a continuous strip of material may be patterned with fold lines and folded along these lines to form a configuration appropriate for heat exchange.

Membrane cores may be employed as heat and/or moisture exchanger(s) for ventilation systems, HVAC systems, air filter systems, energy recovery ventilator (ERV) systems, and evaporative cooling systems. The present disclosure is directed to improvements in existing membranes, methods of fabricating them, membrane cores, systems, method of fabricating them, and systems utilizing membrane cores.

SUMMARY OF THE DISCLOSURE

In accordance with an embodiment, an air handling module may comprise a housing and an exchanger contained within the housing. The air handling module may further comprise a first manifold positioned on a first side of the housing and including a first pair of ports arranged on a first end and a second pair of ports arranged on a second end and a second manifold positioned on a second side of the housing and including a first pair of ports arranged on a first end and a second pair of ports arranged on a second end. The first pair of ports of the first manifold may be in fluid communication with the first pair of ports of the second manifold to transfer air through the exchanger and between the first and second manifolds, and the second pair of ports of the first manifold may be in fluid communication with the second pair of ports of the second manifold to transfer air through the exchanger and between the first and second manifolds.

In accordance with another embodiment, a method of manufacturing a membrane material for an enthalpy exchanger may comprise imparting a charge onto microporous particles, coating a first roller and a second roller with the charged microporous particles, feeding a substrate between the first and second rollers, and applying heat and pressure to transfer the charged microporous particles from the first and second rollers onto the substrate.

In accordance with another embodiment, an air conditioner may comprise an exchanger including multiple layers of folded membrane material defining a stack of alternating first and second fluid passageways, wherein the first fluid passageways may be configured to receive a first air stream and the second fluid passageways are configured to receive a second air stream. The air conditioner may further comprise a liquid distribution system including a first header including a first distribution channel for delivering a first liquid to the first fluid passageways, a second header including a second distribution channel for delivering a second liquid to the second fluid passageways, a first plurality of porous members in communication with the first distribution channel and in contact with inner surfaces of the first fluid passageways, and a second plurality of porous members in communication with the second distribution channel and in contact with inner surfaces of the second fluid passageways. The first plurality of porous members may be configured to provide a continuous flow of the first liquid onto the inner surfaces of the first fluid passageways, and the second plurality of porous members may be configured to provide a continuous flow of the second liquid onto the inner surfaces of the second fluid passageways.

In accordance with another embodiment, an insulating structure may comprise a rotationally-molded shell including an interstitial space and an insulating material disposed within the interstitial space, wherein the insulating material may be one or more of: metal oxide powder; inorganic oxide powder; silica powder; fumed silica powder; and aerogel powder.

In yet another embodiment, a method for manufacturing a separator may comprise delivering a sheet of netting material between a first continuous belt having a first corrugated surface and a second continuous belt having a second corrugated surface, mating together the first and second corrugated surfaces, applying heat and pressure to the sheet of netting material to form a corrugated netted sheet, releasing the corrugated netted sheet from the first and second continuous belts, cooling the corrugated netted sheet, and applying a constant tension on the corrugated netted sheet as the corrugated netted sheet is released from the first and second continuous belts.

BRIEF DESCRIPTION OF THE DRAWINGS

FIG. 15*l* illustrates a psychrometric chart corresponding to the operation of an evaporative cooling and/or steam regenerating liquid desiccant air conditioner module, according to an exemplary disclosed embodiment;

DETAILED DESCRIPTION

Reference will now be made in detail to the exemplary embodiments of the present disclosure described above and illustrated in the accompanying drawings.

Air Handling Module, Air Handling System, and Rotary Damper

Figure 1:
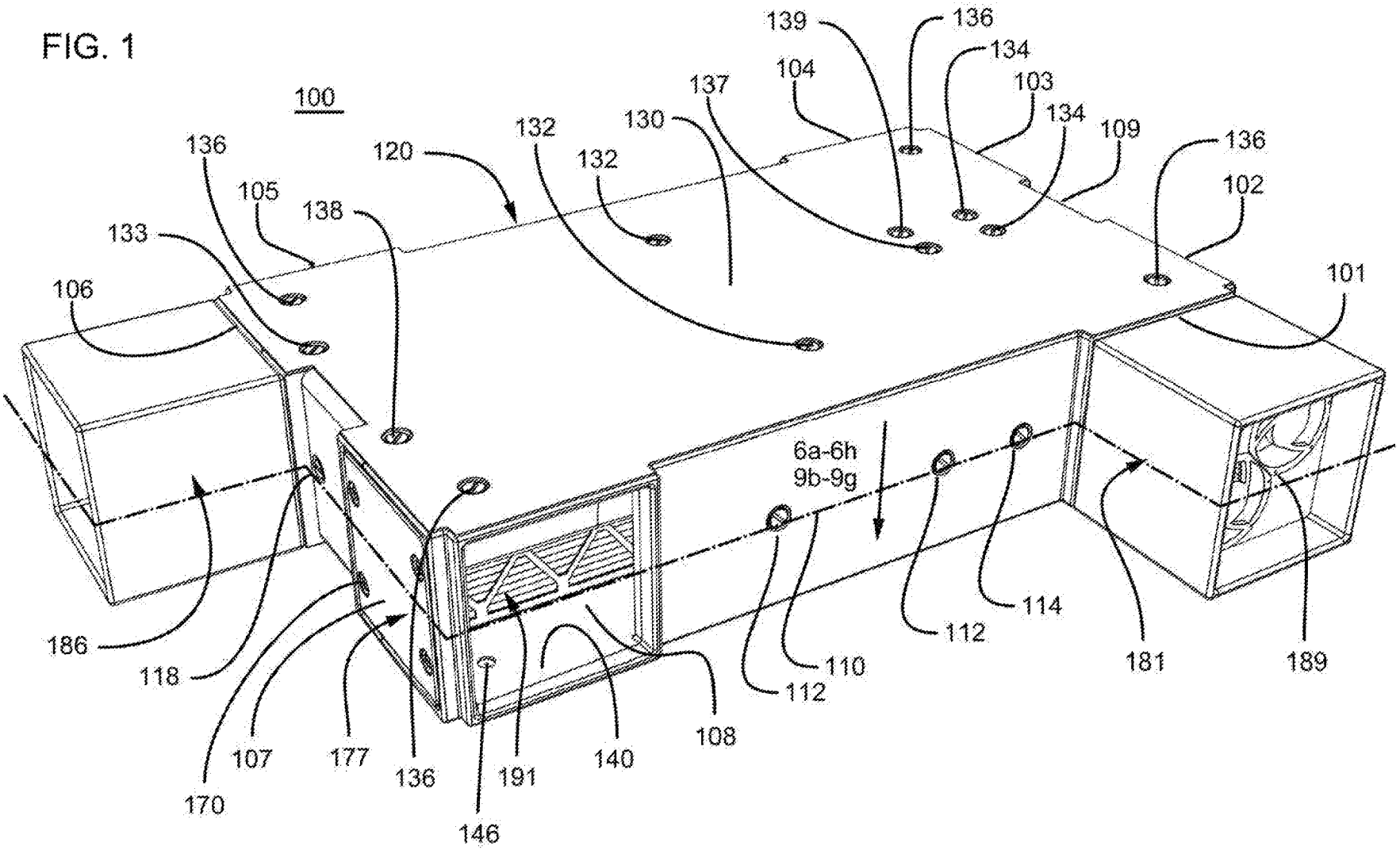
FIG. 1 illustrates a perspective view of an exemplary air handling module having a plurality of modular features, according to an exemplary disclosed embodiment.

FIG. 1 illustrates an air handling module 100 according to the present disclosure. In some embodiments, air handling module 100 may be an energy recovery ventilation (ERV) system and may utilize return air (RA) from a space or a building to precondition outside air (OA) for an HVAC system. Air handling module 100 may include a housing 120 having a top 130, a bottom 140, and sides 110. Furthermore, air handling module 100 may include a first pair of ports 103, 104 fluidly connected to a second pair of ports 101, 102, and a third pair of ports 107, 108 fluidly connected to a fourth pair of ports 105, 106.

Fan box 181 may be coupled to port 101 and may contain one or more fans 189 configured to draw outside air (OA) from ports 103 and/or 104 and through an exchanger 213. Fan box 186 may be coupled to port 106 and may contain one or more fans 189 configured to draw return air (RA) from a port 108 and through a filter 191. An access panel 177 may attach to and detach from port 107 via panel connectors 107. Connectors 107 may include any suitable connection mechanisms, such as, for example, latches, screws, and the like. Access panel 177 may be detached from port 107 to provide access for replacing filter 191.

Ports 101-108 may serve as interchangeable attachment points for a number of additional structures, such as, for example, metal ducts, weather hoods, roof curbs, and/or other fluidly connected components of an HVAC system. Ports 101-108 may include any suitable means, including, for example, mechanical latches, flanges, friction fit, interference fit, removable fasteners, and the like, to readily connect and disconnect components to air handling module 100.

Air handling module 100 may also include a port 109 that may provide access to electrical, power, and economizer sections of air handling module 100. Housing 120 may include a plurality of external and internal ports configured to facilitate a modular hydronic distribution and collection system. For example, in some embodiments, housing 120 may include side drain ports 112, side liquid desiccant drain port 118, top drain ports 133, top liquid desiccant port 137, top liquid desiccant port 138, and top evaporative port 139. These ports of the hydronic distribution and collection system may serve as interchangeable attachment points for a plurality of components, including, for example, a condensate drain pipe, an evaporative water supply pipe, an evaporative water drain pipe, a liquid desiccant supply pipe, a liquid desiccant drain pipe, a refrigerant line conduit, a chilled water conduit, a steam pipe, and/or other fluidly connected hydronic components of an HVAC system. In some embodiments, the ports may be threaded and may incorporate gasketed seals.

Housing 120 may also include a plurality of external and internal ports configured to facilitate a modular system for components for local communications network, electrical distribution, and power distribution. For example, in some embodiments, housing 120 may include side conduit port 114 and top conduit port 134. Air handling module 100 may facilitate modular connectivity with additional air handling modules 100 via top anchor ports 136 and bottom anchor ports 146.

Figure 2:
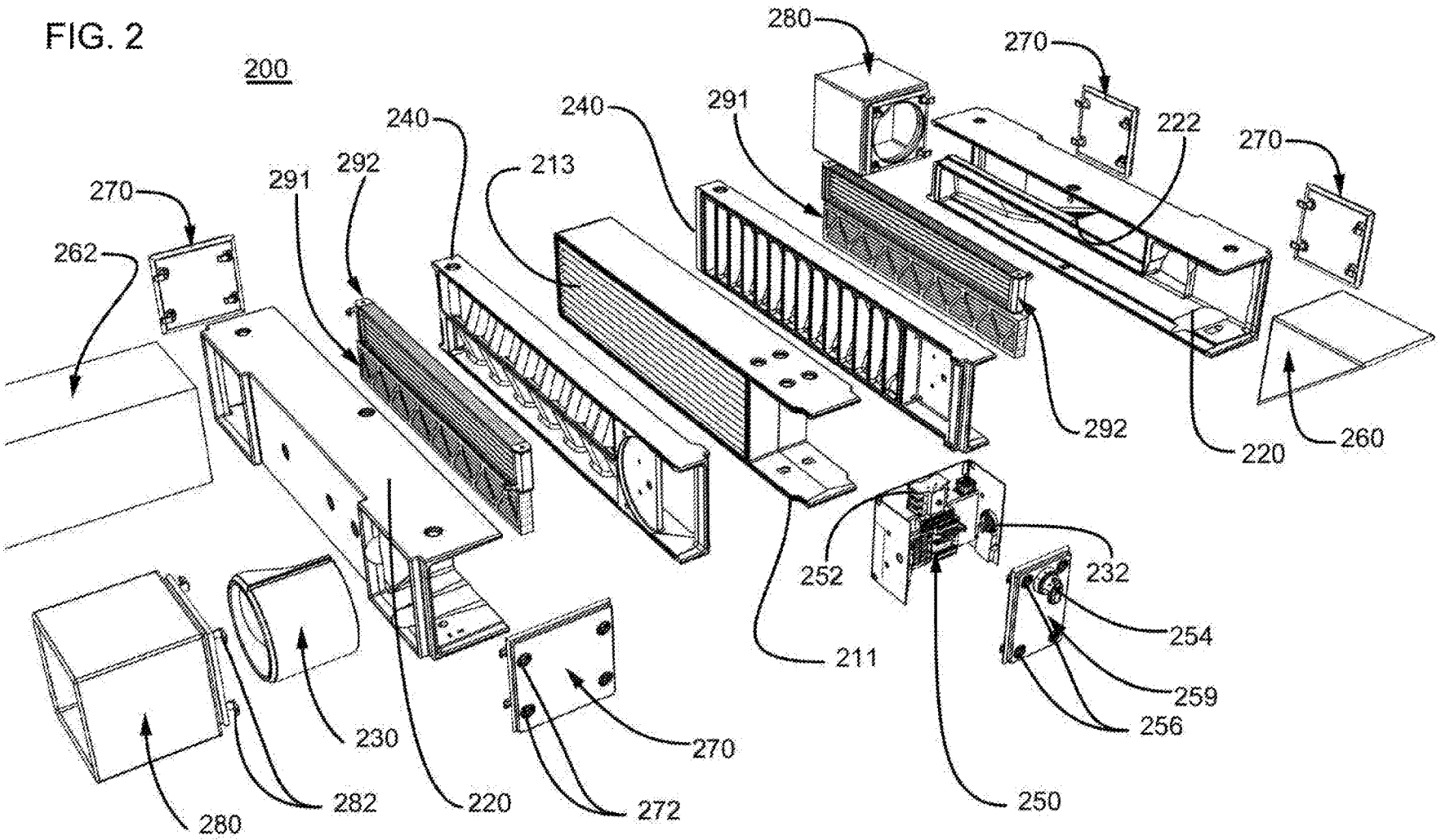
FIG. 2 illustrates an exploded view of an exemplary air handling module having a plurality of modular features, according to an exemplary disclosed embodiment.

FIG. 2 illustrates an exploded view of an air handling module 200 according to the present disclosure. As shown in FIG. 2, air handling module 200 may include an exchanger 213 configured to transfer heat and moisture from the treated air stream. Exchanger 213 may be composed of any number of suitable materials to promote various air processing and conditioning objectives including, but not limited to, plastic plates, metal plates, enthalpy ceramic porous plates, cellulous plates, and various combinations thereof. Exchanger 213 may be contained within an exchanger housing 211. Air handling module 200 may also provide for an integrated electrical cabinet. For example, in some embodiments, air handling module 200 may include a controller 250 configured to readily attach to and detach from housing 211, an electrical disconnect 252, and an actuator 232. An electrical access panel 259 may cover the electrical cabinet and may be disconnected from air handling module 200 to provide access to the electrical cabinet via latches 256 and a disconnect handle 254.

As shown in FIG. 2, air handling module 200 may further comprise one or more exchanger dividers 240. Exchanger divider 240 may be configured to direct airflow into and out of exchanger 213. Exchanger divider 240 may facilitate various airflow configurations and may be interchangeable with air handling module 200 depending on the application. In some embodiments, for example, exchanger divider 240 may facilitate cross-over airflow for air handling module 200. In other embodiments, for example, exchanger divider 240 may facilitate parallel airflow.

As will be discussed in more detail below, manifolds 220 each flanking an exchanger divider 240 may include internal air channel tracks and an air director 222 to further facilitate air conditioning function modularity. Air handling module 200 may also include heat exchangers 292 and filters 291 contained within manifolds 220. In some embodiments, heat exchanger 292 may be a suitable coil heat exchanger, such as, for example, condenser coils, evaporator coils, chilled water coils, hot water coils, and steam coils. Filter 291 may be any suitable particulate filter. It should be appreciated that in other embodiments, filter 291 may further include or be substituted for a variety of other components, such as, for example, UV lights, drop-stop filters, droplet separators, and gas absorption filters. As discussed above, the air handling module of the present disclosure may facilitate interchangeably connecting a variety of structures, such as, for example, metal ducts, weather hoods, roof curbs, and/or other fluidly connected components of an HVAC system.

As shown in FIG. 2, manifolds 220 include plurality of ports which serve as interchangeable attachment points for a number of structures, including, for example, fan box 280 attached via one or more latches 282, a weather hood 260, a metal duct 262, and an access panel 270 attached via one or more latches 272. Manifolds 220 may further include an aperture port to receive a rotary damper 230. Rotary damper 230 may be controlled by actuator 232.

FIGS. 3*a*-3*d* illustrate perspective view of a manifold 300 of an air handling module according to the present disclosure. As discussed above, manifold 300 may comprise a number of interchangeable attachment points to fluidly connect a variety of components of an HVAC system, including, for example, fan boxes, metal ducts, weather hoods, roof curbs, access panel and/or other. Manifold 300 may include a top channel track 320 and a bottom channel track 322. Channel track 320 and bottom channel track 322 may be separated by an air director 310 and a manifold divider 324 positioned between the tracks 320, 322. Manifold 300 may further include a top slide channel 350, a bottom slide channel 352, and an economizer track 360. In one embodiment, economizer track 360 may be a bearing track for a rotary damper.

Top slide channel 350 may receive an exchanger 390. Exchanger 390 may slide into and out of top slide channel 350 as indicated by arrow 390*a*. Exchanger 390 may be composed of any suitable thermal transfer devices, such as, for example, condensers, evaporators, fluid heat exchangers, and steam humidifiers. In one embodiment, exchanger 390 may be a suitable coil heat exchanger, such as, for example, condenser coils, evaporator coils, chilled water coils, hot water coils, and steam coils. Manifold 300 includes an inlet 392 and an outlet 394 to facilitate the flow of a heat transfer medium to and from exchanger 390.

A heat transfer medium, including, for example, liquid refrigerant, steam, chilled water, or hot water, may enter exchanger 390 thru inlet 392 and may exit exchanger thru outlet 394. Bottom slide channel 350 may receive a filter 391. Filter 391 may slide into and out of bottom slide channel 352 as indicated by arrow 391*a*. Filter 391 may be any suitable particulate filter. It should be appreciated that in other embodiments, filter 391 may further include or be substituted for a variety of other components, such as, for example, UV lights, drop-stop filters, droplet separators, and gas absorption filters.

Manifold 300 may also include a top drain port 332, a bottom drain port 342, and a side drain port 312. Top drain port 332 may facilitate access to top slide channel 350 and may provide a modular hydronic collection system for top slide channel 350. It should be appreciated that installers at an installation site may thereby access top drain port 332 according to site requirements. Top drain port 332 may be sealed by insulated plug 338. Bottom drain port 342 may facilitate access to bottom slide channel 352 and may provide a hydronic collection system for bottom slide channel 352. Side drain port 312 may provide an additional access and hydronic collection point for top channel track 320 in a direction perpendicular to top drain port 332. In one embodiment, top drain port 332 may have a threaded configuration. For example, top drain port 332 may be threaded with type British Standard Parallel Pipe (BSPP) along with an integrated sealing washer. Persons of ordinary skill in the art would appreciate that BSPP is compatible with other international standards including NPT, NPTS, and BSPT, enabling a global distribution model.

Figure 3A:
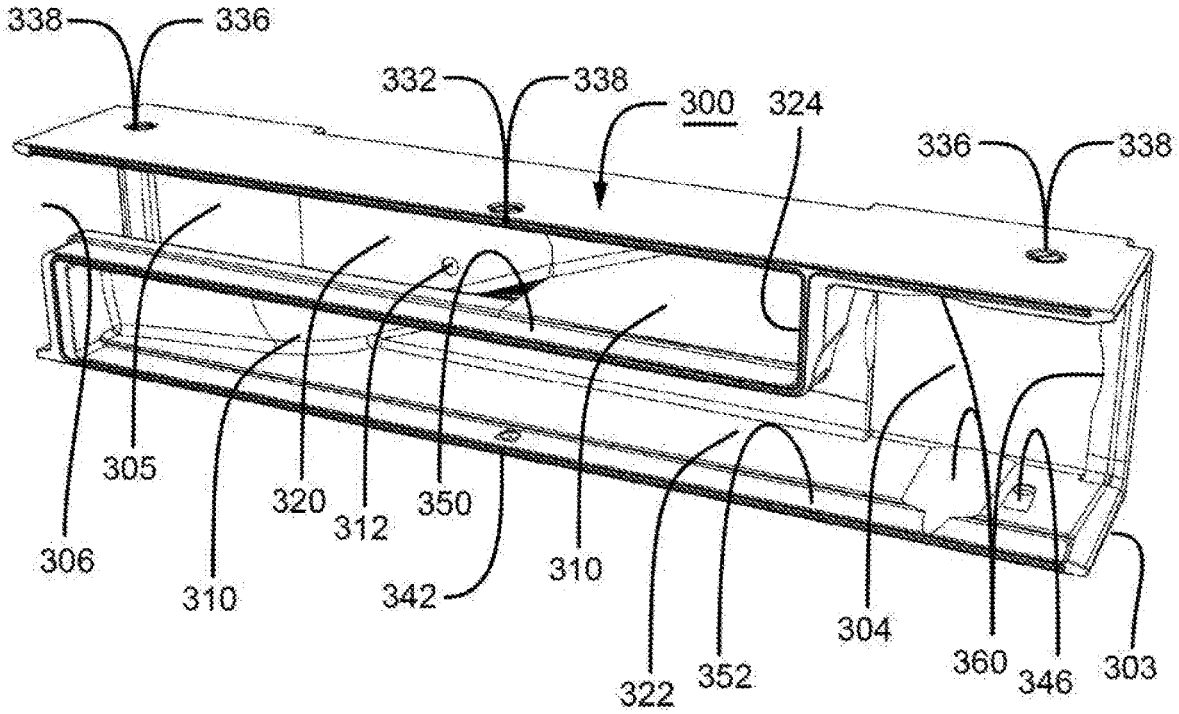
FIGS. 3*a*-3*d* illustrate cross-sectional perspective views of internal channel tracks of the air handling module, according to an exemplary disclosed embodiment.
Figure 3B:
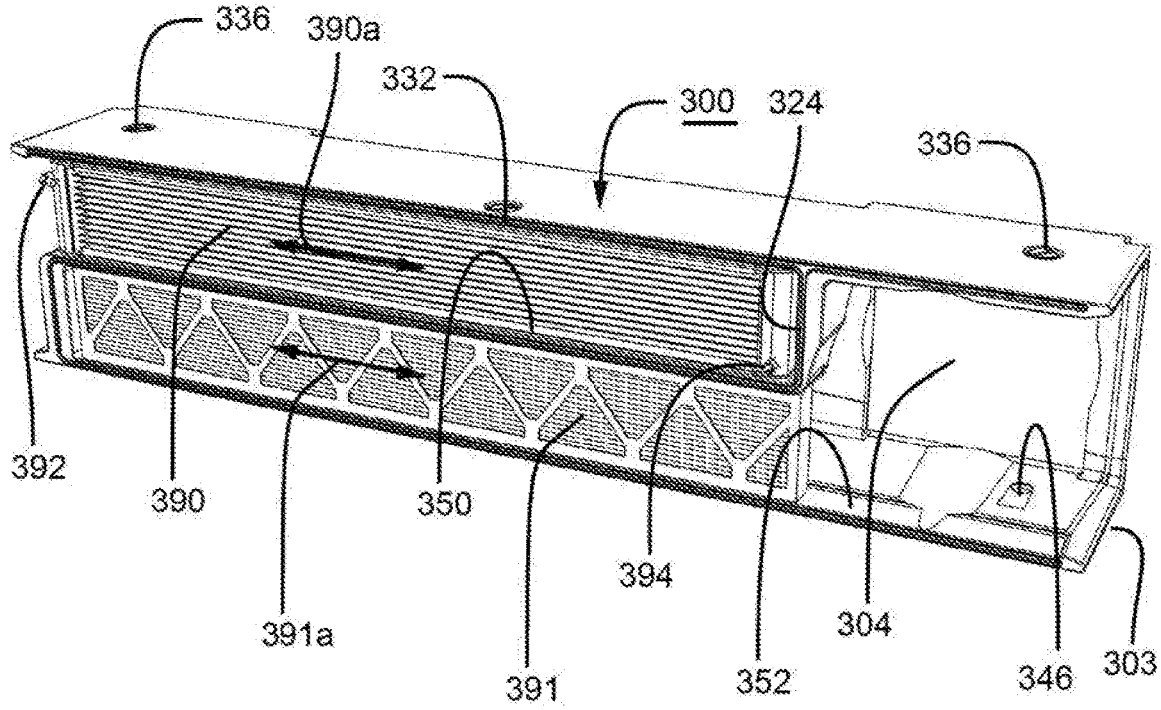
Figure 3C:
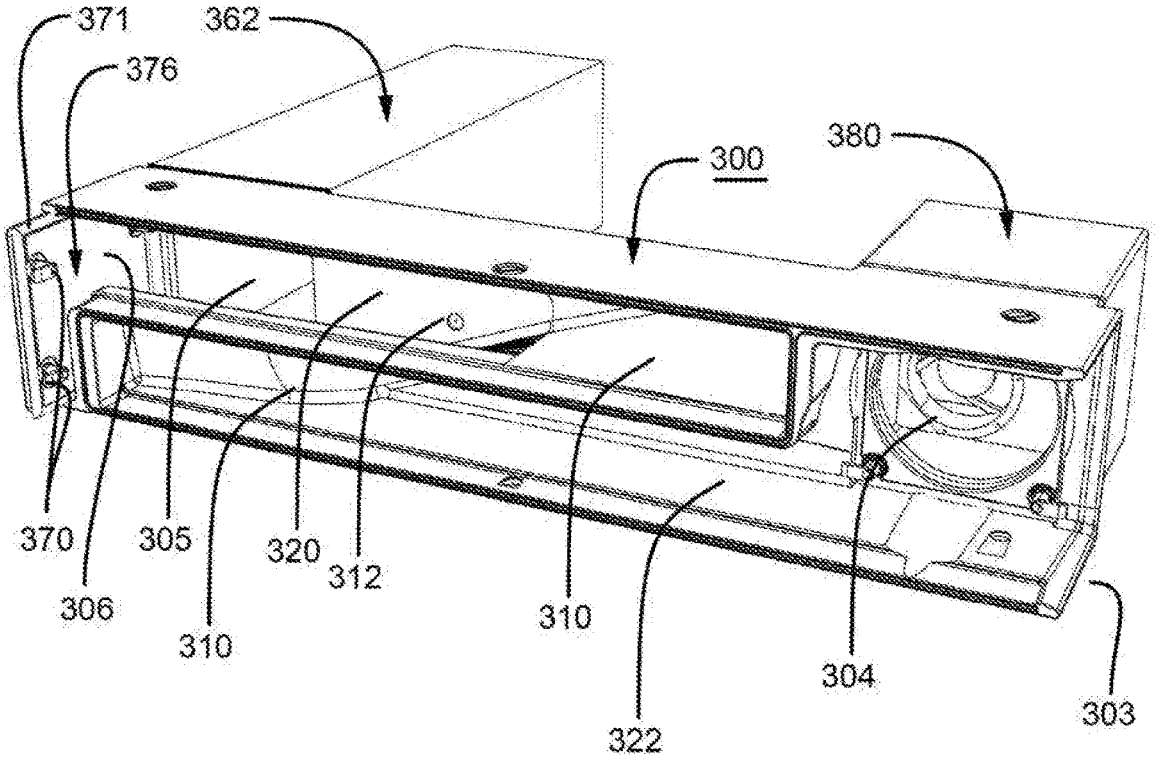
Figure 3D:
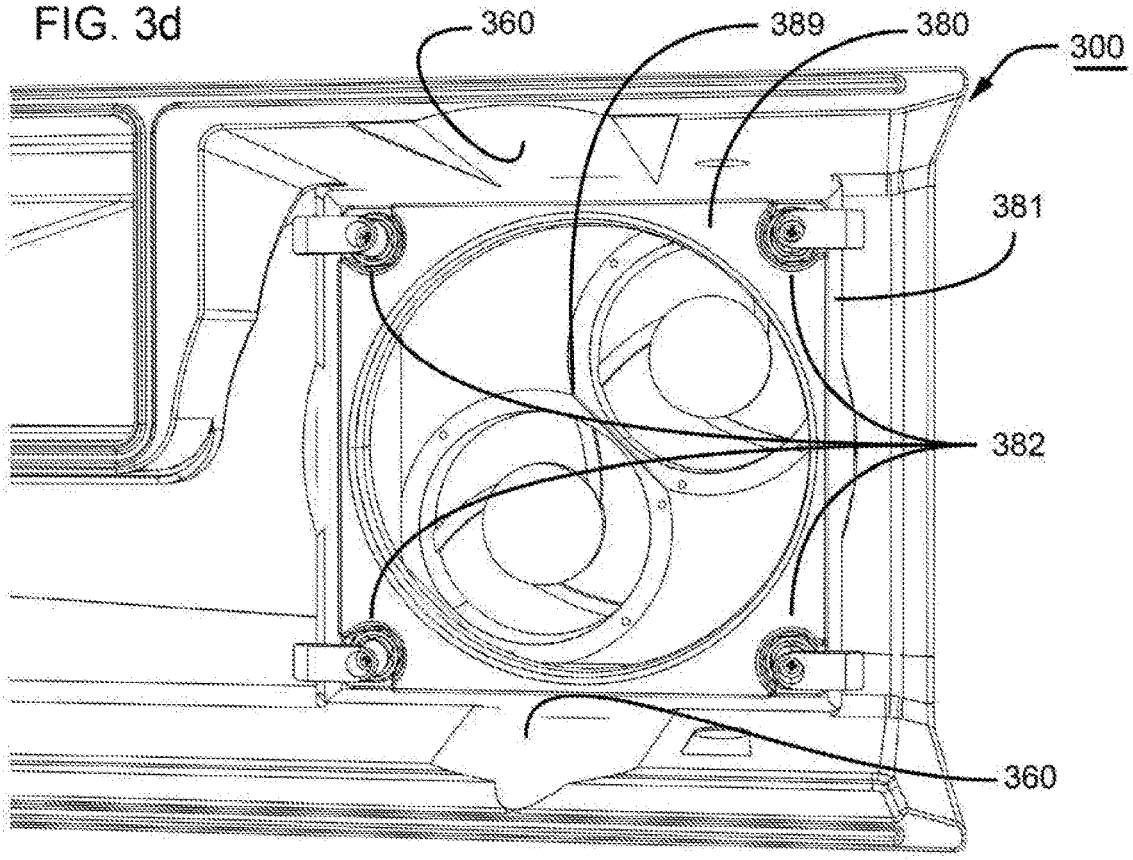

Manifold 300 may further comprise top anchor ports 336 and bottom anchor ports 346 configured to provide structural connection to an adjacent manifold or various structural supports. Manifold 300 also includes a plurality of air ports 303, 304, 305, and 306. As shown in FIG. 3*c*, in one embodiment, a duct 362 may be connected to manifold 300 via port 305, and port 306 may be covered by an access panel 376. Access panel 376 may include one or more latches 370 and a seal 371 to provide an air-tight connection to port 306.

Port 303 and port 304 may be positioned perpendicular relative to each other. Likewise, port 305 and port 306 may be positioned perpendicular relative to each other. Such a configuration may facilitate multi-directional installation of components to manifold 300 and adjacent port ready access. Moreover, ports 303, 304, 305, and 306 may provide a readily interchangeable and configurable manifold 300 for connecting to various HVAC and air handling components. Manifold 300 may facilitate a number of various on-site installation configuration options. Persons of ordinary skill would appreciate that any suitable number of access ports for manifold 300, oriented in any suitable configuration, and positioned in any suitable location of manifold 300, including, for example, the lateral, upper, and lower surfaces, is contemplated by the present disclosure.

In some embodiments, a fan box 380 containing one or more fans 389 may be attached to manifold 300 via port 304. Fan box 380 may include one or more latches 382 and a seal 381 to provide an air-tight connection to port 304.

As shown in FIG. 4*a*-4*h*, the air handling module 100 may also include a rotary damper 430. Rotary damper 430 may include a rotatable semi-cylindrical member 471. Rotary damper 430 may be configured to permit air flow in directions along the rotational axis of the semi-cylindrical member 471. The rotary damper 430 may also be configured to permit air flow in directions other than along the rotational axis of semi-cylindrical member 471. For example, the rotary damper 430 may permit air flow in directions normal to the rotational axis of semi-cylindrical member 471. A single rotary damper 430 may eliminate the need for a pair of face and bypass dampers acting in unison.

Rotary damper 430 may have at least four potential modes within air handling module 100. The first mode may be to facilitate a complete or partial economizer bypass around exchanger 213 in order to directly supply outside air (OA) as the supply air (SA), thereby providing free cooling to a building or enclosure. The second mode may be to facilitate a complete or partial defrost bypass around exchanger 213 in order to prevent ice buildup from cold outdoor air (e.g., below freezing). The third mode may be to facilitate a complete or partial bypass around exchanger 213 in order to modulate the sensible-to-latent ratio of supply air with a wrap-around air handling module. The fourth mode may be to facilitate a regeneration cycle within exchanger 213 to drive off water vapor, carbon dioxide, and/or other VOC contaminants. Other uses and modes for rotary damper 430 may be apparent to those skilled in the art and any such function may be used in the practice of the present disclosure.

Rotary damper 430 may comprise semi-cylindrical member 471, shaft mounting plate 486 (which may be secured by bolts 487), and shaft 484 with utility tube 485 disposed within. Shaft 484 may be directly connected to rotary damper actuator 432 providing continuous clockwise and/or counterclockwise rotation. Semi-cylindrical member 471 may include an end wall 478 with integrated seal channel 483, an outer surface 476 with integrated seal channel 482, an inner surface 477, and an end ring 479 with integrated seal channel 481. In some embodiments, rotary damper 430 may be made of an insulating material and/or may be a hollow structure filled with insulating material, such as, for example, urethane foam, metal oxide, or fiberglass, to provide insulating qualities and to avoid condensation or ice accumulation.

Rotary damper 430 may be structurally positioned between manifold 400 and exchange divider 440. Rotary damper 430 may be fluidly positioned between two air inlets. The first air inlet to rotary damper 430 may originate from exchanger 213 and may be physically located in bottom channel track 422 of manifold 400, represented by arrow 466. The second air inlet may be located at exchanger divider 440 and may originate from port 401, represented by arrow 467. Rotary damper 430 outlet may be fluidly positioned to and face port 404.

For example, rotary damper 430 may be a rotary air damper configured to selectively control the source of the supply air (SA). In some embodiments, rotary damper 430 may be positioned in the bottom channel track 422 of the manifold 400, as shown in FIGS. 4*a*-4*h*. Rotary damper 430 may be configured to selectively deliver treated air exiting from the exchanger 213 as supply air (SA) or directly deliver outside air (OA) as supply air (SA). Rotary damper 430 may include a manifold section 400 and an exchanger divider section 440 rotatably coupled to the manifold section 400. The exchanger divider section 440 may include semi-cylindrical member 471 having a first opening 473 in fluid connection to the manifold section 400 and a second opening 472 on the side surface of the semi-cylindrical member 471. In some embodiments, rotary damper 430 may be disposed within conventional ductwork or HVAC systems.

Rotary damper 430 may permit air flow in a direction along the X-rotational axis of the semi-cylindrical member 471. Rotary damper 430 may also permit air flow in a direction other than along the X-rotational axis of the semi-cylindrical member 471. The side surface of the semi-cylindrical member 471 opposite the second opening may block air flow.

Figure 4A:
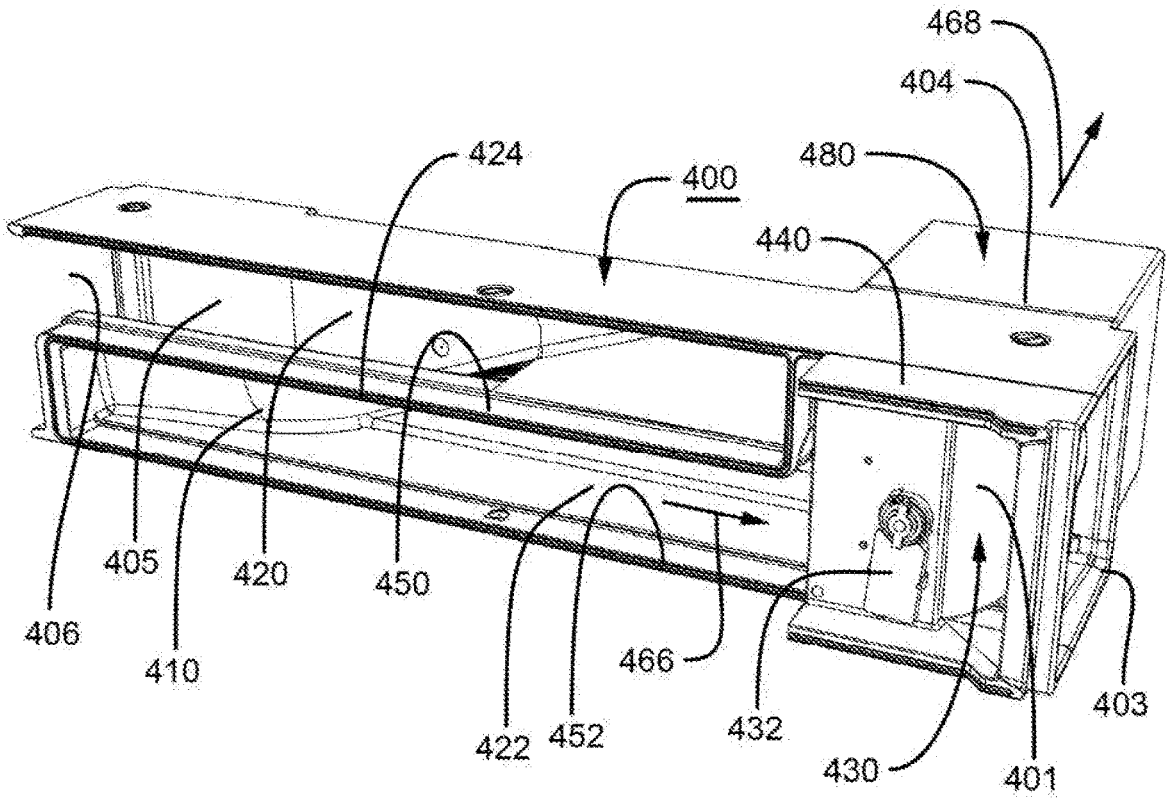
FIGS. 4*a*-4*h* illustrate perspective views of a rotary damper, according to an exemplary disclosed embodiment.
Figure 4B:
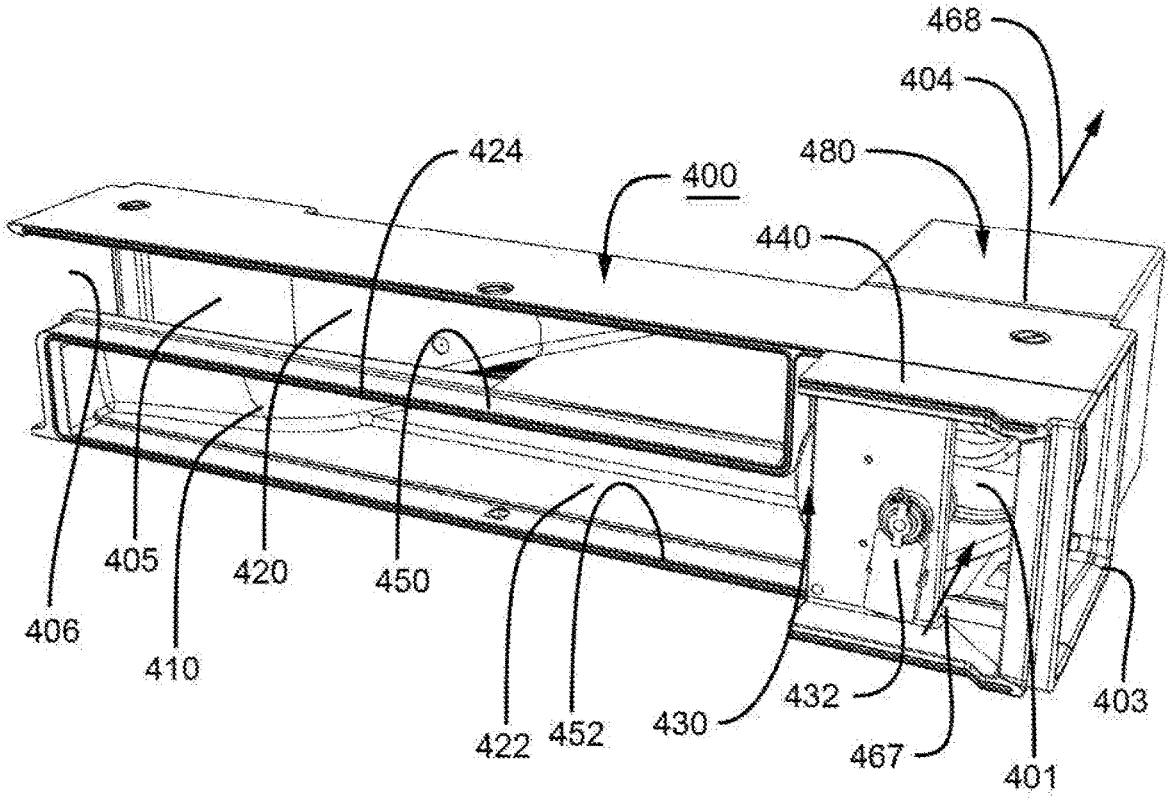
Figure 4C:
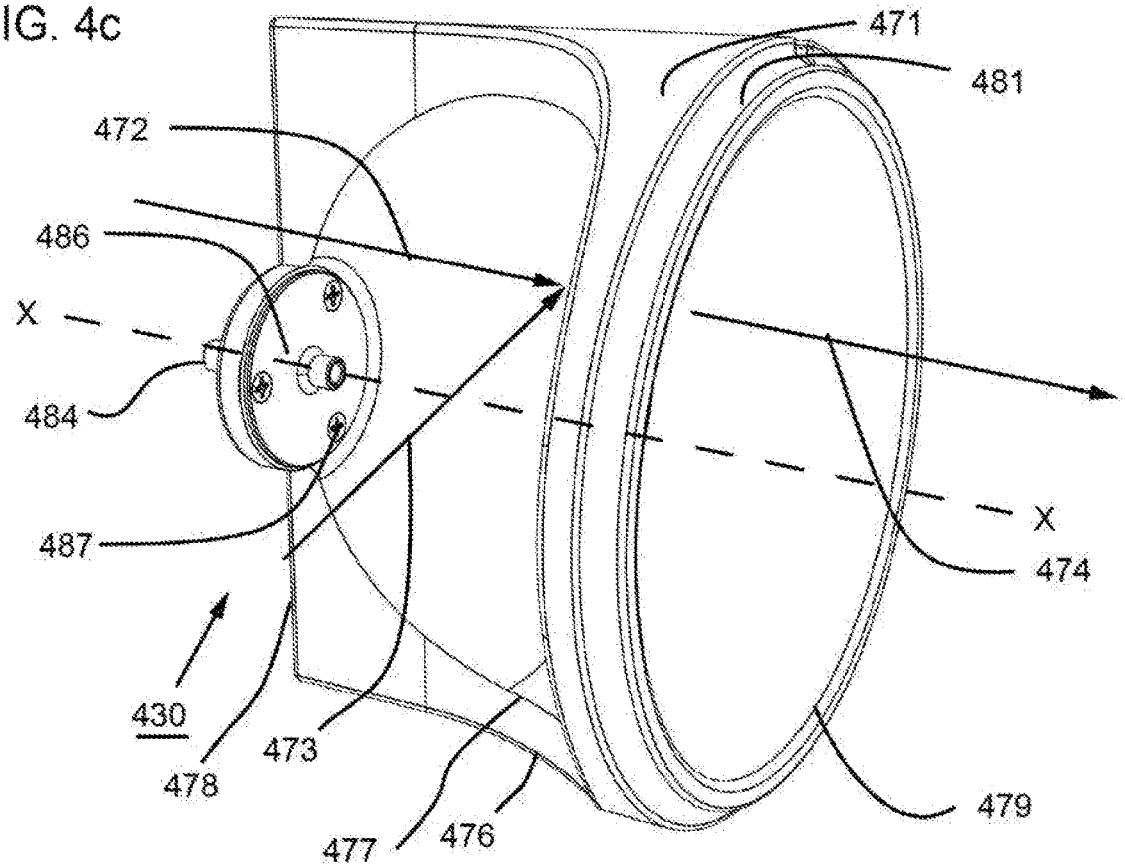

FIG. 4*c* is a perspective view of rotary damper 430 according to the present disclosure. Rotary damper 430 may facilitate fluid inlet 472 along the X-axis shaft 484, as well as fluid inlet 473 perpendicular to the X-axis shaft 484. Fluid outlet 474 may pass through end ring 479 with integrated end sealed channel 481 containing end ring seal 490.

Figure 4D:
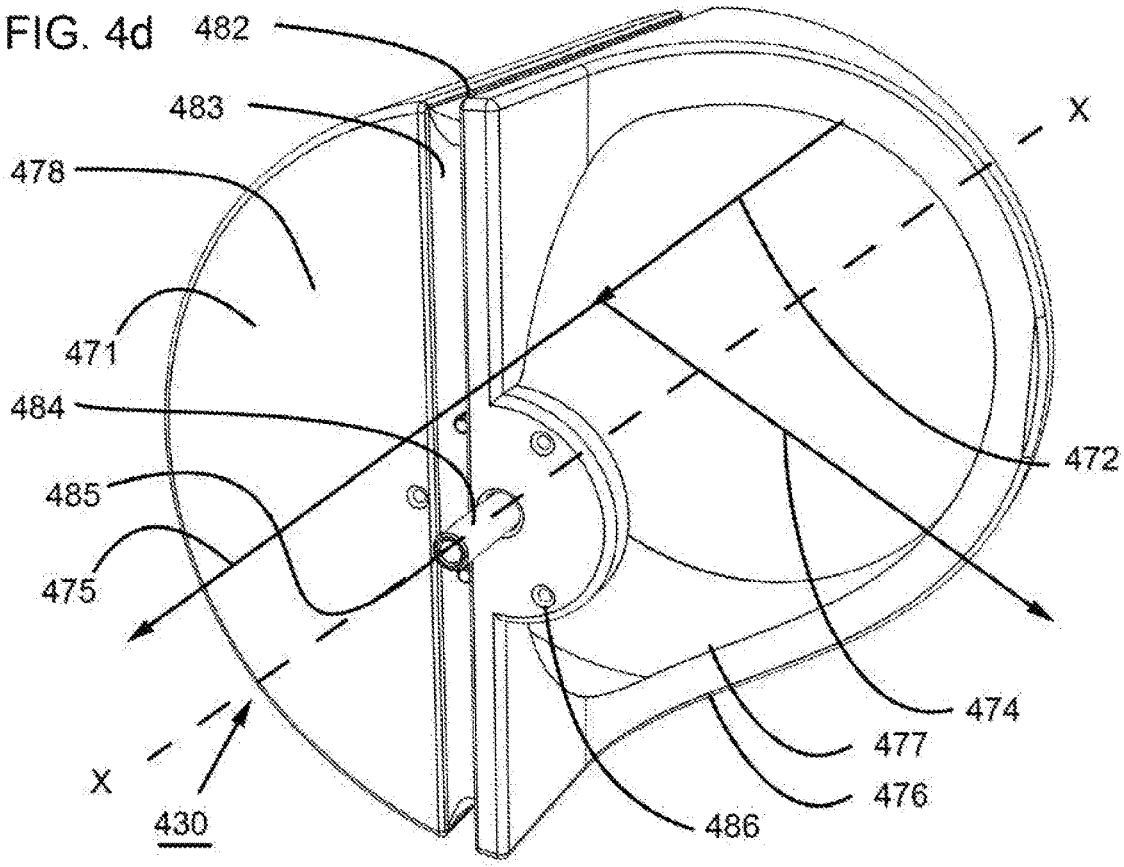

FIG. 4*d* is another perspective view of rotary damper 430 according to the present disclosure. Fluid inlet 472 may pass through end ring 479 with integrated end sealed channel 481 containing end ring seal 490. Rotary damper 430 may facilitate fluid outlet 475 along the X-axis shaft 484, as well as fluid inlet 474 perpendicular to the X axis shaft 484.

Figure 4E:
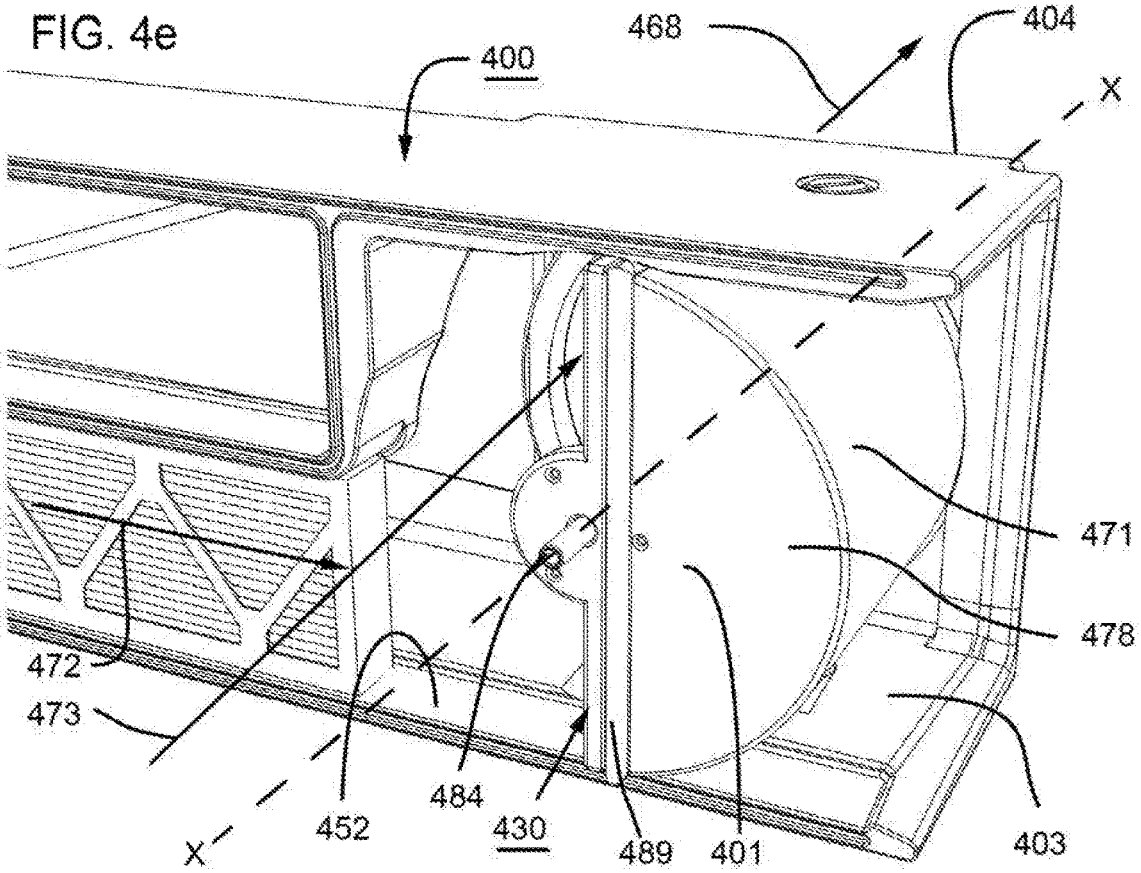

As shown in FIG. 4*e*, the semi-cylindrical member 471 may be rotated about X-axis shaft 484 to a first position to adjust the direction of fluid flowing through the first opening 422 represented by fluid inlet 473 and second openings 404 represented by fluid outlet 468. For example, the semi-cylindrical member 471 may be rotated to a first position, wherein the second fluid outlet 468 faces the outlet port 404 for the supply air (SA) stream. In the first position, treated air exiting from the exchanger 213 may be directed through the manifold 400 and the first and second openings 422, then through 404 of the semi-cylindrical member 471, and may then exit the air handling module 100 as supply air (SA). The outside air (OA) entering the air handling module 100 may be blocked by the end wall 478 of the semi-cylindrical member 471 opposite the second opening 404 and facing the direction of the outside air (OA) flow. End wall seal 489 may prevent or restrain fluid flow 473 from leaking thru to port opening 401.

Figure 4F:
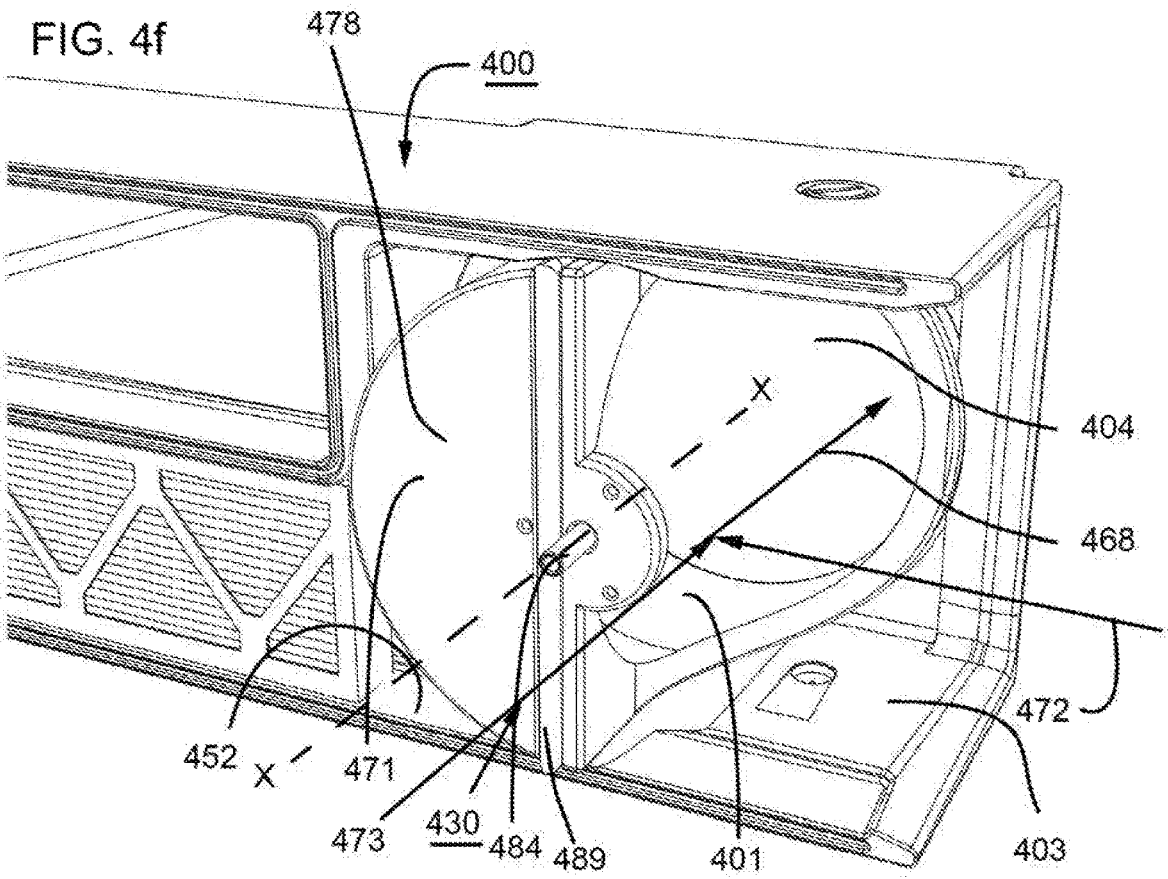

As shown in FIG. 4*f*, the semi-cylindrical member 471 may be rotated about X-axis shaft 484 to a second position to adjust the direction of fluid flowing through the third opening 401 represented by fluid inlet 473 and second openings 404 represented by fluid outlet 468. Semi-cylindrical member 471 may seal off passage 422, and thus block fluid flow thru exchanger 213. Outside air (OA) flow entering the air handling module 100 may enter the semi-cylindrical member 471 and may be directly delivered as supply air (SA). The rotation of the semi-cylindrical member 471 may be controlled by any suitable power source, such as, for example, a rotary motor 432. End wall seal 489 may prevent or restrain fluid flow 473 from leaking thru to port opening 401.

Figure 4G:
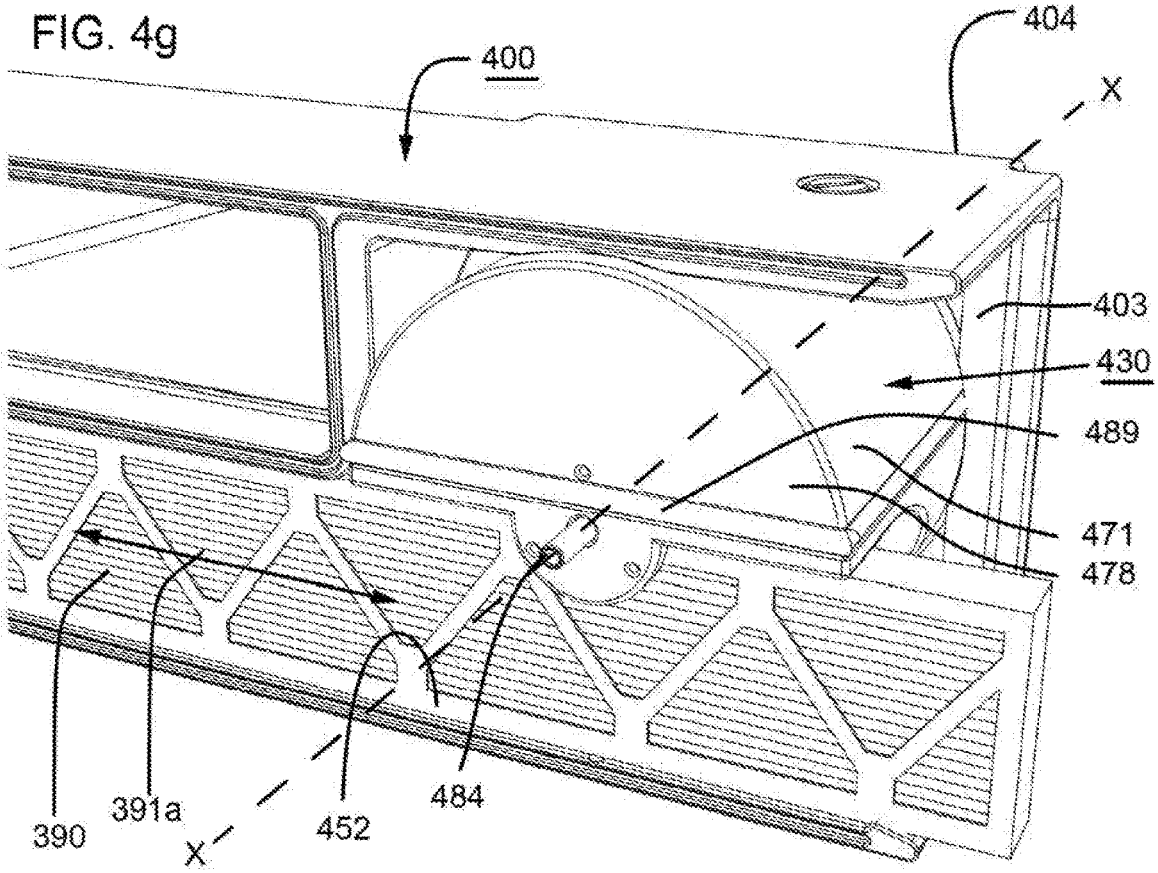

As shown in FIG. 4*g*, the semi-cylindrical member 471 may also be rotated about X-axis shaft 484 to a third position to facilitate the installation or removal of air filter or coil 390. Filter or coil 390 may slide in or out along bottom slide channel 452 as depicted by arrow 391*a*. In this embodiment, end wall seal 489 may be positioned parallel to the bottom slide channel 452. Rotary damper actuator 432 may include a manual override so that semi-cylindrical member 471 may be manually positioned to minimize any risk of injury or damage during operation.

Figure 4H:
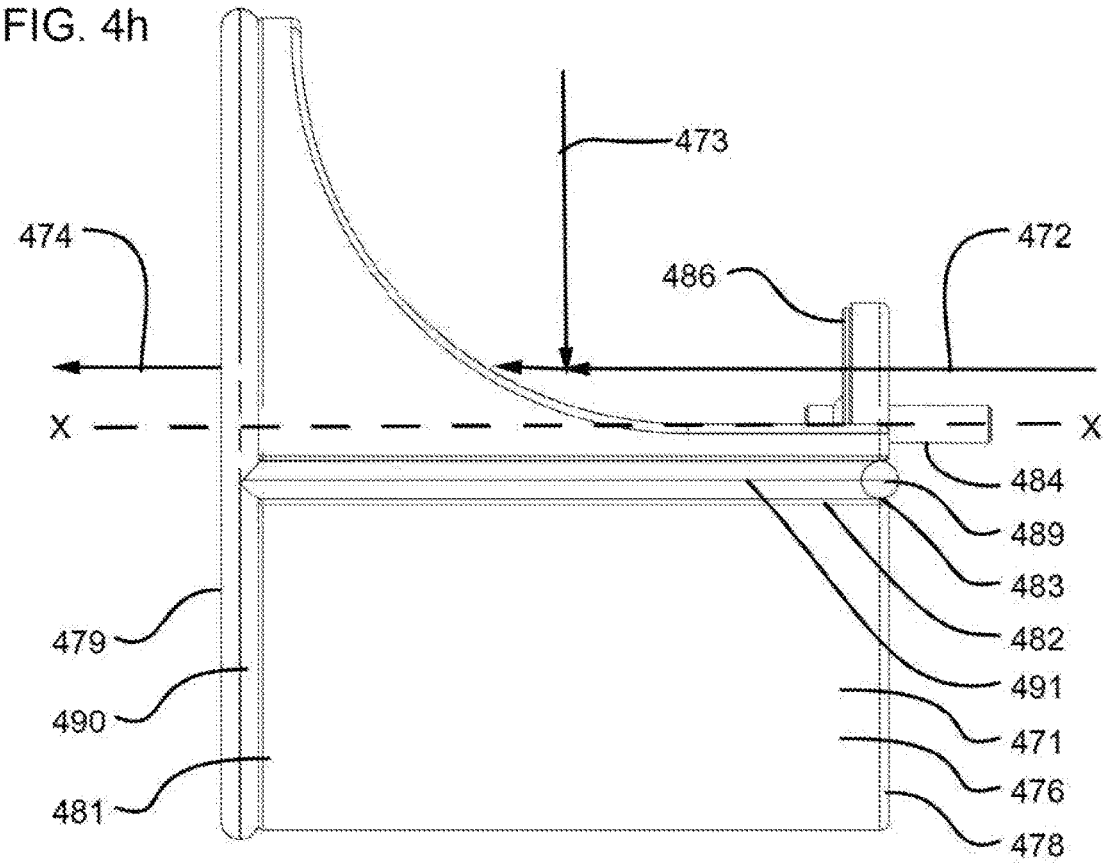

FIG. 4*h* is a side view of rotary damper 430 according to the present disclosure. Rotary damper 430 may facilitate fluid inlet 472 along the X-axis shaft 484 as well as fluid inlet 473 in a direction other than along the X-axis shaft 484. Fluid outlet 474 may pass through end ring 479 with integrated end sealed channel 481 containing end ring seal 490.

Existing HVAC or ERV systems may employ multiple air dampers to control the direction of air flow. Each damper may be dedicated to controlling the direction of a single source of air flow. Typically, conventional air dampers may be rectangular or square shaped frames with movable louvers to permit and block the flow of air. Rotary damper 430 of the present disclosure may be positioned at the intersection of two different air flows and may regulate the direction of both air flows by rotating the semi-cylindrical member 471. As a result, rotary damper 430 of the present disclosure obviates the need for multiple or separate air dampers. Semi-cylindrical member 471 of rotary damper 430 may be rotated by any desired amount to proportionally control and vary the mixing ratio of air streams and/or the volume of air passed through rotary damper 430.

Figure 5A:
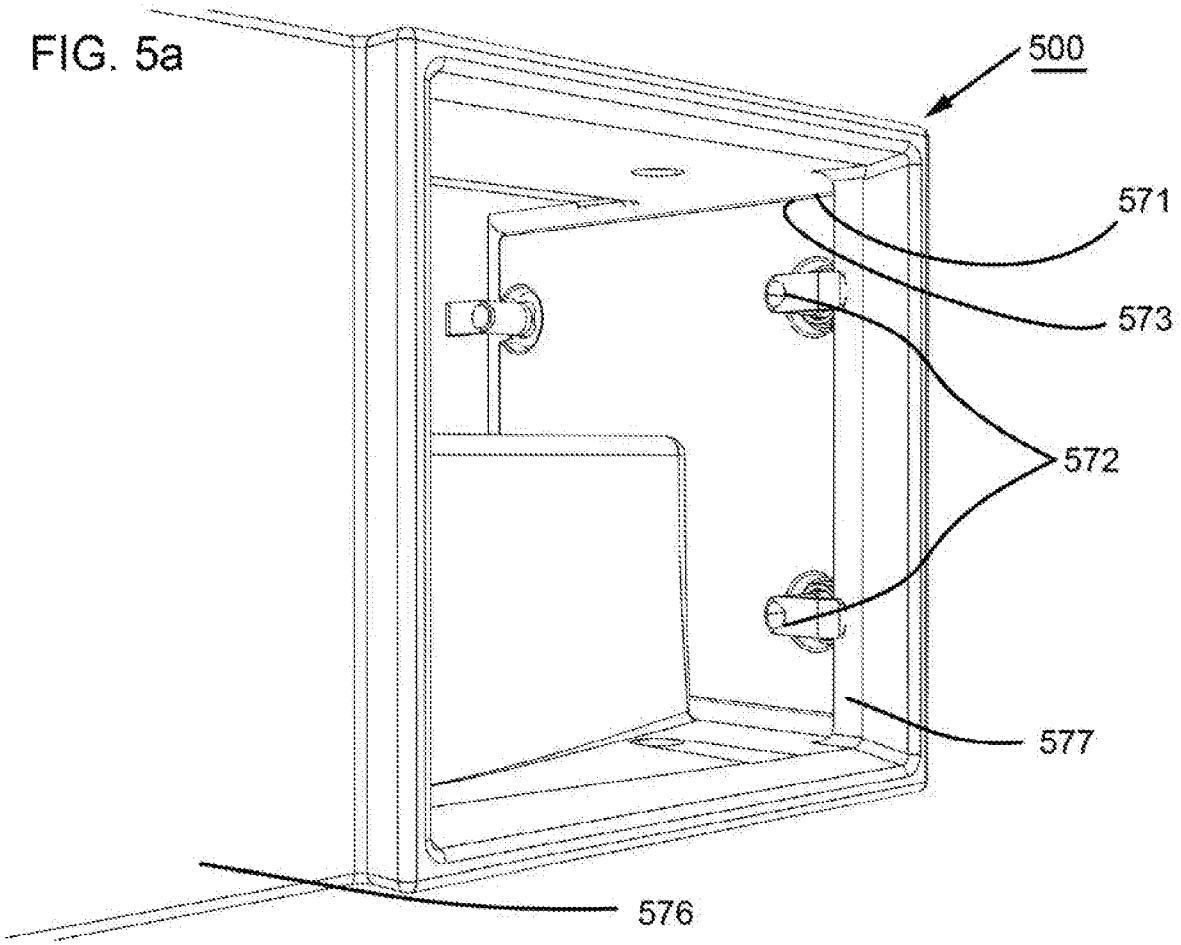
FIGS. 5*a* and 5*b* illustrate perspective views of access panels, according to an exemplary disclosed embodiment.
Figure 5B:
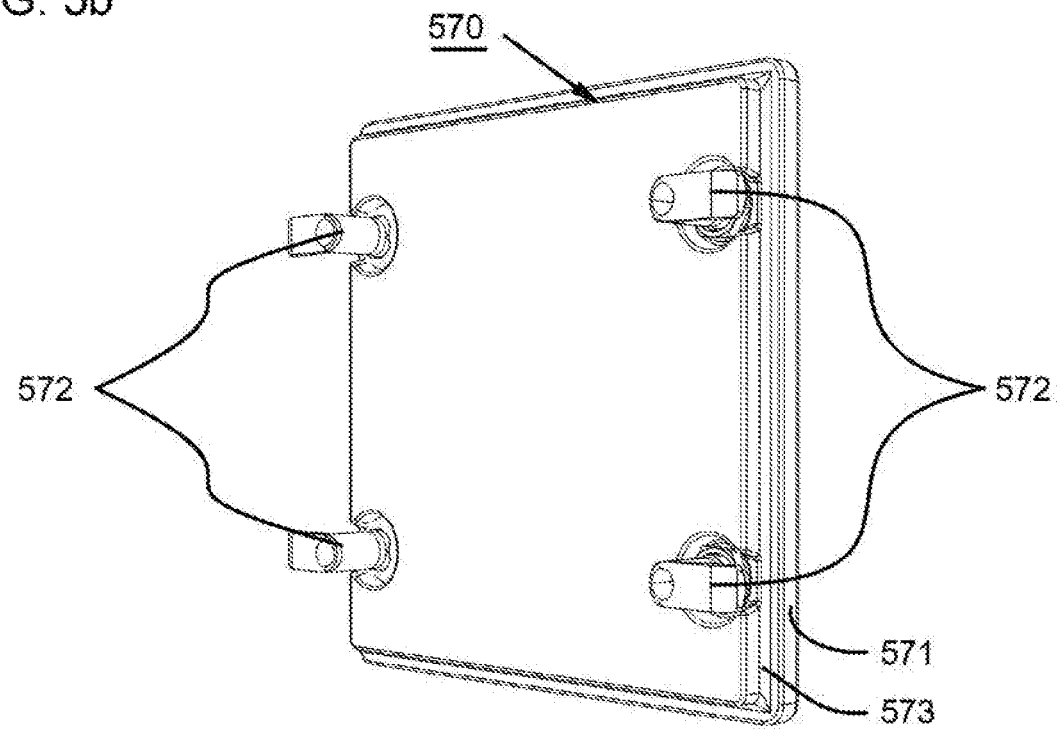

FIGS. 5*a* and 5*b* illustrate perspective views of an access panel 570 according to the present disclosure. As discussed above, access panel 570 may readily attach to, and detach from, air ports of an air handling module 500. Access panel 570 may include one or more latches 572 to engage and hold access panel 570 onto an inner surface 577 of air handling module 500. In one embodiment, latches 572 may include a screw and thread configuration to engage and disengage latches 572 by tightening or loosening the screw. Access panel 570 may also include a seal 573 disposed on an access panel seal channel. Seal 573 may engage with an outer surface 576 of air handling module 500 to provide an air-tight connection between the access panel 570 and the port. In other embodiments, a single twist handle (not shown) may actuate latches 572 in a linear or semi-circular fashion. Access panel 570 may operate in any orientation and may provide for complete, interchangeable access to internal components of the air handling module.

Figure 6A:
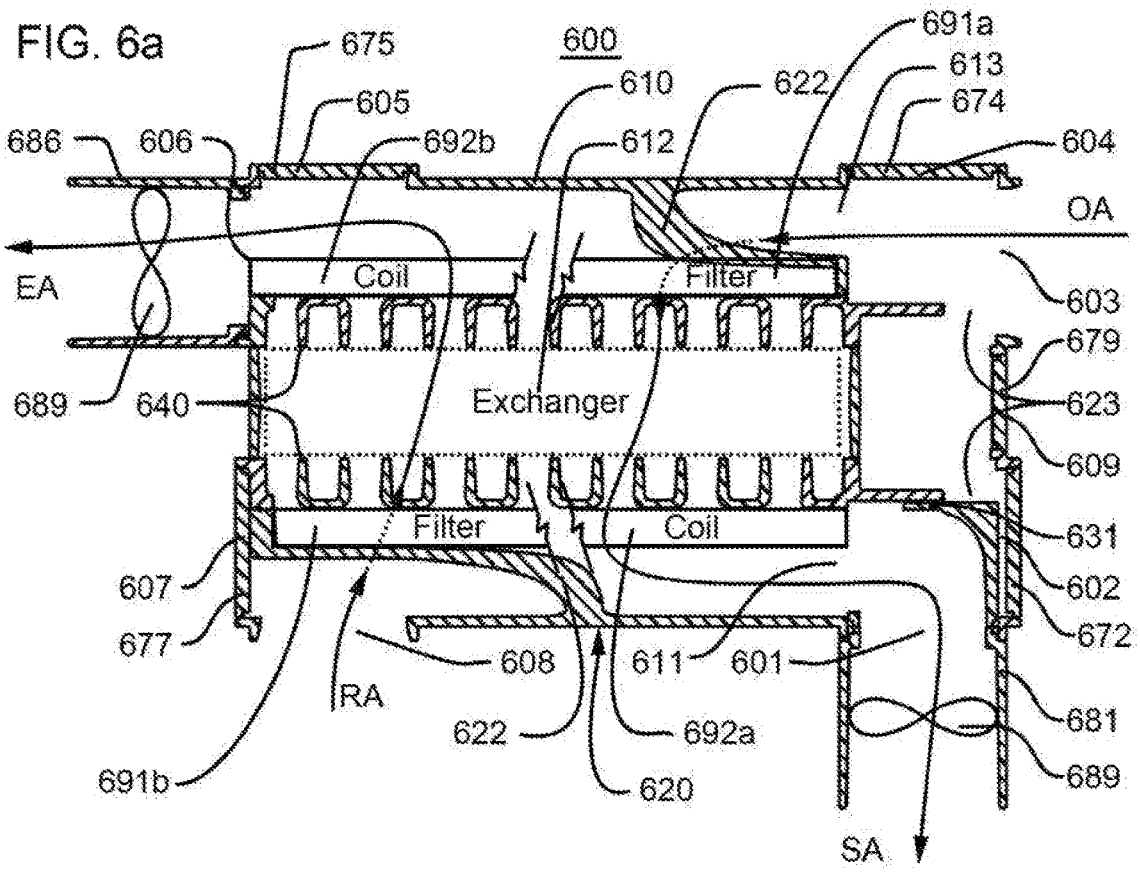
FIGS. 6*a*-6*h* illustrate cross-sectional views of fan boxes facilitating air flow into and out of the air handling module and interchangeable exchanger dividers facilitating a cross-flow airflow pattern, according to an exemplary disclosed embodiment.

FIGS. 6*a*-6*h* illustrate the modularity of the air handling module of the present disclosure by illustrating exemplary configurations of the air handling module. FIG. 6*a* illustrates a cross-sectional view along the dashed line shown in FIG. 1 of an air handling module 600 in a first configuration according to the present disclosure. Air handling module 600 may include a fan box 686 coupled to port 606 and a fan box 681 coupled to port 601. Fan box 686 and fan box 681 may be configured to pull air flow into and out of a housing 620. Air handling module 600 may include an air-to-air heat exchanger 612 contained within housing 620. Air handling module 600 may also include a first pair of ports 601-602 fluidly connected to a second pair of ports 603-604. One or both of the second pair of ports 603-604 may receive outside air (OA). Air may flow through housing 620 and may be discharged from air handing module 600 through one or both of the first pair of ports 601-602 as supply air (SA). Air handling module 600 may further include a third pair of ports 605-606 fluidly connected to a fourth pair of ports 607-608. One or both of the fourth pair of ports 607-608 may receive return air (RA). Exhaust air (EA) may be discharged from air handing module 600 through one or both of the third pair of ports 605-606.

Outside air (OA) may enter housing 620, which may comprise sides 610, through port 603 and may flow through opening 613, while paired port 604 may be sealed by an access panel 674. An air director 622 and an exchanger divider 640 may direct outside air (OA) through filter 691*a*, exchanger 612, and supply air coil 692*a*. Exchanger 612 may be any suitable exchanger for promoting a variety of air processing and conditioning objectives, including, but not limited to, sensible plate type, enthalpy plate type, wheel type, heat pipe, indirect evaporation type, direct evaporation type, liquid desiccant type, carbon dioxide scrubbing, VOC scrubbing, and various other types of exchangers know to those skilled in the art. One or more fans 689 may be positioned inside fan box 681 and may pull supply air (SA) from exchanger 612, through an opening 611, and out of port 601, while paired port 602 may be sealed by an access panel 672. One or more fans 689 may be positioned inside fan box 686 and may pull exhaust air (EA) from exchanger 612 and out of port 606, while paired port 605 may be sealed by access panel 675. A rotary damper 631 may seal bypass openings 623, and a port 609 may be sealed by an access panel 679.

Return air (RA) may enter air handling module 600 through port 608, while paired port 607 may be sealed by an access panel 677. An air director 622 and an exchange divider 640 may direct return air (RA) through a filter 691*b*, exchanger 612, and an exhaust air coil 692*b*. Supply air coil 692*a* and exhaust air coil 692*b* may be any suitable thermal transfer device for promoting a variety of air processing and conditioning objectives, including, but not limited to, a condenser coil, an evaporator coil, a chilled water coil, a hot water coil, a steam coil, a carbon dioxide scrubber, and/or a VOC scrubber.

Figure 6B:
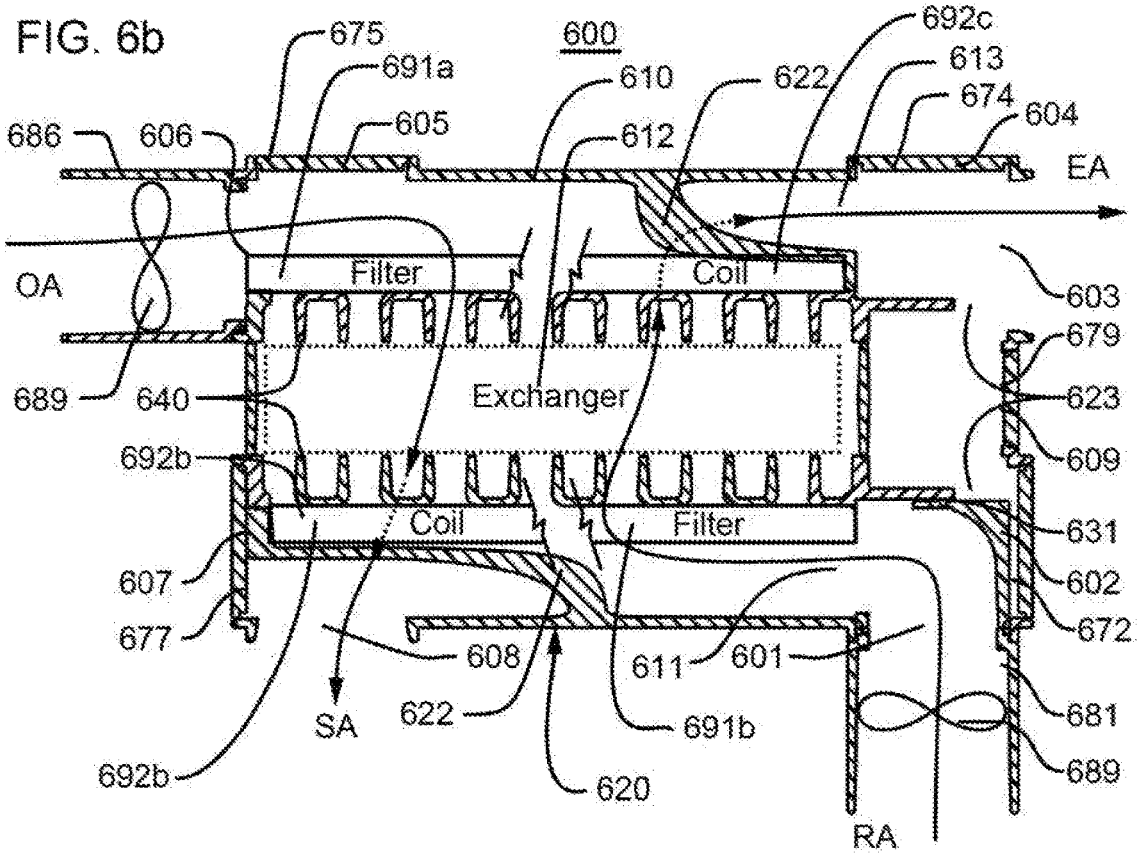

FIG. 6*b* illustrates a cross-sectional view of air handling module 600 in a second configuration according to the present disclosure. As shown in FIG. 6*b*, fan box 686 may be coupled to port 606 and fan box 681 may be coupled to port 601. Fan box 686 and fan box 681 may be configured to push air flow into and out of housing 620. One or both of third pair of ports 605-606 may receive outside air (OA). Air may flow through housing 620 and may be discharged from air handing module 600 through one or both of fourth pair of ports 607-608 as supply air (SA). One or both of first pair of ports 601-602 may receive return air (RA). Exhaust air (EA) may flow through housing 620 and may be discharged from air handing module 600 through one or more of second pair of ports 603-604.

One or more fans 689 of fan box 686 may push outside air (OA) entering at port 606 through housing 620 and exchanger 612, while paired port 605 may be sealed by access panel 675. Air director 622 and exchanger divider 640 may direct outside air (OA) through filter 691*a*, exchanger 612, and supply air coil 692*b*. One or more fans 689 of fan box 681 may push return air (RA) entering at port 601 through opening 611, housing 620, and exchanger 612, while paired port 602 may be sealed by access panel 672. Air director 622 and exchange divider 640 may direct return air (RA) through filter 691*b*, exchanger 612, and exhaust air coil 692*c*. Supply air (SA) may exit port 608, while paired port 607 may sealed by access panel 677. Exhaust air (EA) may flow through opening 613 and exit port 603, while paired port 604 may be sealed by access panel 674. Rotary damper 631 may seals bypass openings 623, and port 609 may be sealed by access panel 679.

Figure 6C:
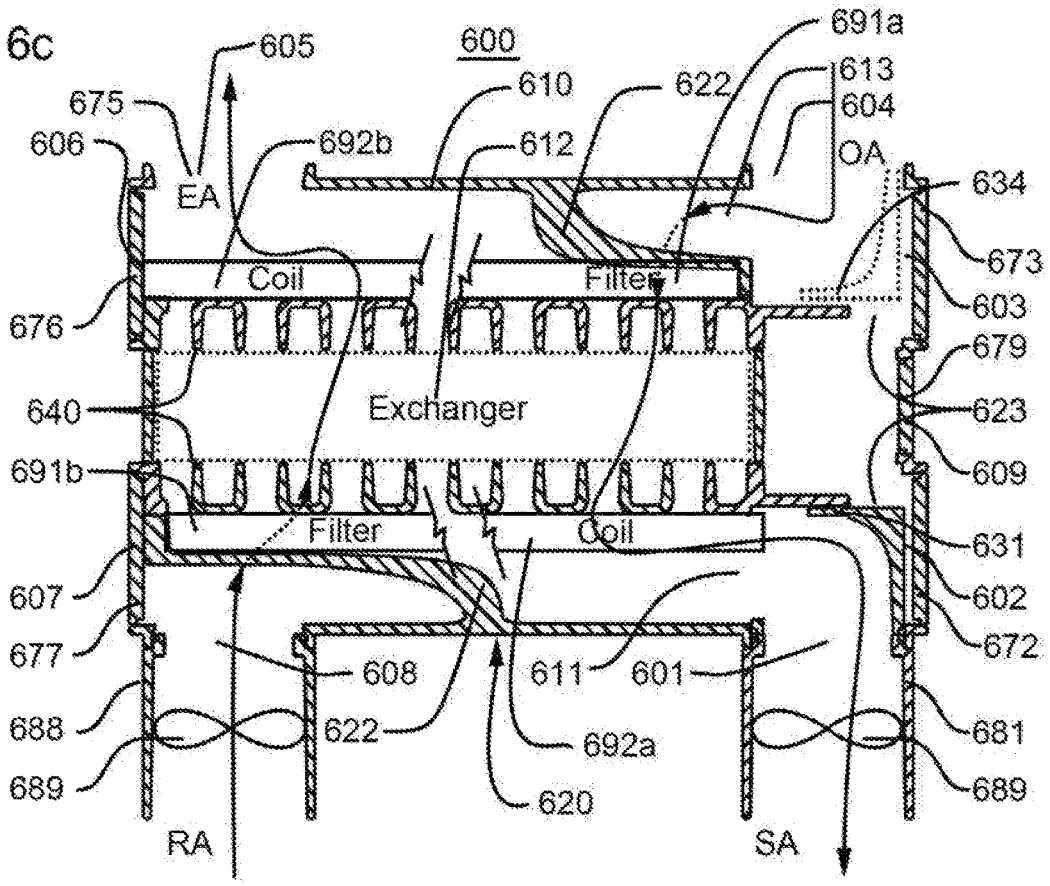

FIG. 6*c* illustrates a cross-sectional view of air handling module 600 in a third configuration according to the present disclosure. As shown in FIG. 6*c*, a fan box 688 may be coupled to port 608 and fan box 681 may be coupled to port 601. Fan box 688 and fan box 681 may be configured to push and pull air flow into and out of housing 620. One or both of second pair of ports 603-604 may receive outside air (OA). Air may flow through housing 620 and may be discharged from air handing module 600 through one or both of first pair of ports 601-602 as supply air (SA). One or both of fourth pair of ports 607-608 may receive return air (RA). Exhaust air (EA) may flow through housing 620 and may be discharged from air handing module 600 through one or both of third pair of ports 605-606.

Outside air (OA) may enter housing 620 through port 604 and may flow through opening 613, while paired port 603 may be sealed by access panel 673. Air director 622 and exchanger divider 640 may direct outside air (OA) through filter 691*a*, exchanger 612, and supply air coil 692*a*. One or more fans 689 of fan box 681 may pull supply air (SA) from exchanger 612, through opening 611, and out of port 601, while paired port 602 may be sealed by an access panel 672. Rotary damper 631 and optional rotary damper 634 may seal bypass openings 623, and access panel may 679 may seal port 609. One or more fans 689 may be positioned inside of fan box 688 and may push return air (RA) entering at port 608 through housing 620 and exchanger 612, while paired port 607 may be sealed by access panel 677. Air director 622 and exchange divider 640 may direct return air (RA) through filter 691*b*, exchanger 612, and exhaust air coil 692*b*. Exhaust air (EA) may exit port 605, while paired port 606 may be sealed by an access panel 676.

Figure 6D:
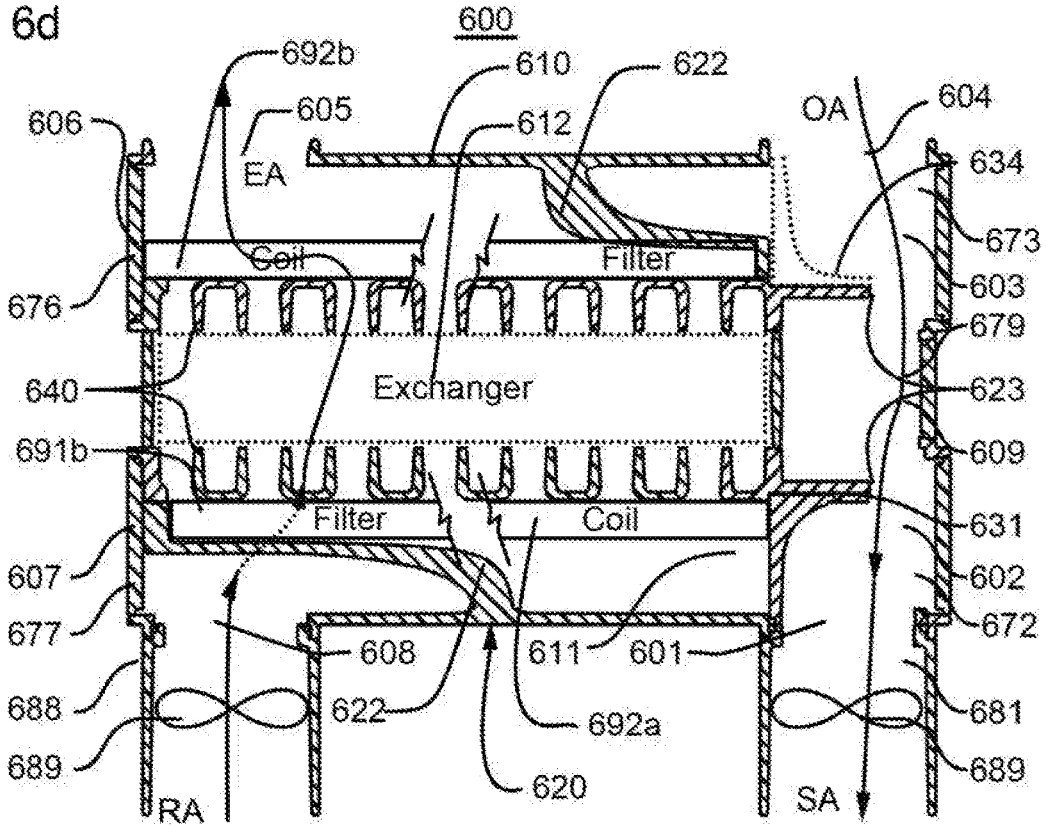

FIG. 6*d* illustrates a cross-sectional view of air handling module 600 in a fourth configuration according to the present disclosure. The embodiment of FIG. 6*d* provides a configuration of air handling module 600, wherein one air flow may bypass exchanger 612 to facilitate an economizer, a defrost, and/or a carbon dioxide scrubbing regeneration function. An economizer function may be an energy efficiency measure that may increase ventilation rates due to a lower pressure drop when bypassing exchanger 612. The economizer function may be implemented during mild weather to reduce the need for mechanical cooling. Further, the economizer function may decrease respiratory issues by supplying a higher percentage of outside air.

As shown in FIG. 6*d*, fan box 688 may be coupled to port 608 and fan box 681 may be coupled to port 601. Fan box 688 and fan box 681 may be configured to push and pull air flow into and out of housing 620. One or both of second pair of ports 603-604 may receive outside air (OA). Air may flow through housing 620 and may be discharged from air handing module 600 through one or both of first pair of ports 601-602 as supply air (SA). One or both of fourth pair of ports 607-608 may receive return air (RA). Exhaust air (EA) may flow through housing 620 and may be discharged from air handing module 600 through one or both of third pair of ports 605-606.

Outside air (OA) may enter housing 620 through port 604 and may flow through an opening 613, while paired port 603 may be sealed by an access panel 673. Rotary damper 631 and optional rotary damper 634 may be actuated to block air path to exchanger 612 and redirect outside air (OA) through bypass openings 623. One or more fans 689 of fan box 681 may pull supply air (SA) through bypass openings 623 and out of port 601, while paired port 602 may be sealed by access panel 672. One or more fans 689 of fan box 688 and may push return air (RA) entering at port 608 through housing 620 and exchanger 612, while paired port 607 may be sealed by access panel 677. Air director 622 and exchange divider 640 may direct return air (RA) through filter 691*b*, exchanger 612, and exhaust air coil 692*b*. Exhaust air (EA) may exit port 605, while paired port 606 may be sealed by access panel 676.

One of the main challenges facing fixed plate air-to-air exchangers may be frost generation inside the exchanger during cold temperature conditions. Enthalpy exchangers may have a lower frost threshold temperature than sensible exchangers because enthalpy exchangers may transfer moisture between two airstreams. The rotary damper of the present disclosure may permit air bypass in the air handling module to prevent frost build-up in the exchanger. The rotary damper may modulate the amount of outside air volume by reducing or eliminating cold air flow through the exchanger. As a result, rotary damper may improve the performance of exchanger, resulting in higher temperatures of air supplied inside a room or building. In one exemplary embodiment, as the temperature of the exhaust air (EA) falls below an adjustable frost control set point (e.g., 28° F.), rotary damper 631 may be actuated to maintain the temperature at or above the frost control set point. By keeping the exhaust air (EA) at or above the frost control set point above (e.g., 28° F.), frost may be prevented from forming in exchanger 612.

Figure 6E:
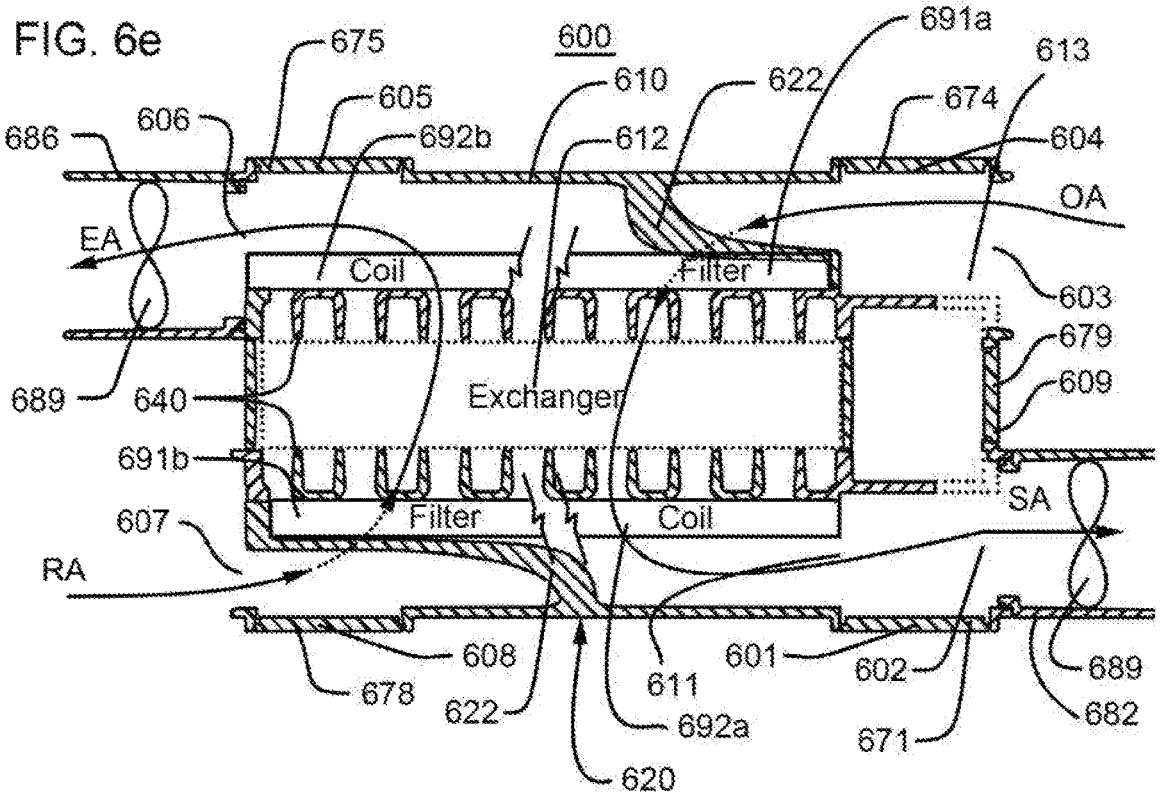

FIG. 6*e* illustrates a cross-sectional view of air handling module 600 in a fifth configuration according to the present disclosure. As shown in FIG. 6*e*, fan box 682 may be coupled to port 602 and fan box 686 may be coupled to port 606. Fan box 686 and fan box 682 may be configured to pull air flow into and out of housing 620. One or both of second pair of ports 603-604 may receive outside air (OA). Air director 622 and exchanger divider 640 may direct outside air (OA) through filter 691*a*, exchanger 612, and supply air coil 692*a*. Air may flow through housing 620 and may be discharged from air handing module 600 through one or both of first pair of ports 601-602 as supply air (SA). One or both of fourth pair of ports 607-608 may receive return air (RA). Exhaust air (EA) may flow through housing 620 and may be discharged from air handing module 600 through one or both of third pair of ports 605-606.

One or more fans 689 may be positioned inside fan box 682 and may pull supply air (SA) from exchanger 612, through opening 611, and out of port 602, while paired port 601 may be sealed by an access panel 671. Return air (RA) may enter housing 620 through port 607, while paired port 608 may be sealed by an access panel 678. Air director 622 and exchange divider 640 may direct return air (RA) through filter 691*b*, exchanger 612, and exhaust air coil 692*b*. One or more fans of fan box 686 may pull exhaust air (EA) from exchanger 612 and out of port 606, while paired port 605 may be sealed by access panel 675.

Figure 6F:
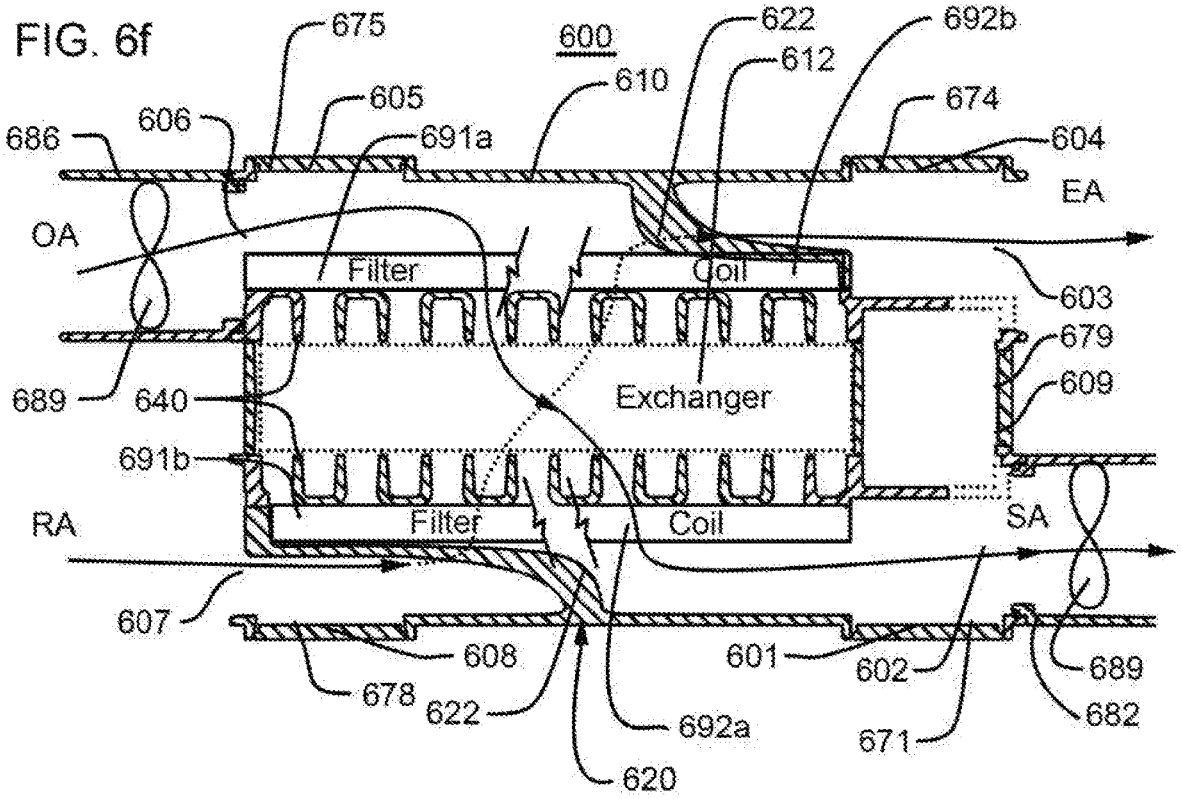

FIG. 6*f* illustrates a cross-sectional view of air handling module 600 in a sixth configuration according to the present disclosure. The embodiment of FIG. 6*f* provides a configuration of air handling module 600, wherein interchangeable exchanger 612 may facilitate a cross-flow air pattern within air handling module 600. Fan box 686 may be coupled to port 606 and may be configured to push air flow into and out of housing 620. Fan box 682 may be coupled to port 602 and may be configured to pull air flow into and out of housing 620 in series with fan box 686. Return air (RA) may enter housing 620 through one or both of fourth pair of ports 607-608 and may be conveyed through housing 620 and exit though one or both of second pair of ports 603-604 as exhaust air (EA). Return air (RA) may be conveyed through and exit housing 620 as exhaust air (EA) by a remote HVAC system fan or building pressure differential. One or both of third pair of ports 605-606 may receive outside air (OA). Air may flow through housing 620 and may be discharged from air handing module 600 through one or both of first pair of ports 601-602 as supply air (SA).

Outside air (OA) may enter housing 620 through port 606, while paired port 605 may be sealed by an access panel 675. Air director 622 and exchanger divider 640 may direct outside air (OA) through filter 691*a*, exchanger 612, and supply air coil 692*a*. One or more fans 689 of fan box 686 may push outside air (OA) through exchanger 612 and out of port 602 as supply air (SA), while paired port 601 may be sealed by access panel 671. One or more fans 689 of fan box 682 may pull supply air (SA) out of port 602 in series with fan box 686. Return air (RA) may enter housing 620 through port 607, while paired port 608 may be sealed by access panel 678. Air director 622 and exchange divider 640 may direct return air (RA) thru filter 691*b*, exchanger 612, and exhaust air coil 692*b*. Exhaust air (EA) may exit port 603, while paired port 604 may be sealed by access panel 674.

Figure 6G:
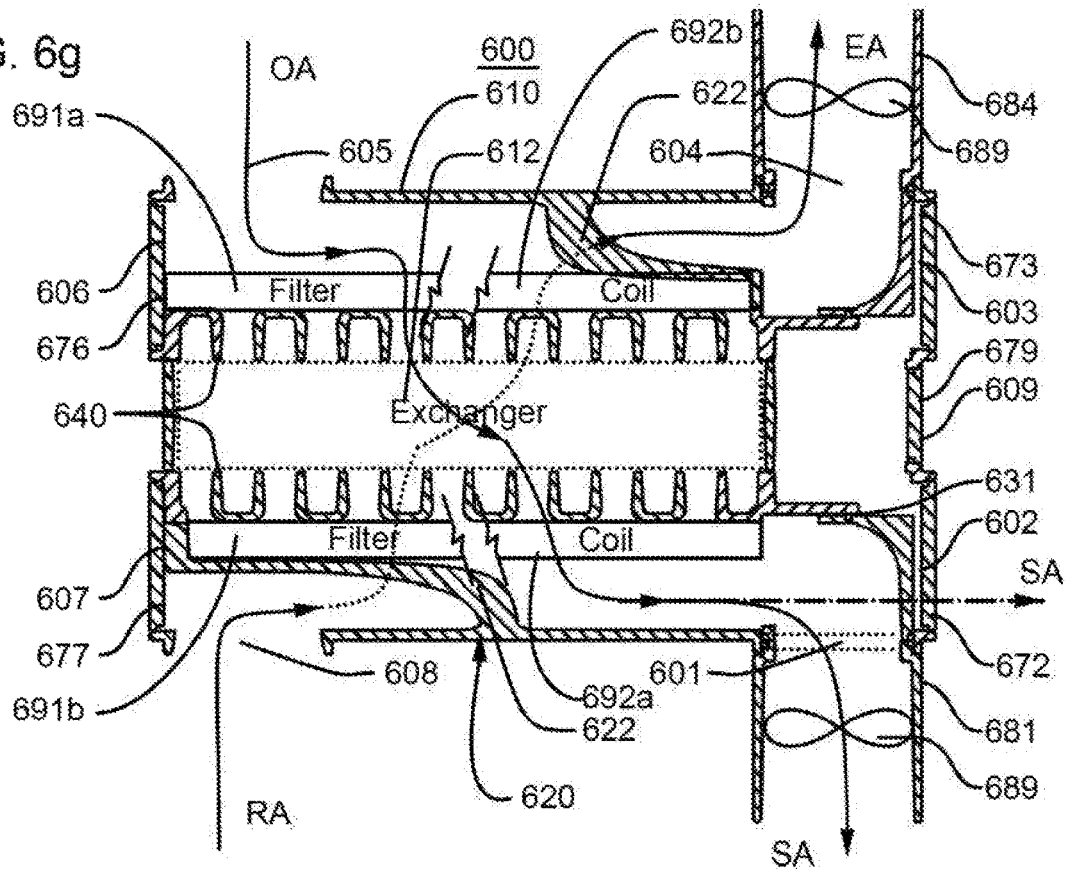

FIG. 6*g* illustrates a cross-sectional view of air handling module 600 in a seventh configuration according to the present disclosure. As shown in FIG. 6*g*, the interchangeable exchanger 612 may facilitate a cross-flow air pattern within air handling module 600. Fan box 681 may be coupled to port 601 and may be configured to pull air flow into and out of housing 620. A fan box 684 may be coupled to port 604 and may be configured to pull air flow into and out of housing 620. One or both of third pair of ports 605-606 may receive outside air (OA). Air may flow through housing 620 and may be discharged from air handing module 600 through one or both of first pair of ports 601-602 as supply air (SA). Return air (RA) may enter housing 620 through one or both of fourth pair of ports 607-608 and may be conveyed through housing 620 and exit though one or both of second pair of ports 603-604 as exhaust air (EA).

Outside air (OA) may enter housing 620 through port 605, while paired port 606 may be sealed by access panel 676. Air director 622 and exchanger divider 640 may direct outside air (OA) through filter 691*a*, exchanger 612, and supply air coil 692*a*. One or more fans 689 of fan box 681 may push outside air (OA) through exchanger 612 and out of port 601 as supply air (SA), while paired port 602 may be sealed by access panel 672. Return air (RA) may enter housing 620 through port 608, while paired port 607 may be sealed by access panel 677. Air director 622 and exchange divider 640 may direct return air (RA) thru filter 691*b*, exchanger 612, and exhaust air coil 692*b*. One or more fans 689 positioned inside fan box 684 may pull exhaust air (EA) out of port 604, while paired port 603 may be sealed by access panel 673.

Figure 6H:
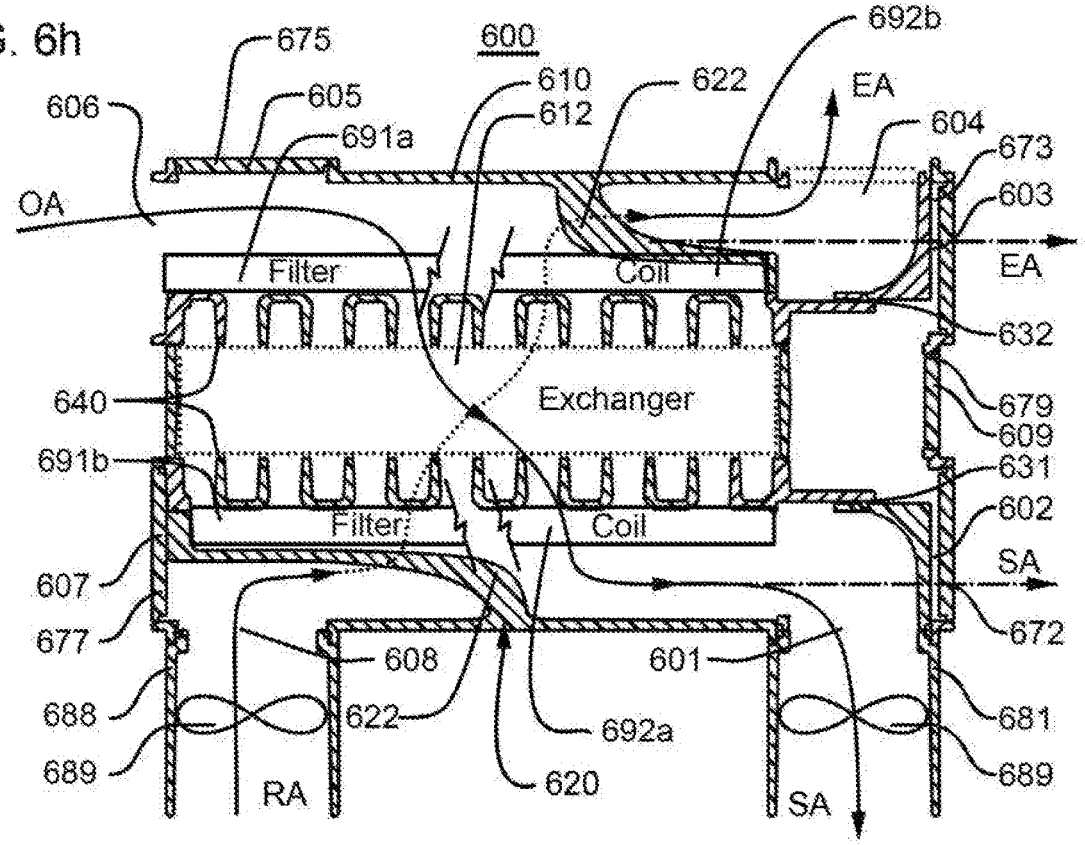

FIG. 6*h* illustrates a cross-sectional view of air handling module 600 in an eighth configuration according to the present disclosure. As shown in FIG. 6*h*, interchangeable exchanger 612 may facilitate a cross-flow air pattern within air handling module 600. Fan box 681 may be coupled to port 601 and may be configured to pull air flow into and out of housing 620. Fan box 688 may be coupled to port 608 and may be configured to push air flow into and out of housing 620. One or both of third pair of ports 605-606 may receive outside air (OA). Air may flow through housing 620 and may be discharged from air handing module 600 through one or both of first pair of ports 601-602 as supply air (SA). Return air (RA) may enter housing 620 through one or both of fourth pair of ports 607-608 and may be conveyed through housing 620 and exit though one or both of second pair of ports 603-604 as exhaust air (EA).

Outside air (OA) may enter housing 620 through port 606, while paired port 605 may be sealed by access panel 675. Air director 622 and exchanger divider 640 may direct outside air (OA) through filter 691*a*, exchanger 612, and supply air coil 692*a*. One or more fans 689 of fan box 681 may pull outside air (OA) through exchanger 612 and out of port 601 as supply air (SA), while paired port 602 may be sealed by access panel 672. Return air (RA) may enter housing 620 through port 608, while paired port 607 may be sealed by access panel 677. Air director 622 and exchange divider 640 may direct return air (RA) thru filter 691*b*, exchanger 612, and exhaust air coil 692*b*. One or more fans 689 of fan box 688 push return air (RA) into port 608, while paired port 607 may be sealed by access panel 677. Return air (RA) may be pushed through exchanger 612 by fan box 688 and may exit out of port 604 as exhaust air (EA), while paired port 603 may be sealed by access panel 673.

Figure 7A:
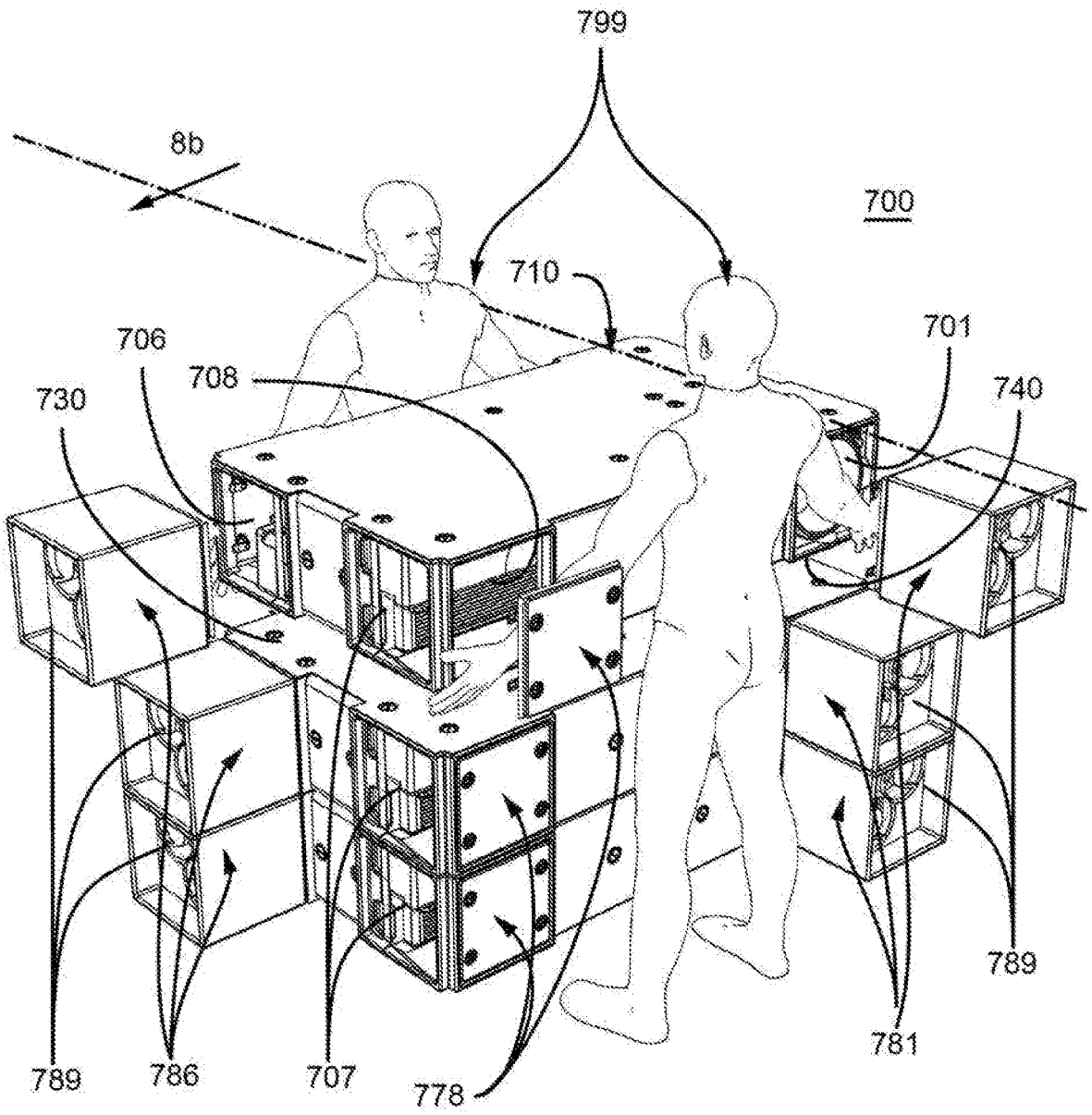
FIGS. 7*a* and 7*b* illustrate perspective views of an exemplary air handling system, according to an exemplary disclosed embodiment.

FIG. 7*a* illustrates a perspective view of a plurality of air handling modules coupled together to form an air handling system according to the present disclosure. As shown in FIG. 7*a*, an air handling system 700 may comprise a plurality of air handling modules 710 stacked together. Air handling modules 710 may operate in parallel with each other to achieve a combined conditioning effect greater than, or equal to, a conditioning effect of a single air handling unit with a desired level of redundancy. Air handling module 710 may comprise lightweight plastic construction which may facilitate hand transport by one or more installation personnel 799 without employing cranes and other heavy machinery. Air handling module 710 may preferably weigh under 100 pounds.

A bottom 740 of air handling module 710 may be stacked on a top 730 of adjoining air handling module 710. As discussed above, ports of air handling module 710 may serve as interchangeable attachment points for a variety of structures, such as, for example, fan boxes, metal ducts, weather hoods, roof curbs, access panels, and/or other fluidly connected components of an HVAC system. Components may readily attach and detach from the ports to accommodate multiple combinations for air handling module 710 customizable per installation site requirements.

One or more ports 706 of air handling module 710 may serve as interchangeable attachment points for fan boxes 786 containing one or more fans 789, and one or more ports 701 of air handling module 710 may serve as interchangeable attachment points for fan boxes 781 containing one or more fans 789. Fan boxes 781 and fan boxes 786 may direct air flow into and out of air handling module 710 through attached ports 701 and ports 706, respectively. Fan boxes 781 and 786 may readily attach and detach from ports 701 and ports 706 using standard screw drivers or wrenches. Fan boxes 781 and 786 may also include integrated power and communication bus wire harnesses to connect into any of the ports to provide a "plug-and-play" arrangement.

Each paired port 707-708 may include an access panel 778 that may readily attach and detach using standard screw drivers or wrenches. This port duality may facilitate numerous air flow directions and may be customized at the site location. In some embodiments, a plurality of ports may be aligned to facilitate the attachment of a single, four-sided rectangular duct. As shown in FIG. 7*a*, extension flanges outlining ports (e.g., ports 707) may be flush along top 730 and bottom sides 740.

Figure 7B:
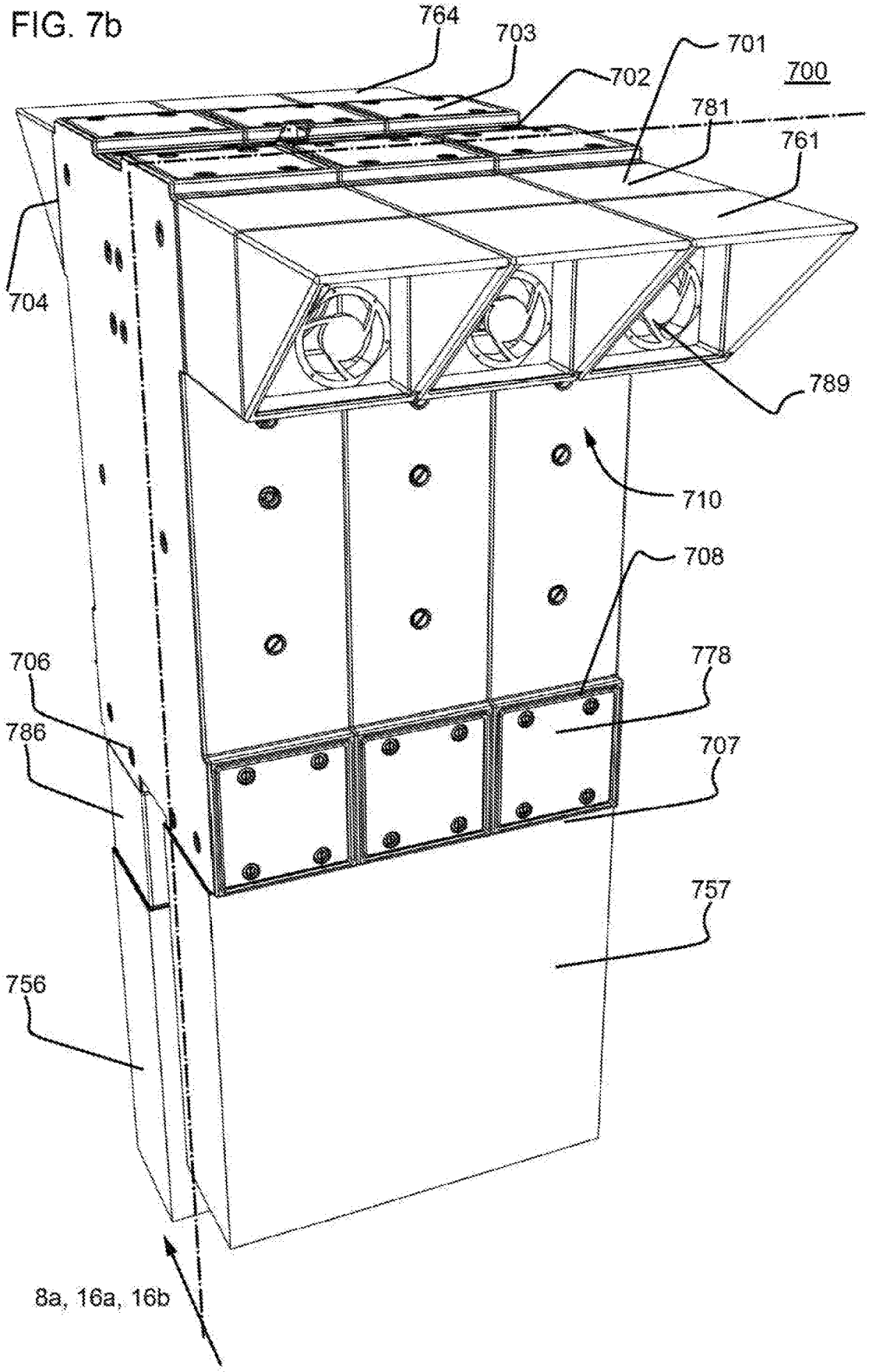

FIG. 7*b* illustrates a perspective view of a plurality of air handling modules coupled together to form an air handling system according to the present disclosure. As shown in FIG. 7*a*, air handling system 700 may comprise a plurality of air handling modules 710, vertically positioned and adjacently stacked. Air handling modules 710 may operate in parallel with each other to achieve a combined conditioning effect greater than, or equal to, a conditioning effect of a single air handling unit with a desired level of redundancy. Air handling modules 710 of air handling system 700 may be in a vertical orientation to facilitate fluid flow in evaporative cooling and/or steam regeneration liquid desiccant conditioning applications and carbon dioxide scrubbing systems.

Fans 789 in fan housing 786 may pull recirculating return air (RA) to be conditioned through a single common duct 757 coupled to ports 707 of air handling modules 710. Return air (RA) may pass through the exchangers in air handling modules 710 and may exit air handling modules 710 as supply air (SA) through a single common duct 756 coupled to ports 706 of air handling modules 710. Fans 789 in fan housing 781 may pull outside air (OA) into air handling modules 710 through one or more weather hoods 764 coupled to ports 704 of air handling modules 710. Outside air (OA) may pass through the exchangers in air handling modules 710 and may exit air handling modules 710 as exhaust air (EA) through one or more weather hoods 761 coupled to ports 701 of air handling modules 710.

Figure 8A:
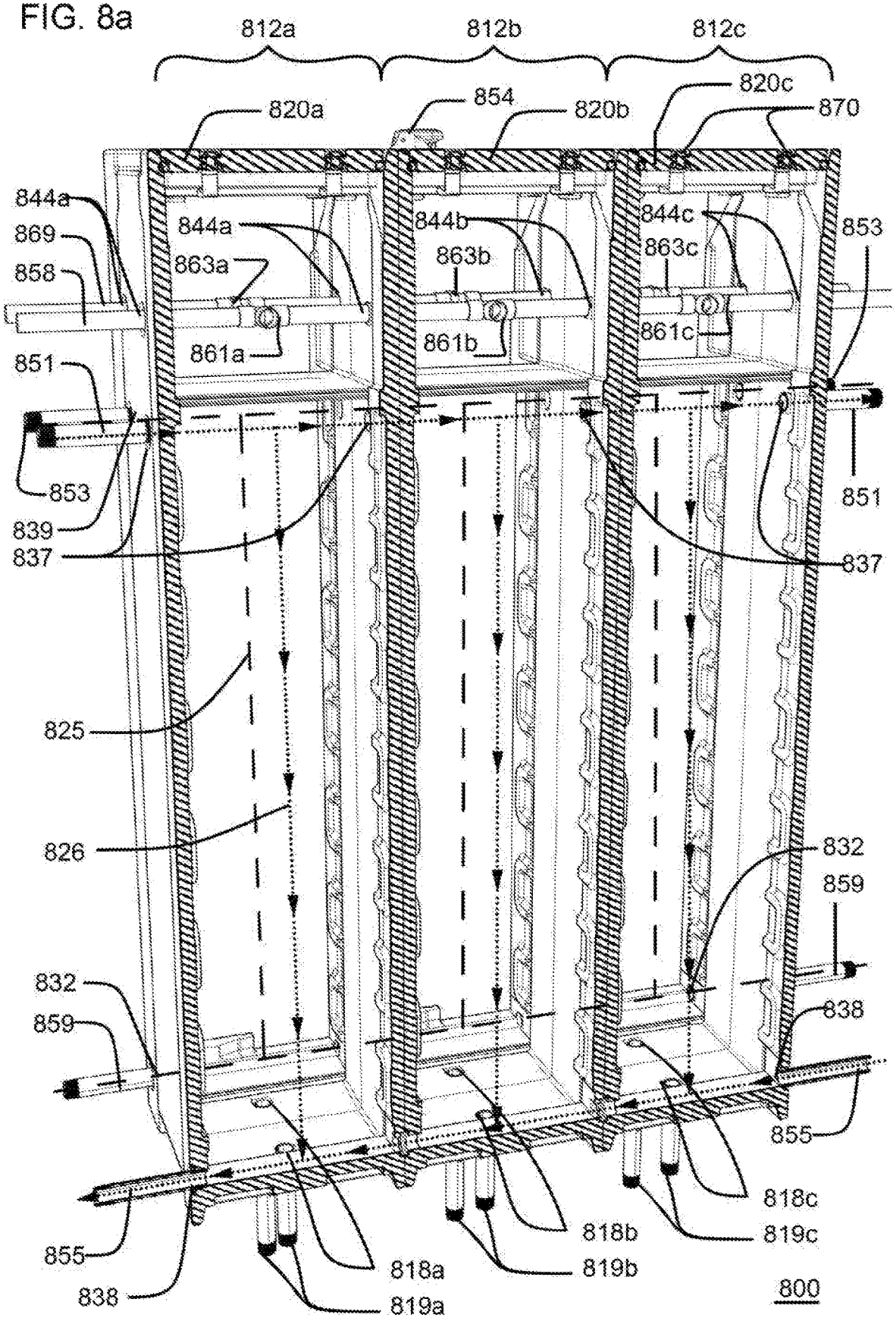
FIGS. 8*a* and 8*b* illustrate cross-sectional perspective views of an exemplary air handling system, according to an exemplary disclosed embodiment.

FIG. 8*a* illustrates a cross-sectional perspective view as indicated by the dashed line shown in FIG. 7*b* of an air handling system 800 according to the present disclosure. As shown in FIG. 8*a*, air handling system 800 may comprise a plurality of air handling modules 812*a*-812*c* stacked in a vertical configuration. Each of air handling modules 812*a*-812*c* may contain a plurality of internal and external ports facilitating a multi-functional hydronic distribution and collection system.

Port(s) 839 may be connected to an evaporative water pipe 853 with sealed threads and may facilitate entry, distribution, and discharge of supply water through a plurality of housings 820*a*-820*c* via evaporative water pipe 853. An exchanger 213 may be contained within each housing 820*a*-820*c* and may include a plurality of plates arranged in a successively stacked configuration with portions thereof having a spaced apart arrangement. A first and second series of discrete alternating passages may be defined at the spaced apart portions.

Evaporative water 825 may be delivered into exchanger 213. The evaporative water 825 may gravitationally flow down the first series of discrete alternating passages until reaching a first drain conduit 832 for collecting the flowing evaporative water 825 from the first series of passages. The first drain conduit 832 may be entirely outside of the exchanger 213 and adjacent to first and second ends of the plurality of plates. The first drain conduit port 832 may be connected to an evaporative water drain pipe 859 with sealed threads and may facilitate entry, distribution, and discharge of water through the plurality of housings 820*a*-820*c*.

Port(s) 837 may be connected to a liquid desiccant pipe 851 with sealed threads and may facilitate entry, distribution, and exit of liquid desiccant 826 through a plurality of housings 820*a*-820*c* via liquid desiccant pipe 851. Liquid desiccant 826 may be delivered into exchanger 213. The liquid desiccant 826 may gravitationally flow down the second series of discrete alternating passages until reaching a second drain conduit 838 for collecting the flowing liquid desiccant 826 from the second series of passages. The second drain conduit 838 may be entirely outside of the exchanger 213 and adjacent to first and second ends of plurality of plates. Second drain conduit 838 may be connected to a liquid desiccant drain pipe 855 with sealed threads and may facilitate entry, distribution, and exit of liquid desiccant through the plurality of housings 820*a*-820*c*.

In some embodiments, side liquid desiccant drain port(s) 818*a*-818*c* and 819*a*-819*c* may be connected to drain pipe(s) 819*a*-819*c* with sealed threads and may provide an additional or alternate exit for liquid desiccant through drain pipe(s) 819*a*-819*c*. In some embodiments, aqueous solutions of alkylamines, other reversibly binding aqueous solutions, lithium chloride, or combinations thereof may flow through the exchangers 213.

In some embodiments, the ports of air handling modules 812*a*-812*c* facilitating the multi-functional hydronic distribution and collection system may be threaded. It should be appreciated that the ports may serve as interchangeable attachment points for a plurality of components including a condensate drain pipe, an evaporative water supply pipe, an evaporative water drain pipe, a liquid desiccant supply pipe, a liquid desiccant drain pipe, a refrigerant line conduit, a chilled water conduit, a steam pipe, reversibly binding aqueous scrubbing pipe, and/or other fluidly connected hydronic components of an HVAC system. The components may readily attach and detach from the ports and may allow customized configuration at the installation site. Gasketed seals may be incorporated between the components and the ports. In some embodiments, the ports may be threaded in accordance with British Standard Parallel Pipe (BSPP) standards with integrated sealing washers to ensure international compatibility with National Taper Pipe (NPT), American Standard Straight Pipe for Mechanical Joints (NPSM), American Standard Straight Pipe (NPS), and British Standard Tapered Pipe (BSTP) standards. In some embodiments, bottom conduit port(s) 844*a*-844*c* may be attached to supply coil pipe 858 and return coil pipe 869 to distribute liquids between a plurality of housings 820*a*-820*c*. Supply coil port 861*a*-861*c* and return coil port 863*a*-863*c* may form access points between conduit port(s) 844*a*-844*c*.

Figure 8B:
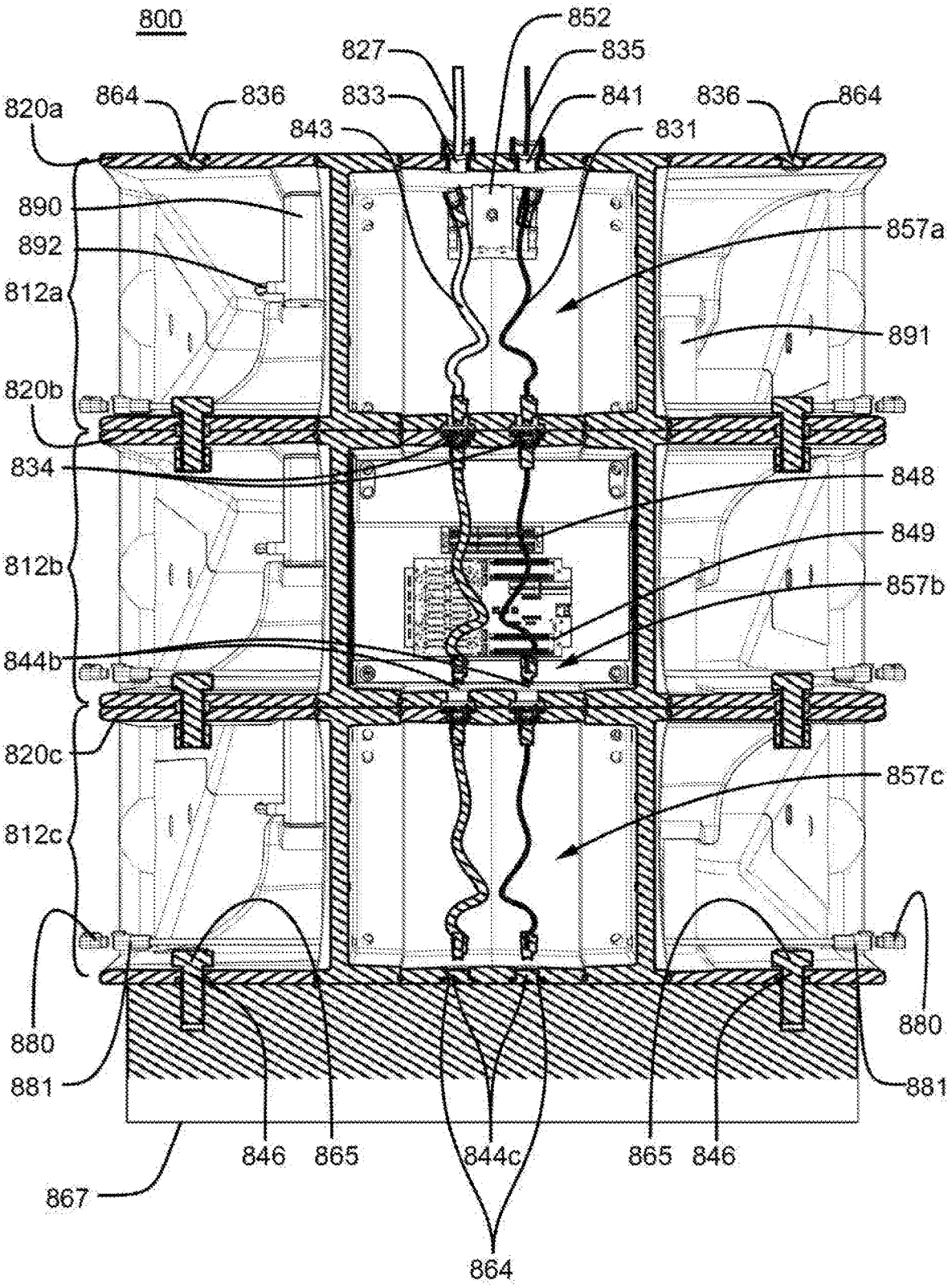

FIG. 8*b* illustrates a cross-sectional perspective view of an air handling system along the dashed line "8B" of FIG.

7*a*. As shown in FIG. 8*b*, air handling system 800 may comprise a plurality of adjacently stacked air handling modules 812*a*-812*c*. Air handling modules 812*a*-812*c* may contain a plurality of internal and external ports, which may facilitate: (a) multi-functional structural connectivity; (b) "plug-and-play" electrical power distribution; and (c) "plug-and-play" communication bus. The communications bus and power distribution of the air handling system may provide a single point of control connection to synchronously operate the plurality of air handling modules.

Air handling modules 812*a*-812*c* may be structurally connected via anchor bolts 865 mating with anchor port(s) 846. Anchor port(s) 846 may also provide a multi-functional structural connection to the ground or support base 867. In some embodiments, anchor port(s) 846 that may not be utilized may be sealed and secured with insulated threaded plug(s) 864. In some embodiments, anchor port(s) 846 may be threaded. Anchor port(s) 846 may serve as interchangeable attachment points for a plurality of attachment structures, such as, for example, structural anchor bolts, module interconnectivity clamps, module seals, and insulated plug seals. These attachment structures may readily attach and detach from anchor port(s) 846, which may allow for customized configuration at the installation site.

Power wire 827 may be connected to a power conduit fitting 833 at threaded port(s) 834, which may facilitate a "plug-and-play" electrical power distribution. A power harnesses 843 may transfer power between top conduit ports 834 and bottom conduit ports 844. Electrical and economizer bypass enclosures 857*a*-857*c* may contain a plurality of devices and accommodate multiple combinations of orientations and various numbers of modules per installation site requirements.

Electrical enclosure 857*a* may provide a single point electrical disconnect 852 for air handling system 800. Electrical enclosure 857*b* may provide a single point electrical distribution 848 for powering a central controller 849. Electrical enclosure 857*c* may be empty. In some embodiments, anchor port(s) 844*c* that may not be utilized in the electrical power distribution may be sealed and secured with insulated threaded plug(s) 864. Power distribution includes electrical power conduit, electrical disconnect handle, module grounding point, and electrical wire harness connectors.

Signal wire 835 may be connected to a signal conduit fitting 841 at threaded port(s) 834, which may facilitate a "plug-and-play" communications bus. A signal harness 831 may transfer signals between top conduit ports 834 and bottom conduit ports 844. Electrical enclosure 857*b* may contain a central controller 849 to which all other air handling modules 812 of air handling module system 800 may be slaves. In some embodiments, a plurality of components, including, for example, fan boxes, may be linked to the "plug-and-play" communications bus and electrical power distribution via an AHU power and signal harness 881 and a fan power and signal harness 880. Interchangeable attachment points may be compatible for a plurality of components, including, for example, a communication bus wire conduit, sensor probes, and communication bus harness connectors.

Gasketed seals may be incorporated between the anchor and threaded ports and their mated components. In some embodiments, the anchor and threaded ports may be threaded in accordance with British Standard Parallel Pipe (BSPP) standards with integrated sealing washers to ensure international compatibility with National Taper Pipe (NPT), American Standard Straight Pipe for Mechanical Joints (NPSM), American Standard Straight Pipe (NPS), and British Standard Tapered Pipe (BSTP) standards.

Figure 9A:
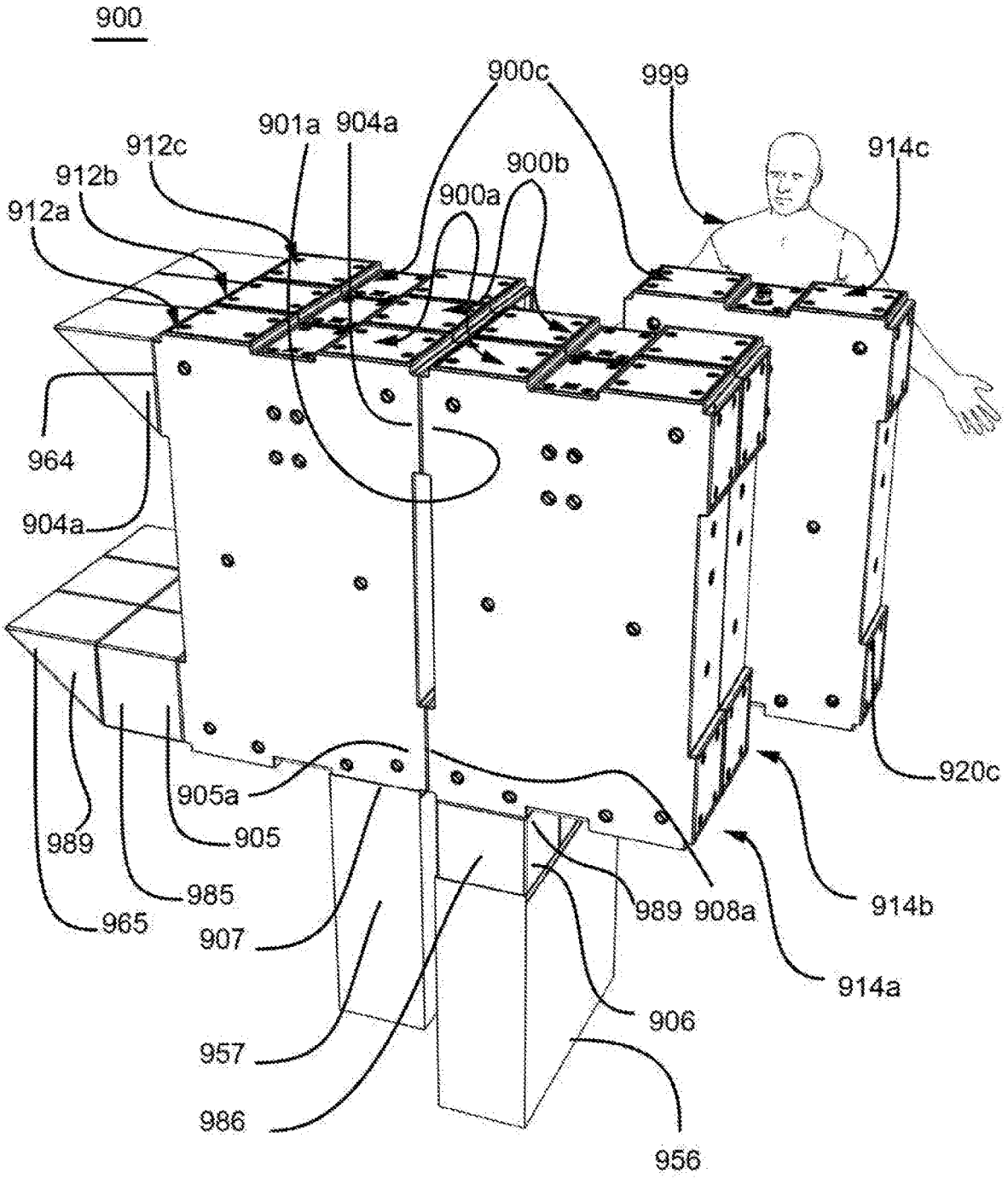
FIG. 9*a* illustrates a perspective of an exemplary air handling system, according to an exemplary disclosed embodiment.

FIG. 9*a* illustrates a perspective view of air handling system 900 according to the present disclosure. As shown in FIG. 9*a*, energy recovery module 912*a* may be fluidly coupled in series to a wrap-around dehumidification module 914*a* to form dual plate air handling module 900*a*. Ports 904*a* and 905*a* of energy recovery module 912*a* may be respectively joined to ports 901*a* and 908*a* of 904*b* of dehumidification module 914*a*. A dual plate air handling module 900*b* may comprise energy recovery module 912*b* fluidly coupled in series to wrap-around dehumidification module 914*b*, and dual plate air handling module 900*c* may comprise energy recovery module 912*c* fluidly coupled in series to a wrap-around dehumidification module 914*c*. The plurality of dual plate air handling modules 900*a*-900*c* may be stacked in a vertical configuration to form a dual plate air handling system 900. Air handling modules 900*a*-900*c* may be configured to operate in parallel with each other to achieve a combined conditioning effect greater than, or equal to, a conditioning effect of a single air handling unit with a desired level of redundancy.

Fan(s) 989 in fan housing 986 may pull outside air (OA) through weather hood 964, and outside air (OA) may enter energy recovery module 912*a* at port 904*a*. Outside air (OA) may exit as supply air (SA) through port 906. A single common supply air (SA) duct 956 may be connected to a plurality of ports 906. A single common rectangular return duct 957 may be connected to a plurality of ports 907, and fan(s) 989 in fan housing 985 may pull return air (RA) through the single common return duct 957. Return air (RA) may exit as exhaust air (EA) through weather hood 965 at port 905.

Air handling module 914 may comprise lightweight plastic construction which may facilitate hand transport by one or more installation personnel 999 without employing cranes and other heavy machinery. Air handling module 914 may preferably weigh under 100 pounds.

Figure 9B:
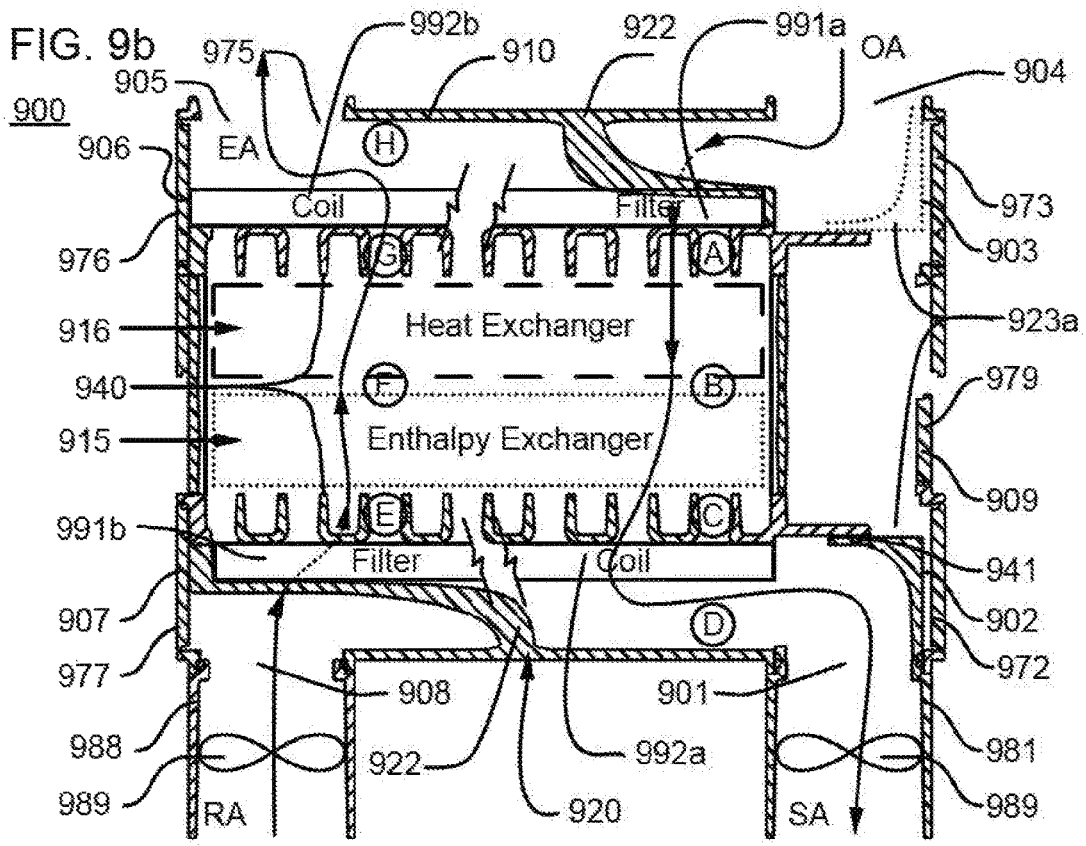
FIGS. 9*b*-9*g* illustrate cross-sectional views of an exemplary air handling system in exemplary configurations, according to an exemplary disclosed embodiment.

FIGS. 9*b*-9*g* illustrate the modularity of the air handling system of the present disclosure by illustrating exemplary configurations of the air handling system. FIG. 9*b* illustrates a cross-sectional view of dual plate air handling system 900 according to the present disclosure. As shown in FIG. 9*b*, air handling system 900 may comprise a sensible heat exchanger 916 in series with an enthalpy exchanger 915 to facilitate lower temperature, frost-free operation of air handling module 900. Air handling system 900 may include fan box 981 coupled to port 901 and fan box 988 coupled to port 908. Fan box 981 and fan box 988 may be configured to pull and push air flow into and out of a housing 920 of air handling system 900.

Air handling system 900 may include a series of air-to-air exchangers 916 and 915 contained within housing 920. Air handling system 900 may also include a first pair of ports 901-902 fluidly connected to second pair of ports 903-904. One or both of second pair of ports 903-904 may receive outside air (OA). Air may flow through housing 920 and may be discharged from air handling system 900 through one or both of first pair of ports 901-902 as supply air (SA). Air handling system 900 may further include third pair of ports 905-906 fluidly connected to fourth pair of ports 907-908. One or both of fourth pair of ports 607-608 may receive return air (RA). Exhaust air (EA) may be discharged from air handling system 900 through one or both of third pair of ports 905-906.

Outside air (OA) may enter housing 920, which may comprise sides 910, through port 904, while paired port 903 may be sealed by access panel 973. Air director 922 and exchanger divider 940 may direct outside air (OA) through filter 991*a*, heat exchanger 916, enthalpy exchanger 915, and supply air coil 992*a*. One or more fans 989 may be positioned inside fan box 981 and may pull supply air (SA) through exchangers 916, 915 and out of port 901, while paired port 902 may be sealed by access panel 672. Rotary damper 941 may seal bypass openings 923*a*, and access panel 679 may seal port 909. One or more fans 989 may be positioned inside fan box 988 and may push return air (RA) entering at port 908 through exchangers 916, 915 and out port 606, while paired port 907 may be sealed by access panel 977. Air director 922 and exchanger divider 940 may direct return air (RA) through filter 991*b*, enthalpy exchanger 915, heat exchanger 916, and exhaust air coil 992*b*. Supply air coil 992*a* and exhaust air coil 992*b* may be any suitable thermal transfer device for promoting a variety of air processing and conditioning objectives, including, but not limited to, a condenser coil, an evaporator coil, a chilled water coil, a hot water coil, and/or a steam coil. Exhaust air (EA) may exit port 905, while paired port 906 may be sealed by access panel 976.

Figure 9C:
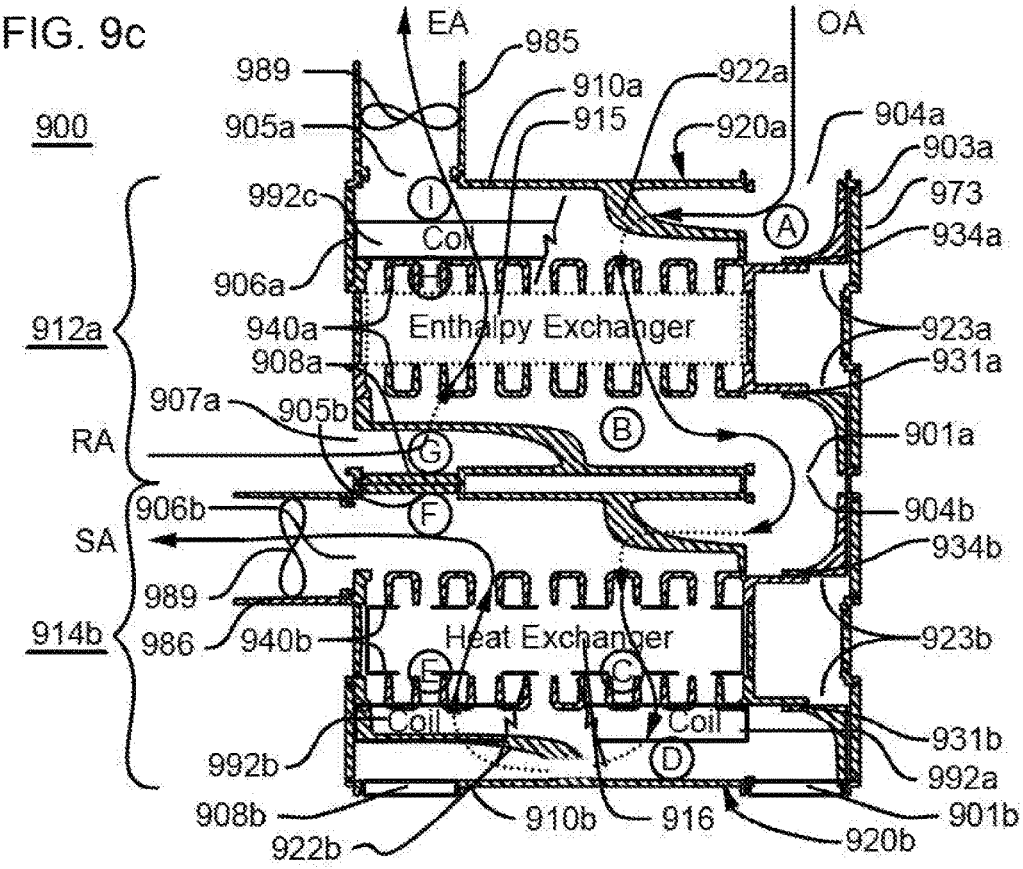

FIG. 9*c* illustrates a cross-sectional view of another dual plate air handling system 900 according to the present disclosure. As shown in FIG. 9*c*, air handling system 900 may comprise of energy recovery module 912*a* serially coupled to wrap-around dehumidification module 914*b*. Ports 901*a* and 908*a* of energy recovery module 912*a* may be fluidly connected to ports 904*b* and 905*b* of dehumidification module 914*b*, respectively. The dual plate air handling system of FIG. 9*c* may provide energy savings and load reduction of enthalpy recovery for dedicated outdoor air. Furthermore, the sensible/latent ratio control of wrap-around dehumidification may deliver low dewpoint to an application at neutral temperature; which may eliminate space reheat.

The dual plate air handling system of FIG. 9*c* may include exchanger 915 housed in housing 920*a* of energy recovery module 912*a* fluidly connected in series to exchanger 916 housed in housing 920*b* of dehumidification module 914*b*. Paired ports 903*a*-904*a* of energy recovery module 912*a* may be fluidly connected to paired ports 905*b*-906*b* of dehumidification module 914*b*. One or both of paired ports 903*a*-904*a* may receive outside air (OA). Air may flow through energy recovery module 912*a* and dehumidification module 914*b* (and exchangers 915, 916) and may be discharged from one or both of paired ports 905*b*-906*b* as supply air (SA). Paired ports 907*a*-908*a* of energy recovery module 912*a* may be fluidly connected to paired ports 905*a*-906*a* of energy recovery module 912*a*. One or both of paired ports 907*a*-908*a* may receive return air (RA). Exhaust air (EA) may be discharged from one or both of paired ports 905*a*-906*a*.

Outside air (OA) may enter housing 920*a* of energy recovery module 912*a*, which may comprise sides 910*a*, through port 904*a*, while paired port 903*a* may be sealed by an access panel 973. Air director 922*a* and exchanger divider 940*a* may direct outside air (OA) through energy recovery exchanger 915. Outside air (OA) may exit housing 920*a* through port 901*a* and may enter housing 920*b* of dehumidification module 914*b*, which may comprise sides 910*b*, through port 904*b*. An air director 922*b*, an exchanger divider 940*b*, and sealed ports 908*b*, 901*b* may direct a first pass of outside air (OA) through sensible exchanger 916 and coil 922*a*. One or more fans 989 of fan box 986 may pull outside air (OA) through coil 922*b*, which may be arranged in series with coil 922*a*, and back through sensible exchanger 916 for a second pass. The air may then exit as supply air (SA) through port 906*b*. A fan box 985 may be fluidly coupled to port 905*a*. One or more fans 989 positioned inside fan box 985 may pull return air (RA) through port 907*a*, while paired port 908*a* may be sealed. Air director 922*a* and exchange divider 940*a* may direct return air (RA) through exchanger 915 and exhaust air coil 992*c*.

In some embodiments, exhaust air coil 992*c* may be a condenser type coil configured to reject heat from evaporator coils 992*a* and 992*b*. A rotary damper 934*a* may seal bypass openings 923*a* and a rotary damper 934*b* may seal bypass openings 923*b*. The air pulled by fan box 985 may exit port 905*a* as exhaust air (EA), while paired port 906*a* may be sealed.

Figure 9D:
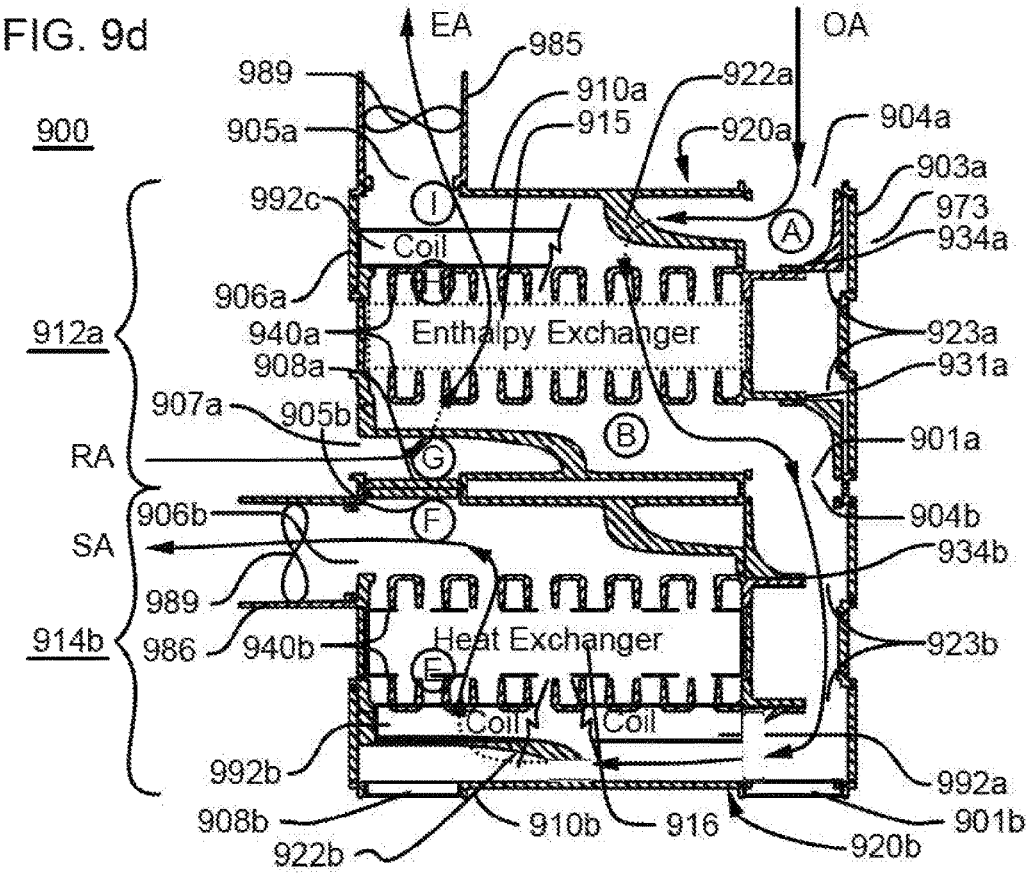

FIG. 9*d* illustrates a cross-sectional view of another configuration of the dual plate air handling system of FIG. 9*c* according to the present disclosure. As shown in FIG. 9*d*, dual-plate air handling module 900 may be arranged to provide energy savings and load reduction through enthalpy exchanger 915. It may also provide bypass 923*b* around wrap-around heat exchanger 916 to change the sensible/latent ratio depending upon changing site requirements. Rotary damper 934*b* may be opened to permit airflow through bypass opening(s) 923*b*, while blocking airflow through the path directed by air director 922*b* and exchange divider 940*b* for the first pass of the outside air (OA) through exchanger 916 as shown in FIG. 9*c*. As such, rotary damper 934*b* may facilitate outside air (OA) bypassing sensible exchanger 916. Sealed ports 908*b*-901*b* may direct outside air (OA) to pass through coils 992*b* and then sensible exchanger 916. One or more fans 989 of fan box 986 may pull this outside air (OA) through sensible exchanger 916 for a single pass. The air may then exit as supply air (SA) through port 906*b*. In some embodiments, coils 992*a* may be closed or turned off to prevent freezing due to the lack of airflow.

Figure 9E:
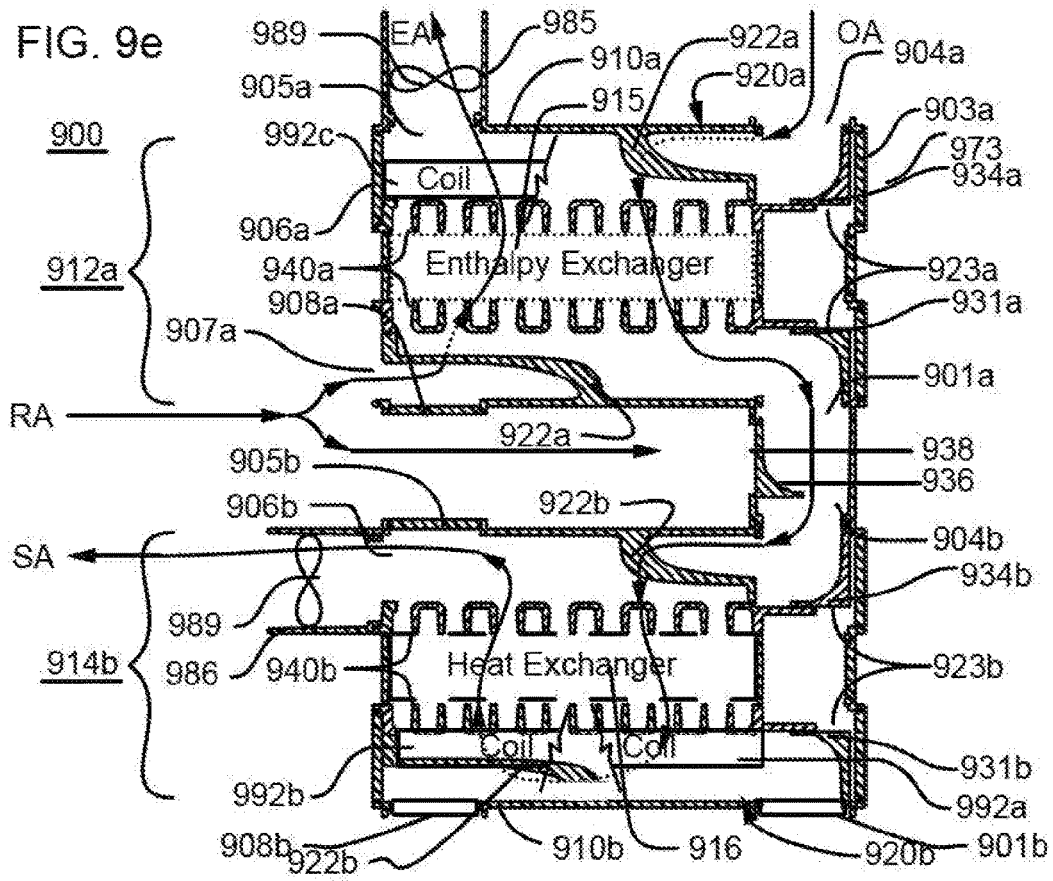

FIG. 9*e* illustrates a cross-sectional view of another dual plate air handling system according to the present disclosure. As shown in FIG. 9*e*, dual plate air handling system 900 may comprise energy recovery module 912*a* serially coupled to wrap-around dehumidification module 914*b* and arranged to facilitate recirculated return air (RA) optionally entering through a port 938. This arrangement may provide the energy savings and load reduction of enthalpy recovery, sensible/latent ratio control, low dewpoint air delivered at room neutral temperature, and recirculating air conditioning during unoccupied periods. The dual plate air handling system of FIG. 9*e* may include port 938 and return air (RA) port rotary damper 936. Rotary damper 936 may be actuated to open and seal port 938. When rotary damper 936 is opened, port 938 may be fluidly connected to paired ports 905*b*-906*b* of dehumidification module 914*b*.

Figure 9F:
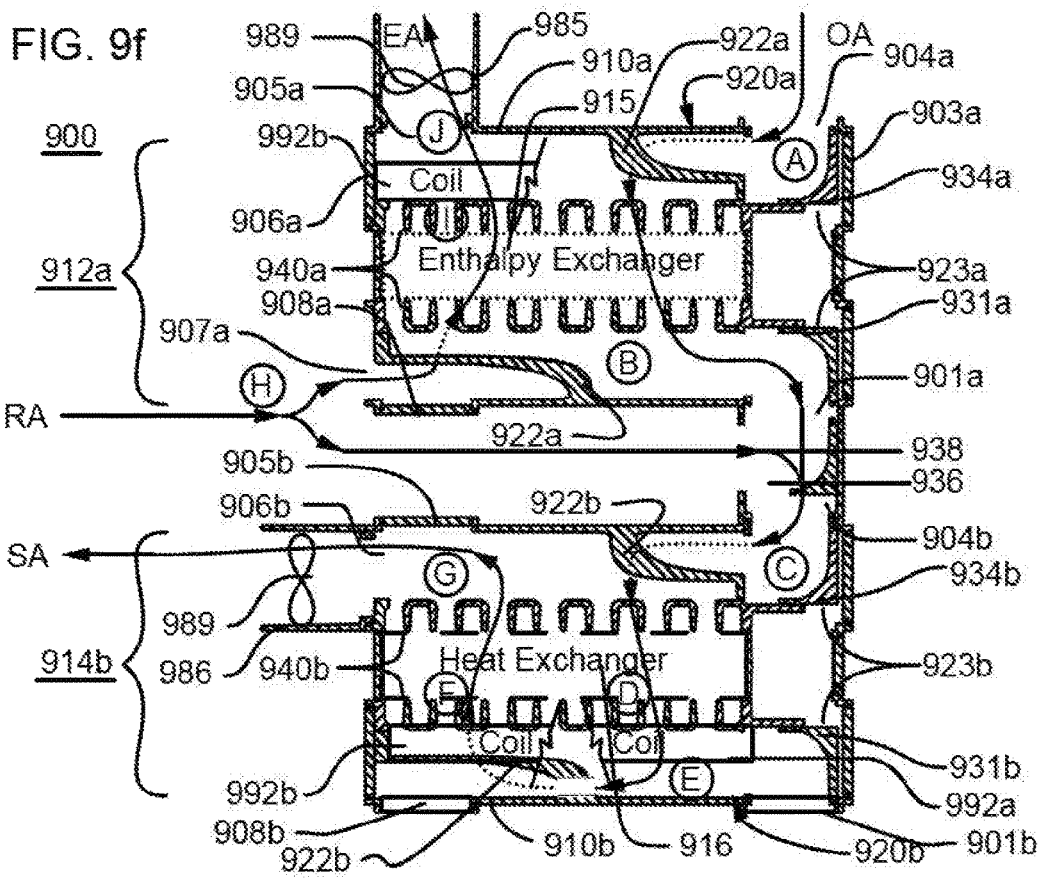

FIG. 9*f* illustrates a cross-sectional view of another configuration of the dual plate air handling system of FIG. 9*e* according to the present disclosure. As shown in FIG. 9*f*, rotary damper 936 may be actuated to facilitate a variable percentage of recirculated return air (RA) entering through port 938 and mixing with outside air (OA). This arrangement may provide the energy savings and load reduction of enthalpy recovery for dedicated outdoor air. Furthermore, the sensible/latent ratio control of wrap-around dehumidification may deliver low dewpoint to an application at neutral temperature; which may eliminate space reheat. Incorporating a variable percentage of recirculating air conditioning may reduce energy during unoccupied periods and/or increase space comfort levels. Rotary damper 936 may be at least partially opened to permit return air (RA) to enter through port 938. When rotary damper 936 is at least partially opened, port 938 may be fluidly connected to ports 901*a* and 904*b* and return air (RA) entering through port 938 may mix with outside air (OA). The mixture of outside air (OA) and return air (RA) then may be supplied to dehumidification arrangement 914*b* through port 904*b*. The amount of return air (RA) mixing with outside air (OA) may be modulated by rotary damper 936.

Air director 922*b*, exchanger divider 940*b*, and sealed ports 908*b*-901*b* may direct the mixture of outside air (OA) and return air (RA) through sensible exchanger 916 and coil 992*a* for a first pass. One or more fans 989 of fan box 986 may pull this mixed air through coil 922*b* and back through sensible exchanger 916 for a second pass. The air may then exit as supply air (SA) through port 906*b*. Rotary dampers 934*a* and 931*a* may seal bypass openings 923*a*, and rotary dampers 934*b* and 931*b* may seal bypass openings 923*b*.

Figure 9G:
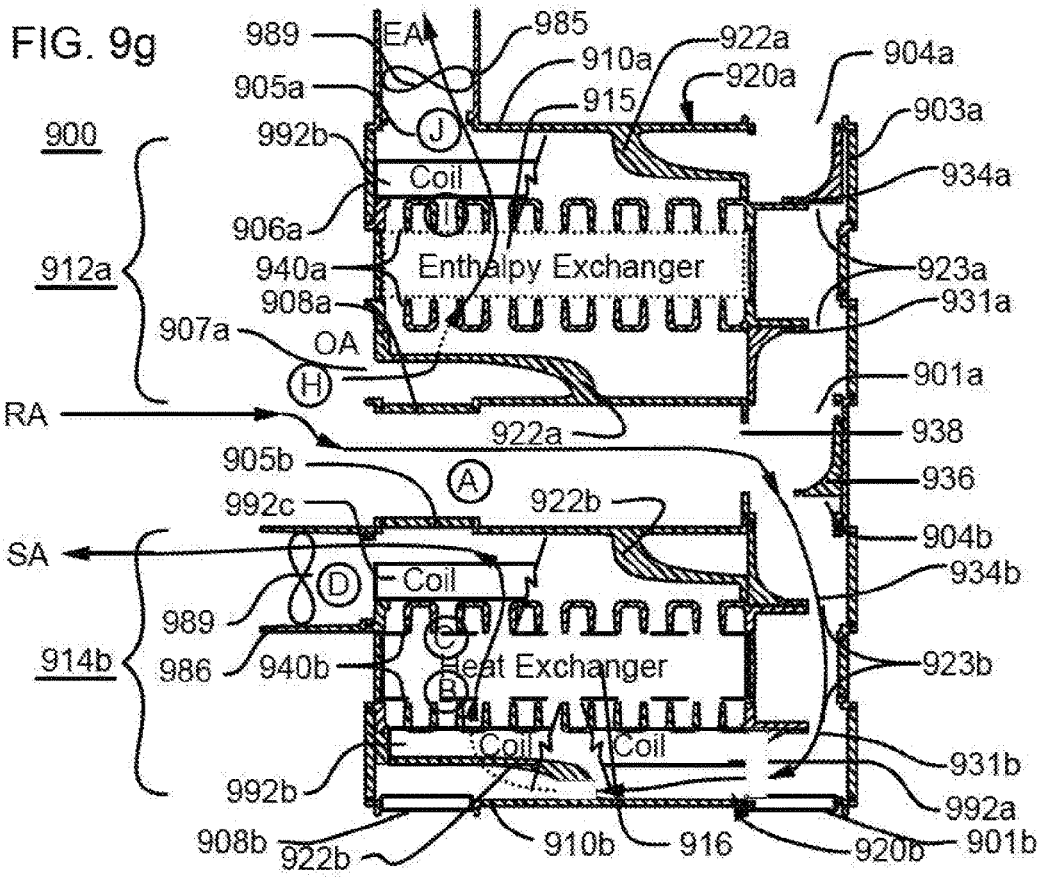

FIG. 9*g* illustrates a cross-sectional view of another configuration of the dual plate air handling system of FIG. 9*e* according to the present disclosure. As shown in FIG. 9*e*, rotary damper 936 may be actuated to facilitate recirculated return air (RA) entering through port 938. This arrangement may provide sensible/latent ratio control of wrap-around dehumidification and may deliver low dewpoint to an application at neutral temperature, which may eliminate space reheat. Incorporating a variable percentage of recirculating air conditioning may reduce energy during unoccupied periods and/or increase space comfort levels. For example, many winter vacation homes sit empty during the humid summer months and controlling dew point may be more important than controlling temperature for reduction of mold and elimination of odors. As shown in FIG. 9*g*, rotary damper 936 may be opened to permit return air (RA) to enter through port 938 and into housing 920*b*. Rotary damper 934*b* may be opened to permit airflow through bypass opening(s) 923*b* and facilitate return air (RA) bypassing sensible exchanger 916. Air director 922*b*, exchanger divider 940*b*, and sealed ports 908*b*-901*b* may direct return air (RA) through coils 992*b* and sensible exchanger 916. One or more fans 989 of fan box 986 may pull this return air (RA) through sensible exchanger 916. The air may then exit as supply air (SA) through port 906*b*. One or more fans 989 of fan box 985 may pull outside air (OA) through port 907 and through exchanger 915 and exhaust air coil 992*b*. Air director 922*a* and exchange divider 940*a* may direct the outside air (OA) through exchanger 915 and exhaust air coil 992*b*. The air pulled by fan box 985 may then exit port 905*a* as exhaust air (EA), while paired port 906*a* may be sealed. Rotary damper 934*a* may be closed to seal bypass opening(s) 923*a*.

Figure 10A:
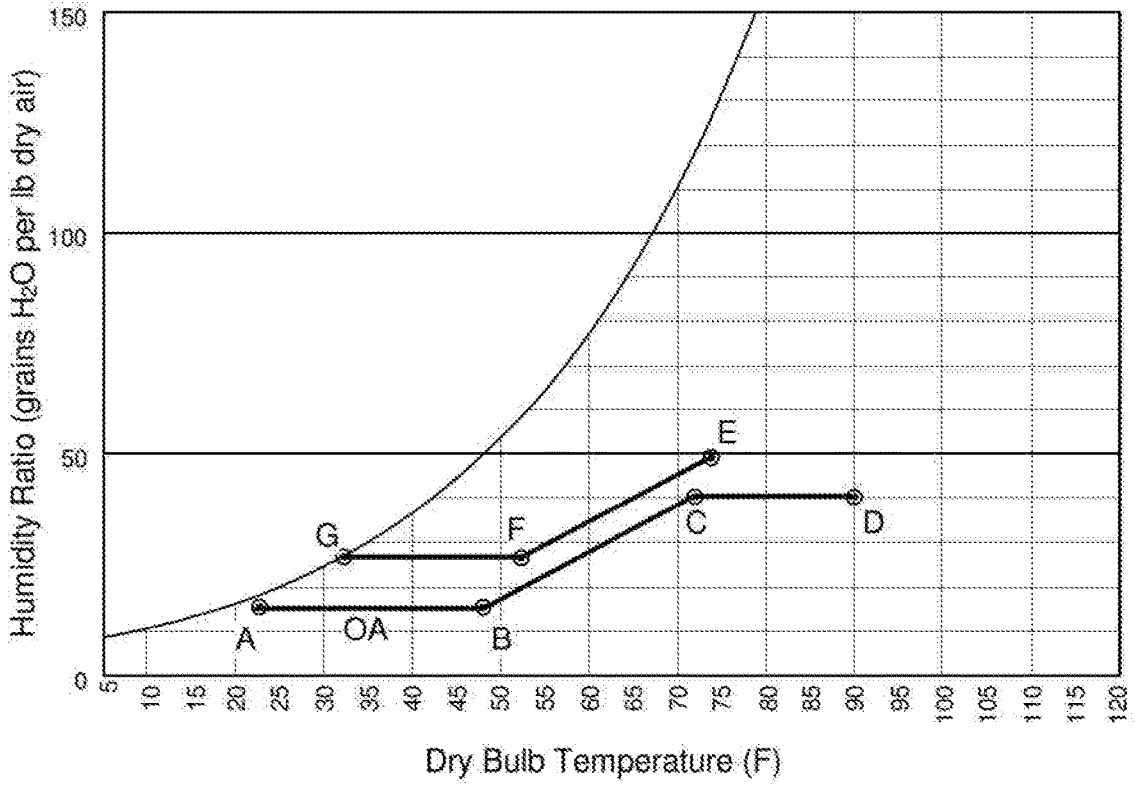
FIGS. 10*a*-10*e* illustrate psychrometric charts corresponding to the operations of an air handling system, according to an exemplary disclosed embodiment.

FIG. 10*a* illustrates a psychrometric chart corresponding to the operation of air handling system of FIG. 9*b* according to the present disclosure. FIGS. 9*b* and 10*a* depict a first airstream of outside air (OA) to supply air (SA) and a second airstream of return air (RA) to exhaust air (EA). As shown in FIG. 10*a*, the first airstream may traverse points A, B, C, and D, and the second airstream may traverse points E, F, and G. FIG. 10*a* charts the estimated temperatures and humidity levels for the first and second airstreams as they traverse these points.

The first airstream and the second airstream may pass through heat exchanger 916 and enthalpy exchanger 915 in a counterflow orientation. Point E may represent a typical winter return air condition from a conditioned space. The second airstream may enter an entry port of enthalpy exchanger 915 at point E on FIG. 10*a* and may flow through enthalpy exchanger 915 to point F. The first airstream may flow simultaneously through enthalpy exchanger 915 from point B to point C in a counterflow orientation in relation to the second airstream flowing through enthalpy exchanger 915 from point E to point F. As the second airstream flows through enthalpy exchanger 915 from point E to point F and the first airstream flows through enthalpy exchanger 915 from point B to C, moisture and heat content may transfer from the second airstream to the first airstream.

The second airstream may also enter an entry port of heat exchanger 916 at point F on FIG. 10*a* and flow through heat exchanger 916 to point G. The first airstream may flow simultaneously through heat exchanger 916 from point A to point B in a counterflow orientation in relation to the second airstream. As the second airstream flows through heat exchanger 916 from point F to point G and the first airstream flows through heat exchanger 916 from point A to point B, heat content may transfer from the second airstream to the first airstream. The first airstream may exit enthalpy exchanger 915 at point C and may enter exhaust air coil 922*a*. The first airstream may receive heat from the exhaust air coil 992*c* and be heated to a point D.

Figure 10B:
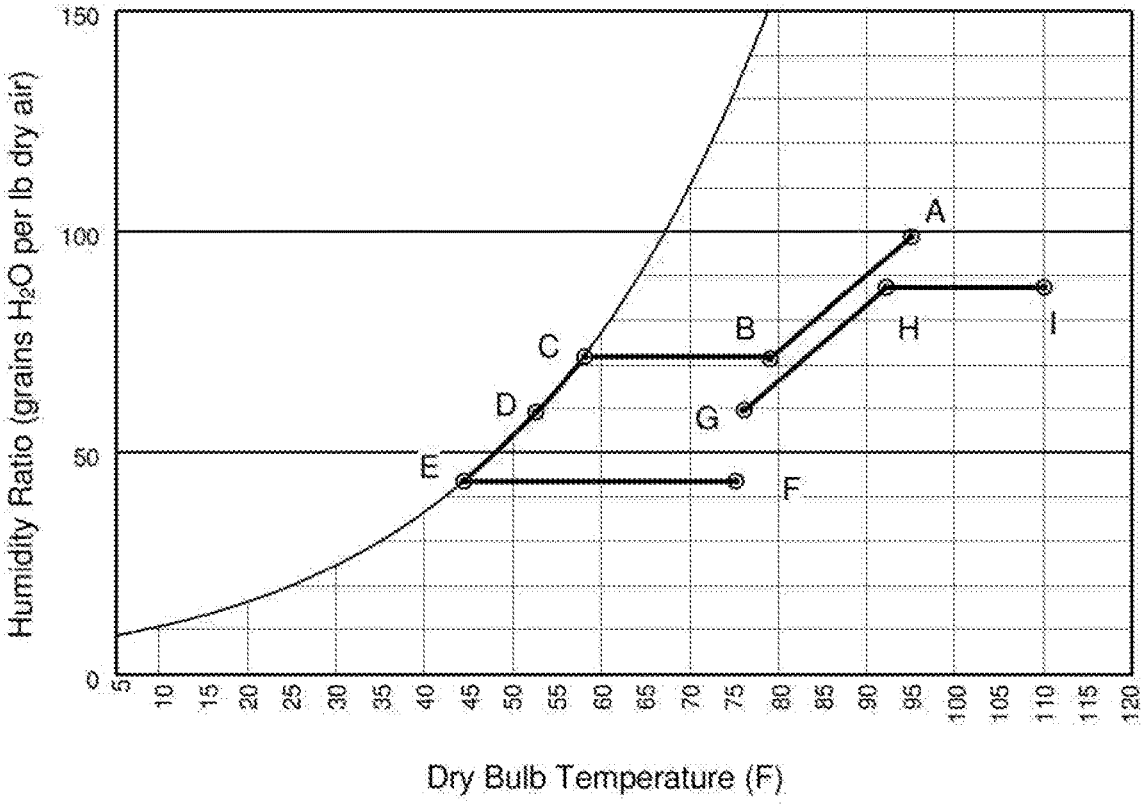

FIG. 10*b* illustrates a psychrometric chart corresponding to the operation of air handling system of FIG. 9*c* according to the present disclosure. FIGS. 9*c* and 10*b* depict a first airstream of outside air (OA) to supply air (SA) and a second airstream of return air (RA) to exhaust air (EA). As shown in FIG. 10*b*, the first airstream may traverse points A, B, C, D, E, and F, and the second airstream may traverse points G, H, and I. FIG. 10*b* charts the estimated temperatures and humidity levels for the first and second airstreams as they traverse these points.

The first airstream and the second airstream may pass through enthalpy exchanger 915 in a counterflow orientation. Point G may represent a typical summer return air condition from a conditioned space. The second airstream may enter an entry port of enthalpy exchanger 915 at point G on FIG. 10*b* and may flow through enthalpy exchanger 915 to point H. The first airstream may flow simultaneously through enthalpy exchanger 915 from point A to point B in a counterflow orientation in relation to the second airstream flowing through enthalpy exchanger 915 from point G to point H. As the second airstream flows through enthalpy exchanger 915 from point G to point H and the first airstream flows through enthalpy exchanger 915 from point A to point B, moisture and heat content may transfer from the first airstream to the second airstream. The second airstream may exit enthalpy exchanger 915 at point H and may flow through exhaust air coil 992*c*. The second airstream may receive heat from exhaust air coil 992*c* and may be heated to point I.

The first airstream may also enter an entry port of heat exchanger 916 and may flow through heat exchanger 916 being sensibly cooled to point C. The first airstream may exit enthalpy exchanger 915 at point C and may flow through evaporator coil 992*a*. The first airstream may be cooled and dehumidified by evaporator coil 992 to point D. The first airstream may then be directed through another evaporator coil 992*b*. The first airstream may be cooled and dehumidified by evaporator coil 99*b* to point E. The first airstream may again be directed through heat exchanger 916 and may be sensibly heated to point F.

Figure 10C:
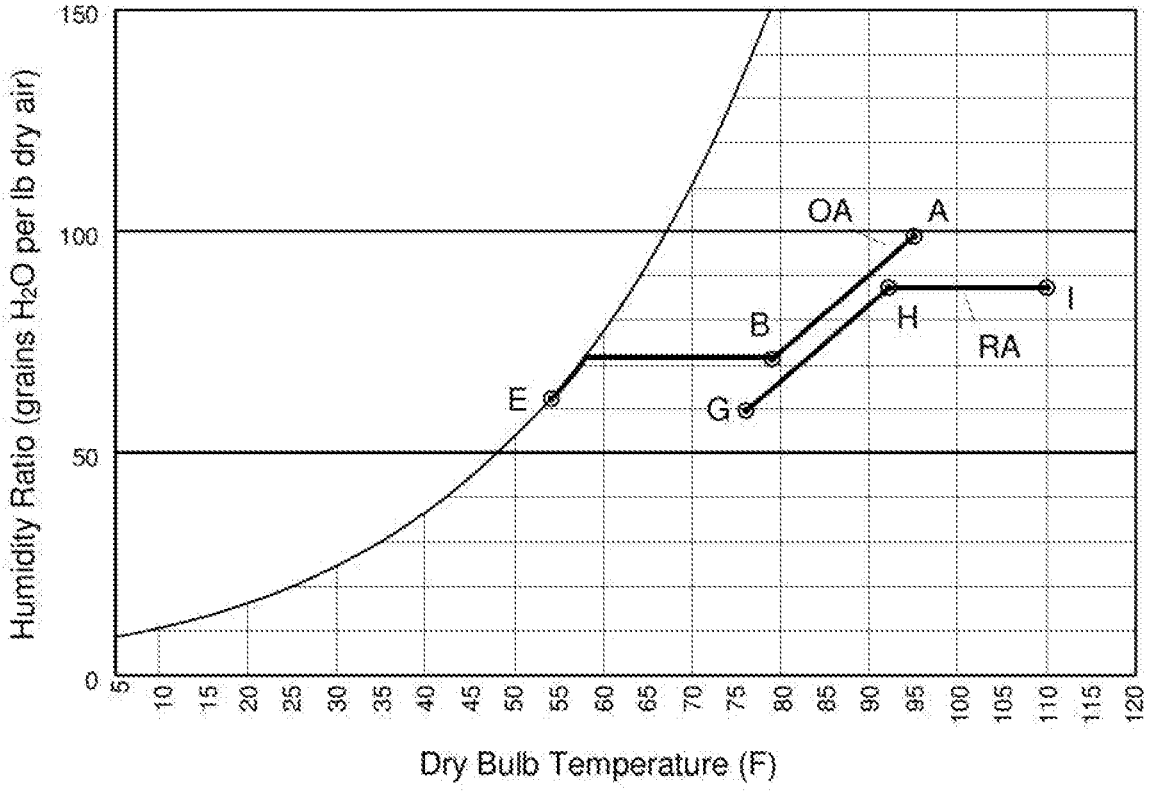

FIG. 10*c* illustrates a psychrometric chart corresponding to the operation of the air handling system of FIG. 9*d* according to the present disclosure. FIGS. 9*d* and 10*c* depict a first airstream of outside air (OA) to supply air (SA) and a second airstream of return air (RA) to exhaust air (EA). As shown in FIG. 10*c*, the first airstream may traverse points A, B, and E, and the second airstream may traverse points G, H, and I. FIG. 10*c* charts the estimated temperatures and humidity levels for the first and second airstreams as they traverse these points.

The first airstream and the second airstream may pass through enthalpy exchanger 915 in a counterflow orientation. Point A may represent a typical summer outside air condition. The first airstream may enter an entry port of enthalpy exchanger 915 at point A of FIG. 10*c* and may flow through enthalpy exchanger 915 to point B. The second airstream may enter an entry port of enthalpy exchanger 915 at point G of FIG. 10*c* and may flow simultaneously from point G to point H in a counterflow orientation in relation to the first airstream. As the first airstream flows through enthalpy exchanger 915 from point A to point B and the second airstream flows through enthalpy exchanger 915 from point G to point H, moisture and heat content may transfer from the first airstream to the second airstream. The first airstream may then flow through evaporator coil 992*b* and may be cooled and dehumidified to point E. The second airstream may exit enthalpy exchanger 915 at point H and may flow through exhaust air coil 992*c*. The second airstream may receive heat from exhaust air coil 992*c* and may be heated to point I.

Figure 10D:
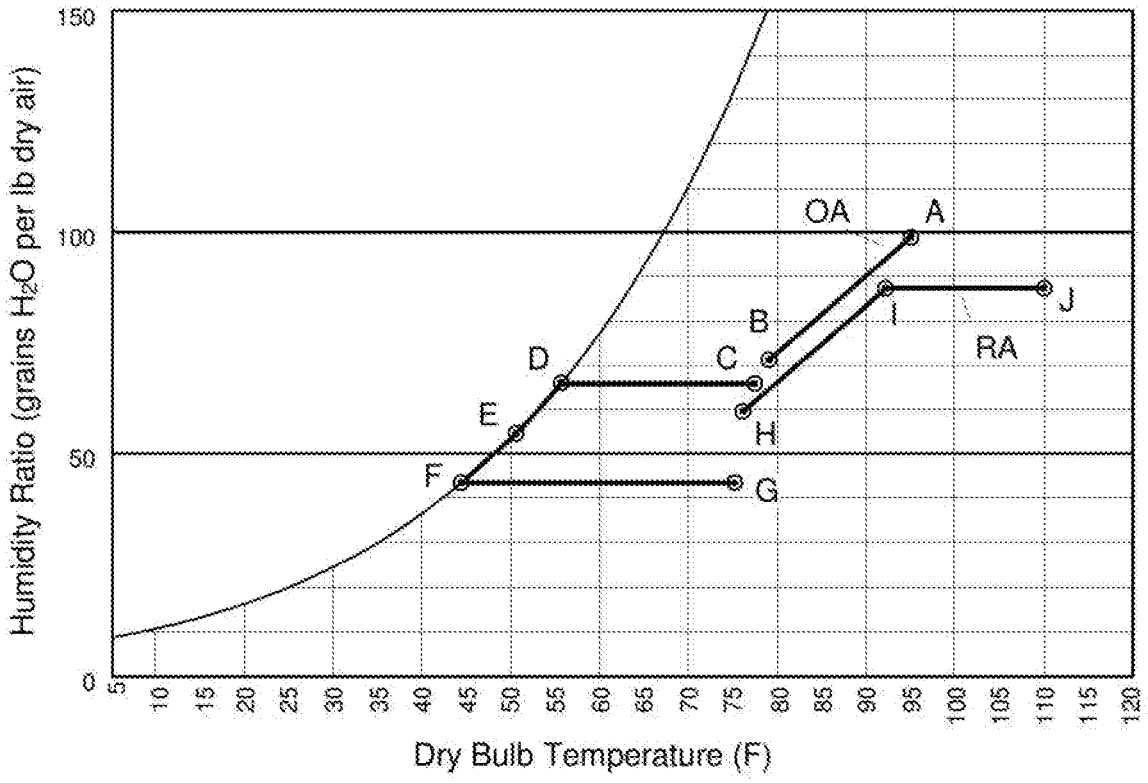

FIG. 10*d* illustrates a psychrometric chart corresponding to the operation of the air handling system of FIG. 9*f* according to the present disclosure. FIGS. 9*f* and 10*d* depict a first airstream of outside air (OA) to supply air (SA), a second airstream of return air (RA) to exhaust air (EA), and a third airstream of supply air (SA). As shown in FIG. 10*d*, the first airstream may traverse points A and B, the second airstream may traverse points H, I, and J, and the third airstream may traverse points C, D, E, F, and G. FIG. 10*d* charts the estimated temperatures and humidity levels for the first, second, and third airstreams as they traverse these points.

The first airstream and the second airstream may pass through enthalpy exchanger 915 in a counterflow orientation. Point A may represent a typical summer outside air condition. The first airstream may enter entry port of enthalpy exchanger 915 at point A of FIG. 10*d* and may flow through enthalpy exchanger 915 to point B. The second airstream may enter entry port of enthalpy exchanger 915 at point H of FIG. 10*d* and may flow simultaneously from point H to point I in a counterflow orientation in relation to the first airstream. As the first airstream flows through enthalpy exchanger 915 from point A to point B and the second airstream flows through enthalpy exchanger 915 from point H to point I, moisture and heat content may transfer from the first airstream to the second airstream. The second airstream may exit enthalpy exchanger 915 at point I and may flow through exhaust air coil 992*c*. The second airstream may receive heat from the exhaust air coil 992*c* and may be heated to a point J.

The outside air (OA) of the first airstream and a partial volume flow of the return air (RA) of the second airstream may mix to form the third airstream in the form of supply air (SA) at point C. The third airstream may enter entry port of heat exchanger 916 at point C of FIG. 10*d* and may flow through heat exchanger 916 and may be sensibly cooled to point D. The third airstream may then flow through evaporator coil 992*a* and may be cooled and dehumidified to point E. The third airstream may then flow through another evaporator coil 992*b* and may be cooled and dehumidified to point F. The third airstream may then encounter may again enter heat exchanger 916 at point F and may flow through heat exchanger 916 and may be sensibly heated to point G.

Figure 10E:
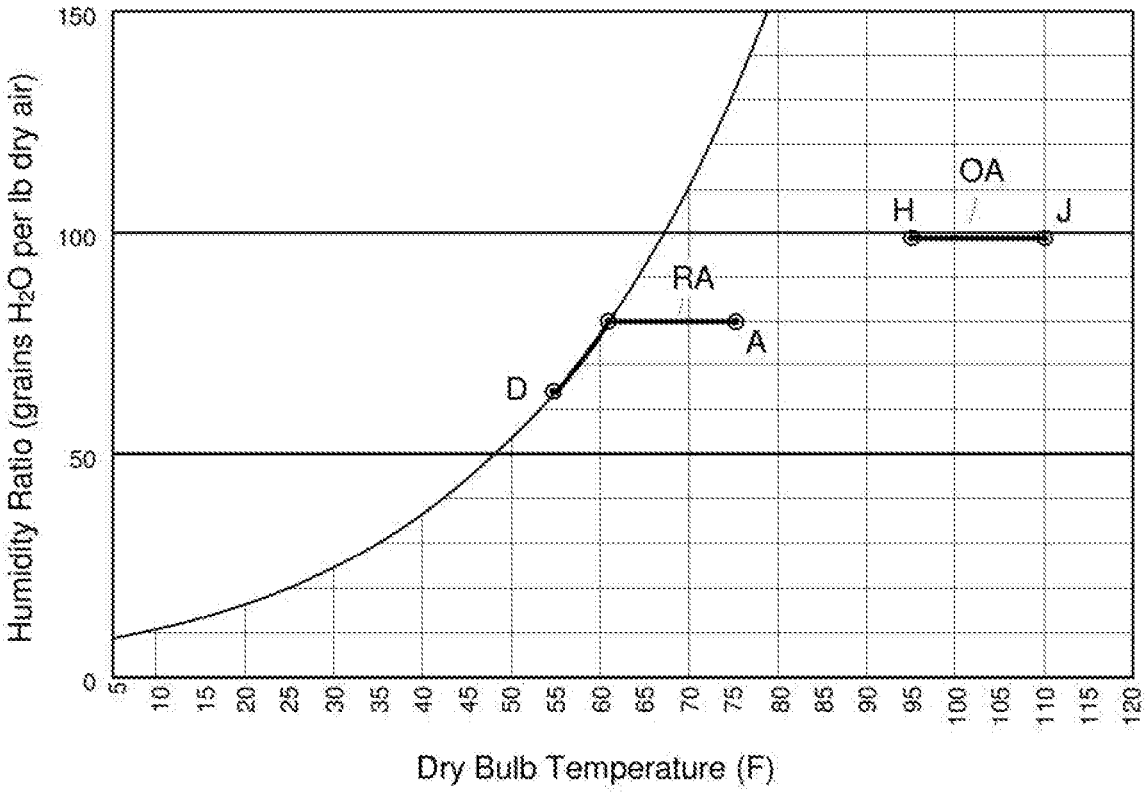

FIG. 10*e* illustrates a psychrometric chart corresponding to the operation of air handling system of FIG. 9*g* according to the present disclosure. FIGS. 9*g* and 10*e* depict a first airstream of outside air (OA) to exhaust air (RA) and a second airstream of return air (RA) to supply air (SA). As shown in FIG. 10*e*, the first airstream may traverse points H though J, and the second airstream may traverse points A through D. FIG. 10*e* charts the estimated temperatures and humidity levels for the first and second airstreams as they traverse these points.

The first airstream and the second airstream may flow through enthalpy exchanger 915 and heat exchanger 916, respectively, but may not experience a state change as no opposing airstream may flow in a counterflow orientation. Point A may represent a typical summer return-air condition. The second airstream may flow through evaporator coil 992*b*, heat exchanger 916, and evaporator coil 992*c*, and may be cooled and dehumidified to point D. The first airstream may enter enthalpy exchanger 915 at point H, flow through enthalpy exchanger 915, and flow through exhaust air coil 992*c*, receiving heat from exhaust air coil 992*c* and may be heated to point J.

Persons of ordinary skill in the art would appreciate that the air handling system of the present disclosure may be modular with respect to the power and velocity of the air flows delivered and supplied by the system. For example, and as shown in FIGS. 7*a*-7*b*, multiple air handling modules may be stacked together (horizontally or vertically) to increase the power, velocity, and capacity of the air flows associated with the system. The power, velocity, and noise of the air flows may be increased or decreased by adjusting the fan speed of the fan boxes. In certain embodiments, the air handling system may be coupled to an existing HVAC unit. One or more air handling modules may be coupled to an HVAC unit to increase the capacity of the HVAC unit. In such an embodiment, the air handling system may act as a pre-treatment stage to remove heat and humidity from air that is supplied to an HVAC unit.

Membranes for Exchanger and Related Methods of Manufacture

Enthalpy exchangers of the present disclosure may embody a variety of configurations depending on, among other factors, the desired application. For example, an enthalpy exchanger may be a planar heat and moisture plate-type exchanger. The enthalpy exchanger may comprise of membrane plates each constructed of a planar, water-permeable membrane. Membrane plates may be stacked and sealed and may be configured to accommodate air streams flowing in counter-flow configurations between alternate plate pairs. This may facilitate heat- and water vapor-transfer via the membrane, while preventing the air streams from mixing, or otherwise contacting one another. In other embodiments, the enthalpy exchanger may include membrane plates arranged to accommodate air streams flowing in crossflow configurations between alternate plate pairs.

In some embodiments, the membrane may permit heat and not moisture to be transferred across the material from one air stream to the other. The membrane of the enthalpy exchanger may, in addition or as an alternative to the membrane plates, comprise a single membrane core made by folding a continuous strip of membrane in a concertina, zig-zag or accordion fashion, with a series of parallel alternating folds.

The present disclosure also contemplates an enthalpy exchanger which may have a rotating wheel arrangement. The enthalpy exchanger may comprise a membrane constructed to include a number of parallel pores or opening, such as a honeycomb structure, through which air passes. The enthalpy exchanger may be formed by winding or stacking the membrane into a wheel shape to provide air passageways parallel to the axis of the wheel.

The membrane or transfer medium of the present disclosure may be used to form heat and moisture transfer bodies, such as enthalpy exchangers, and may comprise a substrate embedded with microporous particles. The substrate may comprise fibrous materials, including, for example, natural cellulose fibers, as well as synthetic thermoplastic fibers, such as polyvinyl alcohol polymer fibers, bicomponent fibers and microfibers. The substrate may comprise any type of fibrous materials that may hold substantial amounts of liquids and microporous particles. The substrate may be formed by conventional paper making processes into adsorbent paper or desiccant paper having adsorbent or desiccant contained therein. In some embodiments, additives, such as reinforcement fibers, may be added to the substrate.

Examples of fibrous materials suitable for use as substrate may include: wood pulp; cellulose fiber; synthetic thermoplastic organic fiber; and mixtures thereof. Inorganic fiber, such as glass or metal fibers and rock wool, may also be used in conjunction with fibrillated organic fiber. The substrate may also comprise synthetic organic thermoplastic fiber including: polymeric fiber, such as polyethylene, polypropylene, polystyrene, polyvinyl chloride, polyester, rayon (cellulose acetate), acrylic, acrylonitrile homopolymer, copolymer with halogenated monomer, styrene copolymer, and mixtures of such polymers. Suitable synthetic thermoplastic organic fiber may be in staple form (chopped yarn), fabricated form (staple form that has been refined), or extruded/precipitated form. In certain embodiments, substrate may comprise one or more of: soft wood fiber, such as Rayonier Poroganier; fiberglass; biocomponent fiber, such as T-201 bicomponent; acrylic fiber, such as Vonnel microfiber; and PVA fiber, such as Kuralon.

Microporous particles may be embedded into the substrate and may comprise any material capable of efficiently holding liquids through capillary action, surface tension, or other mechanisms. Microporous particles may be activated for adsorption by removing water from their hydrated precursors. Microporous material may be capable of efficiently adsorbing/desorbing said moisture to a counter-flowing air stream. Microporous material may also be capable of efficiently adsorbing/desorbing said moisture to a crossflowing air stream.

Substrate embedded with microporous particles may have liquid sorption capacity for liquids, such as, for example, lithium chloride, water, lithium bromide, tri-ethylene glycol, calcium chloride, potassium formate, zinc-carbon, zinc-chloride, alkaline, nickel oxyhydroxide, lithium-copper oxide, lithium-iron disulfide, lithium-manganese dioxide, lithium-chromium oxide, lithium-silicone, mercury oxide, zinc-air, silver-oxide, magnesium, NiCd, lead-acid, NiMH, NiZn, AgZn, LiFePO4, lithium ion, and mixtures thereof. In some embodiments, the liquid may be a lithium chloride with an amount of lithium chloride in the solution being 8.3% wt. or less.

Microporous particles may include activated aluminas, silica gels, molecular sieves, porous titania, or zeolites, activated carbon, and the like, and mixtures of these compounds. In certain embodiments, microporous particles may include transition alumina, such as gamma alumina, due to their inert properties, lower cost, and wide market availability. An example of commercially available gamma alumina is VGL 15 produced by U.O.P. Corporation.

Figure 11A:
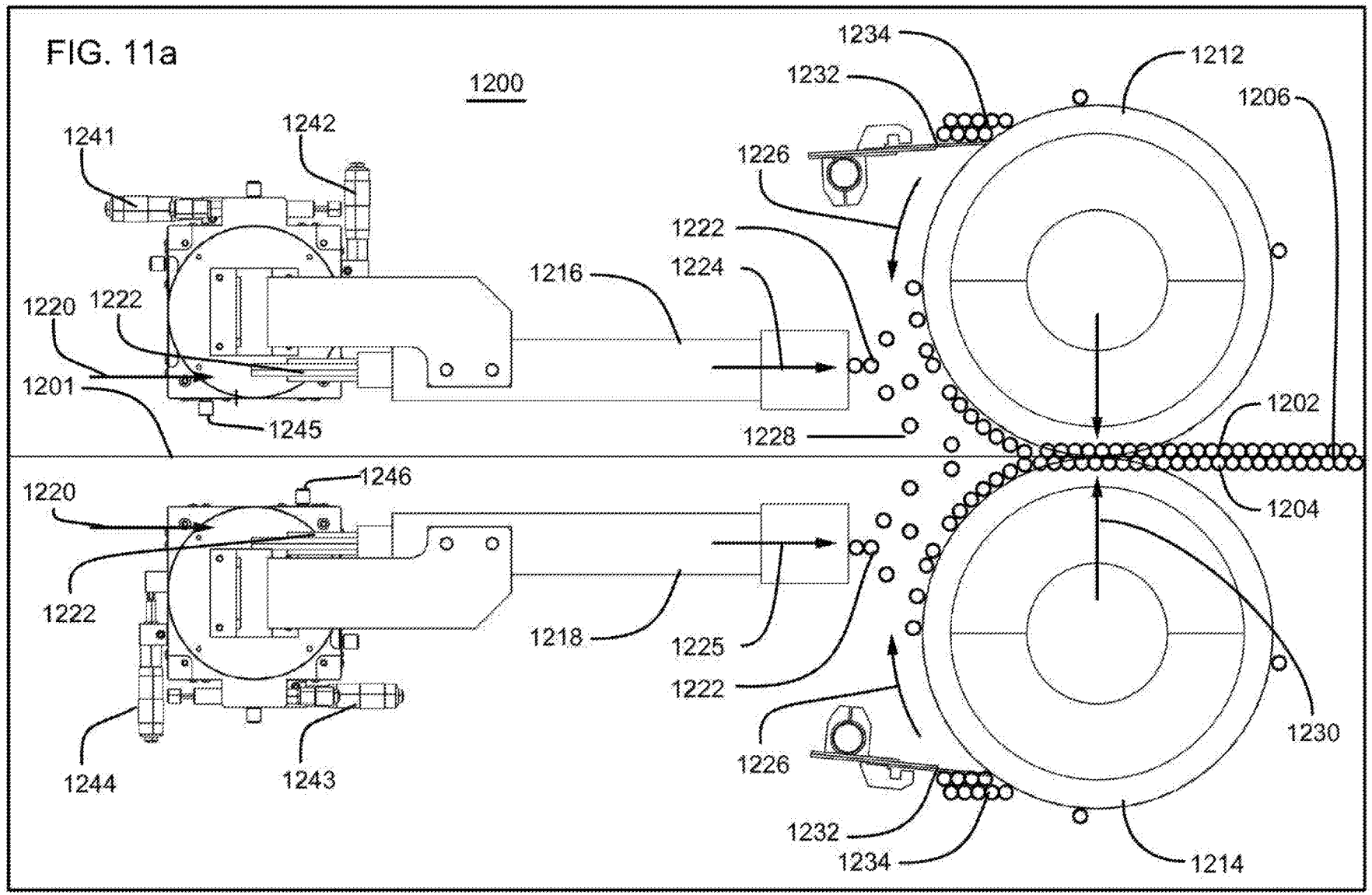
FIGS. 11*a* and 11*b* illustrate perspective views of an exemplary process for manufacturing a membrane for an exchanger, according to an exemplary disclosed embodiment.
Figure 11B:
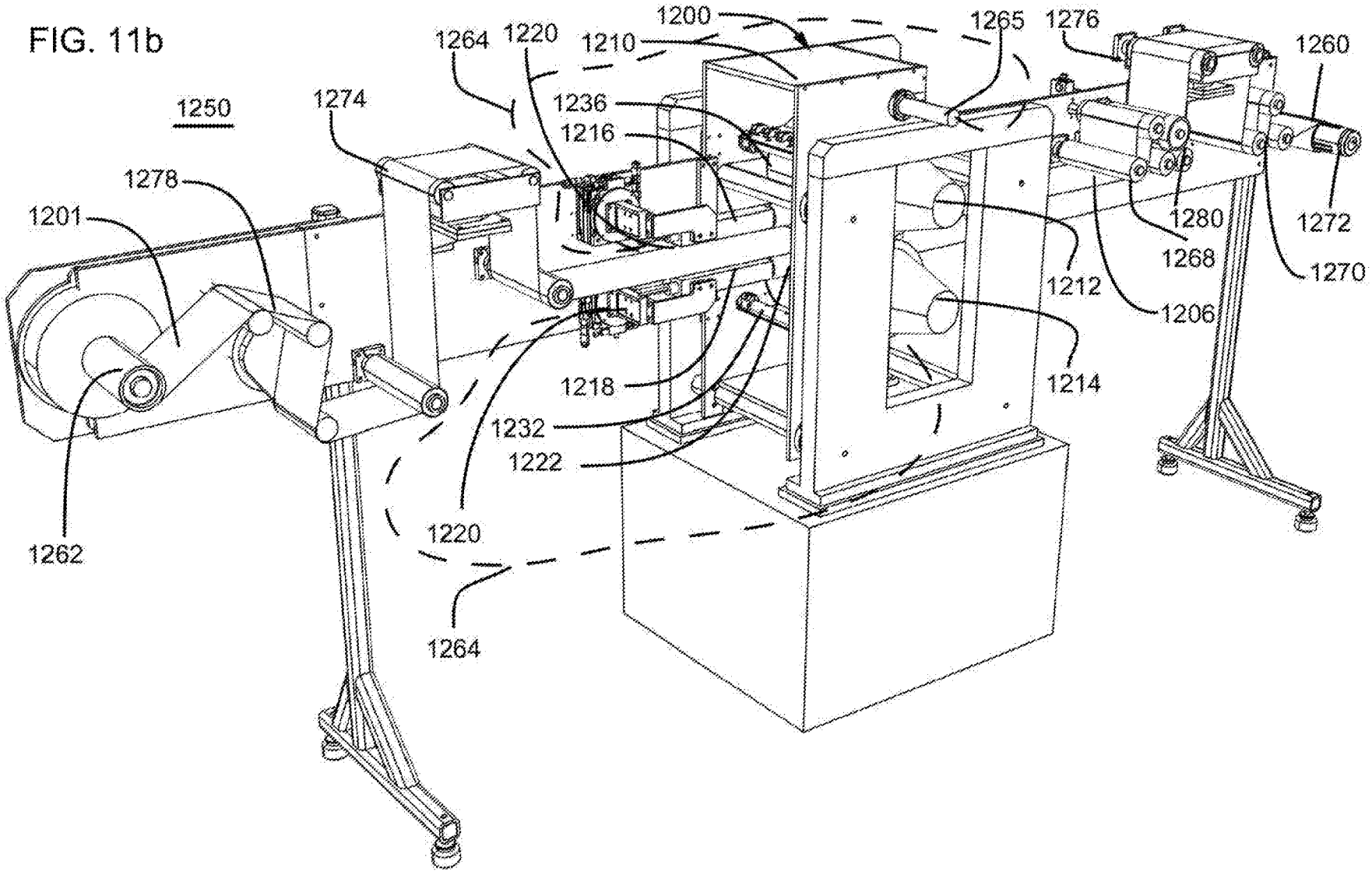

An exemplary system and process for manufacturing substrate for use as a membrane or transfer medium according to the present disclosure will now be described with reference to FIGS. 11*a* and 11*b*. As shown in FIGS. 11*a* and 11*b*, a roll of substrate 1201 may be continuously fed to coating chamber 1200. As substrate 1201 is fed through coating chamber 1200, substrate 1201 may be embedded with microporous particles and may exit coating chamber 1200 as membrane or transfer medium 1206. Membrane 1206 may be continuously collected and rolled up into a roll of membrane 1260.

Substrate 1201 may be a thermoplastic sheet formed of thermoplastic fibers, such as polypropylene. In some embodiments, additives, such as reinforcement fibers, may be added to the thermoplastic sheet. Alternatively, substrate 1201 may comprise paper formed of natural fibers, such as wood pulp or cellulose.

Microporous particles embedded into substrate 1201 may include transition alumina, such as gamma alumina. In some embodiments, membrane 1206 may comprise a thermoplastic sheet containing gamma alumina, and in other embodiments, membrane 1206 may comprise paper containing gamma alumina. The present disclosure contemplates that membrane 1206 may be manufactured by coating or embedding any suitable substrate with any suitable microporous particles, as described above.

Coating chamber 1200 may include housing 1210 enclosing first calender roller 1212 and second calender roller 1214. First coating apparatus 1216 may be positioned proximate first calender roller 1212, and second coating apparatus 1218 may be positioned proximate second calender roller 1214. Each of first coating apparatus 1216 and second coating apparatus 1218 may be configured to spray microporous particles (e.g., gamma alumina) in powdered form onto its respective calender roller 1212, 1214. First and second coating apparatuses 1216, 1218 may be connected to source 1220 of powdered microporous particles via suitable supply lines 1222. Powdered microporous particles may be delivered from source 1220, through supply lines 1222, and sprayed from first and second coating apparatuses 1216, 1218 by any appropriate means, including, for example, compressed air.

First and second coating apparatuses 1216, 1218 may impart a positive charge onto microporous particles 1222 as they are sprayed out of first and second coating apparatuses 1216, 1218 and onto first and second calender rollers 1212, 1214. Each of first and second calender rollers 1212, 1214 may be electrically grounded. As such, powdered microporous particles may be electrostatically coated onto first and second calender rollers 1212, 1214.

Persons of ordinary skill in the art would appreciate that first and second coating apparatuses 1216, 1218 may be configured to control the rate at which charged microporous particles are sprayed and may be configured to control the electrical charge rate of powdered microporous particles as they exit the apparatuses 1216, 1218. First and second coating apparatuses 1216, 1218 may include any suitable device for use in electrostatic coating. For example, in some embodiments, first and second coating apparatuses 1216, 1218 may include powder coating spray guns. A high degree of uniformity may be achieved as a monolayer of microporous particles 1222 may adhere to rollers 1212, 1214. This uniformity may be achieved because the high electrical potential between microporous particles 1222 and rollers 1212, 1214 may diminish exponentially after a first monolayer is deposited. An electrostatic cloud of sprayed microporous particles 1222 may create nearly complete coverage of these monolayer microporous particles 1222 on the top and bottom rollers 1212, 1214. In some embodiments, the microporous particles 1222 loading to the thermoplastic substrate sheet 1201 may be as high as 90% by weight. It should be appreciated that in other embodiments, the loading of the microporous particles 1222 to the substrate 1201 may be 50% to 90% by weight, and in certain embodiments, the loading of the microporous particles 1222 to the substrate 1201 may be 50% to 60% by weight.

Each of first and second calender rollers 1212, 1214 may be configured to embed powdered microporous particles into substrate 1201. Substrate 1201 may be fed between rollers 1212, 1214, and rollers 1212, 1214 may rotate in a direction toward the feed direction of substrate 1226. Rollers 1212, 1214 may comprise hard, anti-stick material and may be configured to be heated to a suitable temperature. In some embodiments, rollers 1212, 1214 may be formed of hardened steel. Persons of ordinary skill in the art would appreciate that rollers 1212, 1214 may be diamond coated. As rollers 1212, 1214 rotate, rollers 1212, 1214 may press onto the top and bottom surfaces of the substrate 1230 and embed the surfaces of substrate 1201 with powdered microporous particles from rollers 1212, 1214.

The heat and pressure between rollers 1230 may transfer the powdered microporous particles from rollers 1212, 1214 onto substrate 1201 by impregnating the substrate 1201 with microporous particles. In some embodiments, rollers 1212, 1214 may be heated to at or near the melting point of the thermoplastic fibers forming a thermoplastic substrate to embed microporous particles with thermoplastic fibers and improve the bond and concentration of the microporous particles on the substrate. For example, when coating a polypropylene substrate with microporous particles, rollers 1212, 1214 may be heated up to, but not exceeding, the melting point of polypropylene (160° C.). Line speeds greater than 10 meters per minute may be achieved. In some embodiments, hydraulic pressure at the nip of an 8-inch-wide membrane may be between 2,000 psi and 5,000 psi, and preferably 4,000 psi. A metering-type calender may be advantageous in controlling the thickness of the membrane.

Rollers 1212, 1214 may be straight rollers. Persons of ordinary skill in the art would appreciate that in other embodiments, the rollers 1212, 1214 may have an arch-shaped configuration to, for example, accommodate flexing of the rollers under pressure particularly in impregnating wider substrates. Rollers 1212, 1214 may be arched to accommodate pressure while maintaining a straight contact surface. Rollers 1212, 1214 may be meter rollers configured to meter the amount of powdered microporous particles transferred onto sheeting structure 1201. Rollers 1212, 1214 may comprise wells or cups etched onto the coating surface of rollers 1212, 1214 that carry a certain amount of powdered microporous particles. The wells or cups of rollers 1212, 1214 may meter the certain amount of powdered microporous particles transferred onto sheeting structure 1201 with an even and uniform thickness of microporous particles. In other embodiments, rollers 1212, 1214 may have a substantially smooth coating surface.

Coating chamber 1200 may also include one or more doctor blades 1232 in contact with the coating surfaces of first and second calender rollers 1212, 1214. Doctor blades 1232 may be configured to remove excess microporous particles 1234 that are coated on first and second calender rollers 1212, 1214 by wiping first and second calender rollers 1212, 1214 as they rotate relative to doctor blades 1232. By removing excess microporous particles on first and second calender rollers 1212, 1214, doctor blades 1232 may also even out the distribution of microporous particles coated on rollers 1212, 1214 and reduce splotching of microporous particles.

Doctor blades 1232 may be formed of any suitable material, including, for example, steel or plastic. It should also be appreciated that doctor blades 1232 may be adjusted depending on the conditions of the coating process. For example, the radial positions of doctor blades 1232 relative to rollers 1212, 1214, the positions of doctor blades 1232 relative to the longitudinal axis of rollers 1212, 1214, the angle at which doctor blades 1232 contact rollers 1212, 1214, and the pressure applied by doctor blades 1230 may be adjusted to address the locations and degree of excess microporous particles to be removed.

In some embodiments, shrouds 1236 may be coupled to the edges of each of first and second calender rollers 1212, 1214. Shrouds 1236 may extend along the longitudinal axis of each of rollers, 1212, 1214 and cover portions of the coating surfaces of rollers 1212, 1214 adjacent to their edges. The shrouds 1236 may block microporous particles from coating portions of the coating surfaces covered by shrouds 1236. Accordingly, shrouds 1236 may frame the coating surface of rollers 1212, 1214 to match a given width of substrate 1201 to be deposited with microporous particles. Shrouds 1236 may therefore reduce the amount of wasted microporous particles that may be coated on the edge of rollers 1212, 1214 but do not contact and transfer to substrate 1201. Shrouds 1236 may be adjustable in length relative to the longitudinal axes of the rollers 1212, 1214 to accommodate various widths of substrate 1201. Persons of ordinary skill in the art would also appreciate that shrouds 1236 may be formed of any suitable material that is electrically insulated and anti-stick to avoid microporous particles coating shrouds 1236.

First and second coating apparatuses 1216, 1218 may be arranged relative to first and second calender rollers 1212, 1214 to regulate the coating properties of microporous particles onto substrate 1201. For example, the position of first coating apparatus 1216 may be angled relative to first calender roller 1212 and the position of second coating apparatus 1218 may be angled relative to second calender roller 1214 depending on the desired direction the powdered microporous particles are to be sprayed onto first and second calender rollers 1212, 1214. In some embodiments, first coating apparatus 1216 may be angled upwards such that a spray end of first coating apparatus 1224 may be pointed towards an upper portion of first calender roller 1212, and second coating apparatus 1218 may be angled downwards such that a spray end of second coating apparatus 1218 may be pointed towards a lower portion of second calender roller 1214. The angle between first coating apparatus 1216 and the longitudinal axis of the feed direction of substrate 1201 may be approximately 45°, and the angle between second coating apparatus 1218 and the longitudinal axis of the feed direction of substrate 1201 may be approximately negative 45°.

First and second coating apparatuses 1216, 1218 may be adjusted to any suitable angle relative to first and second calender rollers 1212, 1214, respectively. In other embodiments, for example, first coating apparatus 1216 may be angled downwards such that a spray end of first coating apparatus 1224 may be pointed towards a lower portion of first calender roller 1212, and second coating apparatus 1218 may be angled upwards such that a spray end of second coating apparatus 1225 may be pointed towards an upper portion of second calender roller 1214.

Angling the position of first and second coating apparatuses 1216, 1218 relative to first and second calender rollers 1212, 1214 may improve the uniformity of powdered microporous particles spray coated onto first and second calender rollers 1212, 1214, which in turn may provide a more uniform distribution of microporous particles embedded into substrate 1202 and 1204. In contrast, first and second coating apparatuses 1216, 1218 horizontally positioned relative to first and second calender rollers 1212, 1214, respectively (i.e., substantially parallel to the longitudinal axis of the feed direction of the substrate 1201), may result in uneven accumulation and coating of the powdered microporous particles on first and second calender rollers 1212, 1214. This, in turn, may result in an uneven distribution and splotching of microporous particles embedded into substrate 1201. Uneven distribution and splotching of microporous particles that may be caused by horizontally positioning first and second coating apparatuses 1216, 1218 may be avoided by adjusting the proximity of first and second coating apparatuses 1212, 1214 relative to first and second calender rollers 1212, 1214, the rate at which powdered microporous particles are sprayed, and the electrical charge rate of powdered microporous particles as they exit the apparatuses.

X-axis (horizontal) adjustments of first and second coating apparatuses 1212, 1214 may be made via a micrometer 1241, 1243. Y-axis adjustments (vertical) of first and second coating apparatuses 1212, 1214 may be made via micrometer 1242, 1244. Angular adjustments of first and second coating apparatuses 1212, 1214 may be made via micrometer 1245, 1246.

In other embodiments, first and second coating apparatuses 1216, 1218 may be vertically positioned relative to first and second calender rollers 1212, 1214, respectively (i.e., substantially perpendicular to the longitudinal axis of the feed direction of the substrate 1201). This configuration may avoid excess accumulation of powdered microporous particles on substrate 1201.

The proximity of first and second coating apparatuses 1216, 1218 relative to first and second calender rollers 1212, 1214 may also affect the density and distribution of powdered microporous particles spray coated onto first and second calender rollers 1212, 1214. In some embodiments, first coating apparatus 1216 may be positioned three (3) to twelve (12) inches on an eight (8) inch wide roller from first calender roller 1212, and second coating apparatus 1218 may be positioned three (3) to twelve (12) inches on an eight (8) inch wide roller from second calender roller 1214. The widths of the rollers and spray patterns may be adjusted to accommodate different distances between the rollers and the coating apparatuses. Positioning first and second coating apparatuses 1216, 1218 closer to first and second calender rollers 1212, 1214 may focus a spray profile of powdered microporous particles and concentrate the amount of powdered microporous particles coated on particular surface areas of first and second calender rollers 1212, 1214. Positioning the first and second coating apparatuses 1216, 1218 further away from first and second calender rollers 1212, 1214 may expand a spray profile of powdered microporous particles and coat more of the surface areas of first and second calender rollers 1212, 1214 with powdered microporous particles. The expanded spray profile may also increase the amount of powdered microporous particles that may pass and not be electrostatically picked up by first and second calender rollers 1212, 1214.

Coating chamber 1210 may also include reclamation system 1264 configured to return powdered microporous particles that are not impregnated into substrate 1201 from coating chamber 1210 to source 1220. Reclamation system 1264 enables the process to recycle and reuse unimpregnated coating material. Reclamation system 1264 may include one or more outlet ports 1265 disposed in coating chamber 1200 connected to source 1220 via suitable conduits 1264. As the powdered microporous particles are sprayed from first and second coating apparatuses 1212, 1214, any powdered microporous particles that may not have been coated on first and second calender rollers 1212, 1214 or deposited onto substrate 1201 may be collected from coating chamber 1200 and returned to source 1220. Microporous particles may exit through outlet ports 1265 and be delivered through conduits 1264 and to source 1220 by any appropriate means, including, for example, a vacuum source.

Persons of ordinary skill in the art would appreciate that the process for manufacturing the membrane of the present disclosure may obviate the use of additives, such as retention aids and binders (e.g., polyvinyl alcohol, hydrophilic latex, and starch) to embed and retain microporous particles within the fiber matrix of substrate 1201. The process of the present disclosure may manufacture the membrane 1206 by embedding the microporous particles into the substrate 1201 without using or by reducing the amount of additives on substrate 1201, rollers 1212, or microporous particles. Accordingly, unspent microporous particles in the coating chamber 1222 that have not been deposited onto substrate 1201 may be reclaimed and reused via reclamation system 1264 without the need for any additional conditioning or other processing of reclaimed microporous particles. In some embodiments, for example, approximately 20-30% of the powdered microporous particles sprayed from first and second coating apparatuses 1216, 1218 may be electrostatically coated on rollers 1212, 1214. Of this amount of material deposited on the rollers, approximately 30-40% of microporous particles coated on the rollers 1212, 1214 may be deposited onto substrate 1201. The remaining microporous particles 1234 that were deposited on rollers 1212, 1214 but not applied to the substrate 1201 may be wiped off rollers 1212, 1214 by doctor blades. This material along with the material that was not deposited on rollers 1212, 1214 may be continuously recycled and reused in preparing membrane 1206.

As shown in FIG. 11*b*, membrane 1206 exiting coating chamber 1200 may be delivered through cooling stage 1268. Cooling stage 1268 may include any suitable cooling mechanisms to cool membrane 1201 as it is fed from heated calender rollers 1212, 1214 of coating chamber 1200. Cooling stage 1268 may include one or more apparatuses to direct ambient or chilled air, such as, for example, air knives, onto the top and bottom surfaces of the membrane 1201. In other embodiments, cooling stage 1268 may include one or more outfeed rollers on or between which membrane 1206 may be calendered. The outfeed rollers may be chilled to ambient or cooler temperatures. By cooling the membrane 1206 immediately after it exits coating chamber 1200, cooling stage 1268 may set warm membrane 1206, control shrinkage, and preventing crinkles and other surface defects on membrane 1206.

Following cooling stage 1268, membrane 1206 enters rewinding stage 1270. Rewinding stage 1270 may include a number of rollers or a festoon that may deliver membrane sheet 1206 to rewinder 1272 configured to wind membrane sheet 1206 into a roll. Rollers and rewinder 1272 of rewinding stage 1270 may be configured to apply a constant tension on membrane sheet 1206 as membrane sheet 1206 is wound into the roll of membrane 1260. The tension applied on membrane sheet 1206 may be approximately two pounds per linear foot in a warm state. A tension significantly higher than 10 pounds per linear foot applied on membrane sheet 1206 in a warm state may create surface defects in membrane sheet 1206, such as microfractures, that may result in an undesired increase in the permeability of membrane sheet 1206. No tension or a tension significantly lower than one pound per linear foot applied on membrane sheet 1206 may disrupt deposition of the microporous particles on membrane sheet 1206, such as the uniformity and distribution of the microporous particles on the sheet 1206 surfaces.

Membrane 1206 manufactured by the manufacturing process of the present disclosure may include a number of advantageous properties when applied as a substrate for heat and/or moisture transfer applications, such as enthalpy exchangers. The coating surface of first calender roller 1212 may contact the entire top surface of substrate 1202, and the coating surface of 1204 second calender roller 1214 may contact the entire bottom surface of substrate 1201. In this configuration, the entire surface area of substrate 1201 may be impregnated with microporous particles. Rollers 1212, 1214 may promote complete coverage of membrane 1206 with microporous particles. Rollers 1212, 1214, in combination with doctor blades 1232 and shrouds 1236, may also promote a homogenous and uniform embedding of the microporous particles into the surfaces of substrate 1201. In some embodiments, microporous particles may form a thin layer on the surfaces of membrane 1206, such as, for example, approximately 1 mil thick on each side of substrate 1201, and microporous particles may comprise 80-90 weight percent of the impregnated substrate material.

As a substrate material for heat and/or moisture transfer applications, it may be desirable for membrane 1206 to be impermeable to air. In some embodiments of the present disclosure, membrane 1206 may be formed of a paper coated with gamma alumina. In other embodiments, membrane 1206 may be formed of thermoplastic sheet coated with gamma alumina. Alumina may act as a natural release agent while any voids or areas of non-uniform coating will result in immediate adhesion of membrane material.

Membrane 1206 formed of a paper coated with gamma alumina may have a wide pore size distribution. An example of commercially available gamma alumina is VGL 15 produced by U.O.P. Corporation. The porosity selected of the gamma alumina-coated paper may permit the flow of moisture across membrane 1206 but block the flow of air. Accordingly, the gamma alumina-coated paper may accommodate both heat and moisture transfer across membrane 1206.

Preferred microporous particles may be a transition alumina, such as gamma alumina, due to their inert properties, electrical charge properties, lower cost, and wide market availability. These materials may be activated for adsorption by removing water from their hydrated precursors. Preferred surface area ranges may be between 100 $m^2$/gm and 250 $m^2$/gm. Preferred pore volume ranges may be 1.30 cc/g to 1.40 cc/g. Preferred loose bulk density optimized for spraying and imparting electrostatic charges may be between 150 kg/$m^3$ to 200 kg/$m^3$. Friability index values of 9-10 may be preferred. The higher the friability index, the more easily the product may be deagglomerated and may accept a charge more rapidly upon entrance into coating apparatuses. The friability index may be a function of calcination conditions. The friability index is the relative loss of >20-micron particles in a nominal 5 wt % slurry of caused by ultrasonification.

Membrane 1206 formed of a thermoplastic sheet coated with gamma alumina of the present disclosure may have a pore volume of approximately 1.36 cc/g. The porosity of the gamma alumina-coated thermoplastic sheet may restrict the flow of both air and moisture across the membrane 1206. Accordingly, the gamma alumina-coated thermoplastic sheet may accommodate only heat transfer across membrane 1206. The microporous particles may be any material capable of efficiently holding liquids through capillary action and surface tension while allowing for imparting a charge. The microporous material may also be capable of efficiently adsorbing/desorbing said moisture to a counter-flowing air stream. Examples of such microporous particles, include, for example, activated aluminas, silica gels, molecular sieves, porous titania, or zeolites, activated carbon, and mixtures thereof.

A single monolayer of microporous particle on the top side and a monolayer of microporous particle on the bottom side with greater than 99% roller coating coverage may be achievable. Coefficient of heat transfers may meet or exceed that of aluminum foils of equivalent thicknesses due to the high surface areas disrupting the boundary layer for fluid flow. Preferable heat transfer coefficients may exceed 59-64 w/m2·K at air velocity of 3 m/s. Preferable membrane thickness may range between 3 and 7 mils. A high tear resistance may be achievable utilizing polyethylene or polypropylene reinforced with various fiber types. Porous particles may be physically embedded onto the surface of a thermoplastic and held in place due to the physical porosity structure of the particle. Preferable weight ranges of a substrate before application of microporous particles may be 15 to 35 grams per square meter. Preferable weight ranges after application of microporous particles may be 60 to 130 grams per square meter.

The surfaces of the gamma alumina-coated paper and the gamma alumina-coated thermoplastic sheet may be highly wettable because the gamma alumina may adsorb large quantities of moisture. Moreover, the thermoplastic fibers of the gamma alumina-coated thermoplastic sheet may have low surface tension and promote sheet flow of moisture, including water and a liquid desiccant, such as lithium chloride, along the surfaces of the membrane 1206. By promoting the flow of a liquid desiccant along the surfaces of the membrane 1206, the thermoplastic fibers may promote air-to-liquid surface interaction resulting in a higher transfer efficiency from membrane 1206. In some embodiments, the thermoplastic sheet may be corona treated prior to being coated with the gamma alumina. Corona treating the surfaces of the thermoplastic sheet may further promote bonding of the gamma alumina to the sheet and may increase the wettable properties of membrane 1206.

While membrane 1206 of the present disclosure has been described in applications as a substrate for heat and moisture transfer applications, such as enthalpy exchangers, it would be apparent to persons of ordinary skill in the art that membrane 1206 may be used in other applications. For example, in some applications, membrane 1206 may be used as a battery separator material in an electrochemical cell.

Membrane 1206 may be processed under suitable post-manufacturing treatments. In some embodiments, membrane 1206 may be treated with a desiccant to increase the adsorption properties of membrane 1206 and further reduce its permeability. For example, membrane 1206 may be exposed to a brine solution including a liquid hydroscopic salt desiccant, such as lithium chloride, and dried so that desiccant is absorbed and maintained by membrane 1206.

Membrane 1206 may be folded and joined at certain edge locations to form multiple opening exchangers for various applications, including heat and/or water vapor exchangers. The exchangers may be suitable for use as exchangers in energy recovery ventilators (ERV) applications. The exchangers may also be used in heat and/or moisture applications, air filter applications, gas dryer applications, flue gas energy recovery applications, sequestering applications, gas/liquid separator applications, automobile outside air treatment applications, carbon dioxide scrubbing applications, airplane outside air treatment applications, and fuel cell applications. The exchangers typically may be disposed within a housing.

For example, in heat and/or moisture transfer applications, such as enthalpy exchangers membrane 1206 may be folded, layered, and sealed at certain edge locations to form an exchanger having multiple membrane layers with a plurality of inlet and outlet passageways in an alternating arrangement, as described in U.S. application Ser. No. 13/426,565; U.S. Pat. Nos. 9,562,726; and 7,824,766, each of which are incorporated herein by reference.

Membrane 1206 may be coated with a bonding material. In a preferred embodiment, a thermoplastic material may be extruded onto the edges of membrane 1206. The thermoplastic material may act as a bonding agent. The membrane 1206 may be folded and sealed at select portions of the edges by welding (e.g., ultrasonic, vibration, or heat) the thermoplastic-coated portions of the edges.

In some embodiments, the thermoplastic may be extruded on the edges of both the top surface and the bottom surface of membrane 1206, and the extruded thermoplastic material on the top surface and the extruded thermoplastic material on the bottom surface may extend laterally and join together. In other embodiments, the thermoplastic material may be extruded on the edges of only one of the top surface and the bottom surface of membrane 1206, and the extruded thermoplastic material may extend laterally and wrap around the edges of the membrane 1206 and bond to the other of the top surface and the bottom surface.

The thermoplastic material may be any suitable thermoplastic, including, for example, polyethylene. The width of the thermoplastic material extruded on membrane 1206 may be approximately 0.125-0.25 inches but may be adjusted to any other width appropriate to achieve a suitable bonding area between folds of membrane 1206. The microporous particles, such as gamma alumina, impregnated into the surface of substrate 1201 may protect membrane 1206 from potential damage that may otherwise result from the high heat of the edge coating process. For example, the gamma alumina deposited on substrate 1201 may insulate substrate 1201 from the high heat of the extruded polyethylene.

Separators for Exchanger and Related Methods of Manufacture

The enthalpy exchanger of the present disclosure may comprise membrane 1206 and separator. Separator may be positioned between layers of membrane 1206. Separator may be disposed in some or all the passageways between adjacent membrane layers and may assist with fluid flow distribution and/or to help maintain separation of the membrane layers. In some embodiments, separator may be a corrugated netting formed of thermoplastic material. Separator may be formed of any suitable material, including, for example, corrugated aluminum inserts, plastic molded inserts, and mesh inserts. In some embodiments, the separator may include porous materials, such as a porous felt, to facilitate wicking and wetting of membrane 1206. As discussed in more detail below, separator may be inserted during the folding and joining process of membrane 1206 in forming the enthalpy exchanger. Alternatively, separator may be inserted between membrane layers after the enthalpy exchanger has been formed. In particular, separator may be inserted between adjacent membrane layers after membrane 1206 has been folded but before the select edges of membrane 1206 have been joined together.

Figure 12:
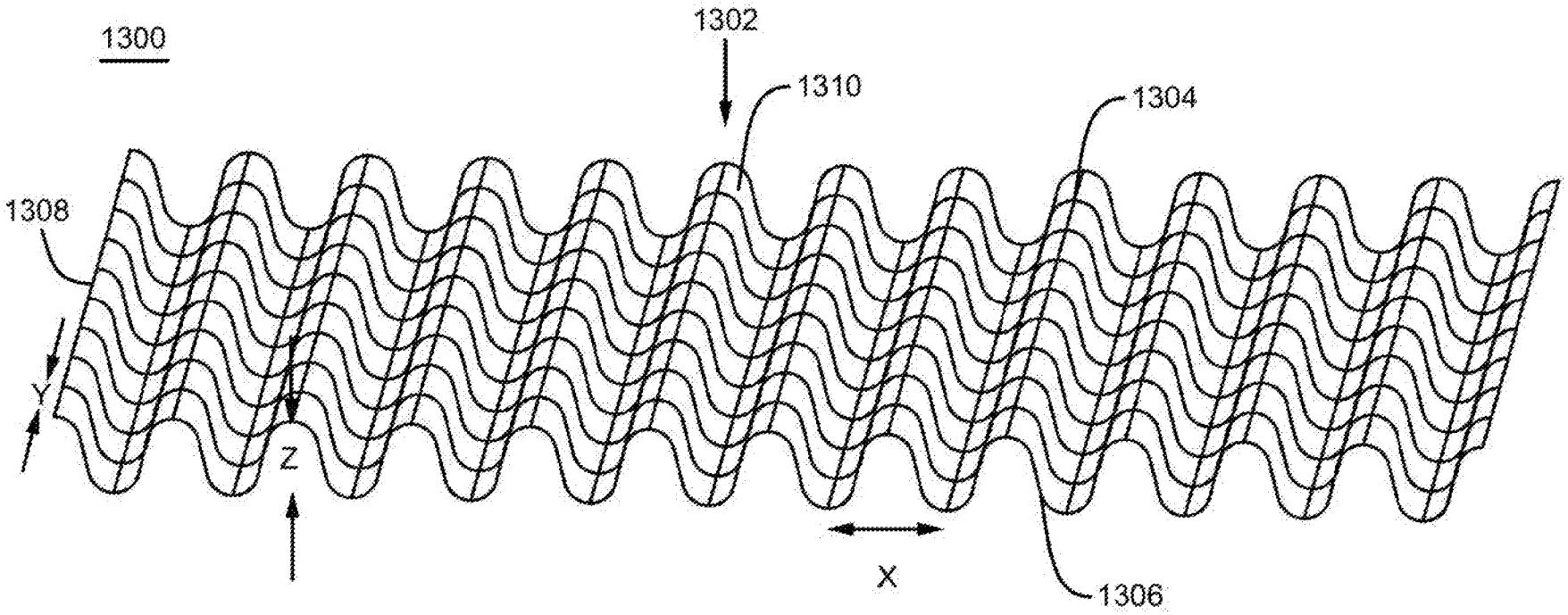
FIG. 12 illustrates a perspective view of one layer of a separator, according to an exemplary disclosed embodiment.
Figure 13A:
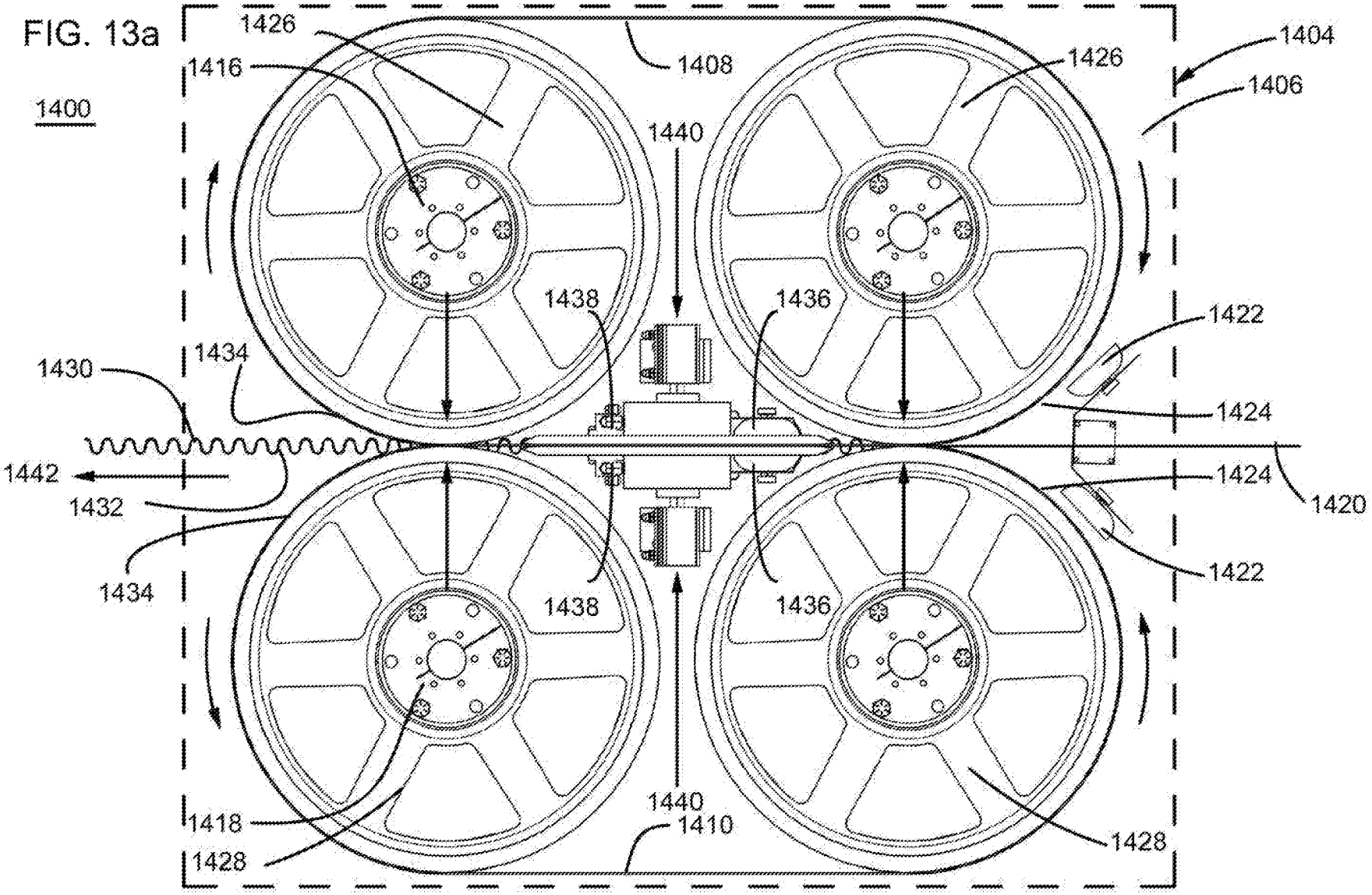
FIGS. 13*a*-13*d* illustrate perspective views of an exemplary process for manufacturing a separator, according to an exemplary disclosed embodiment.
Figure 13B:
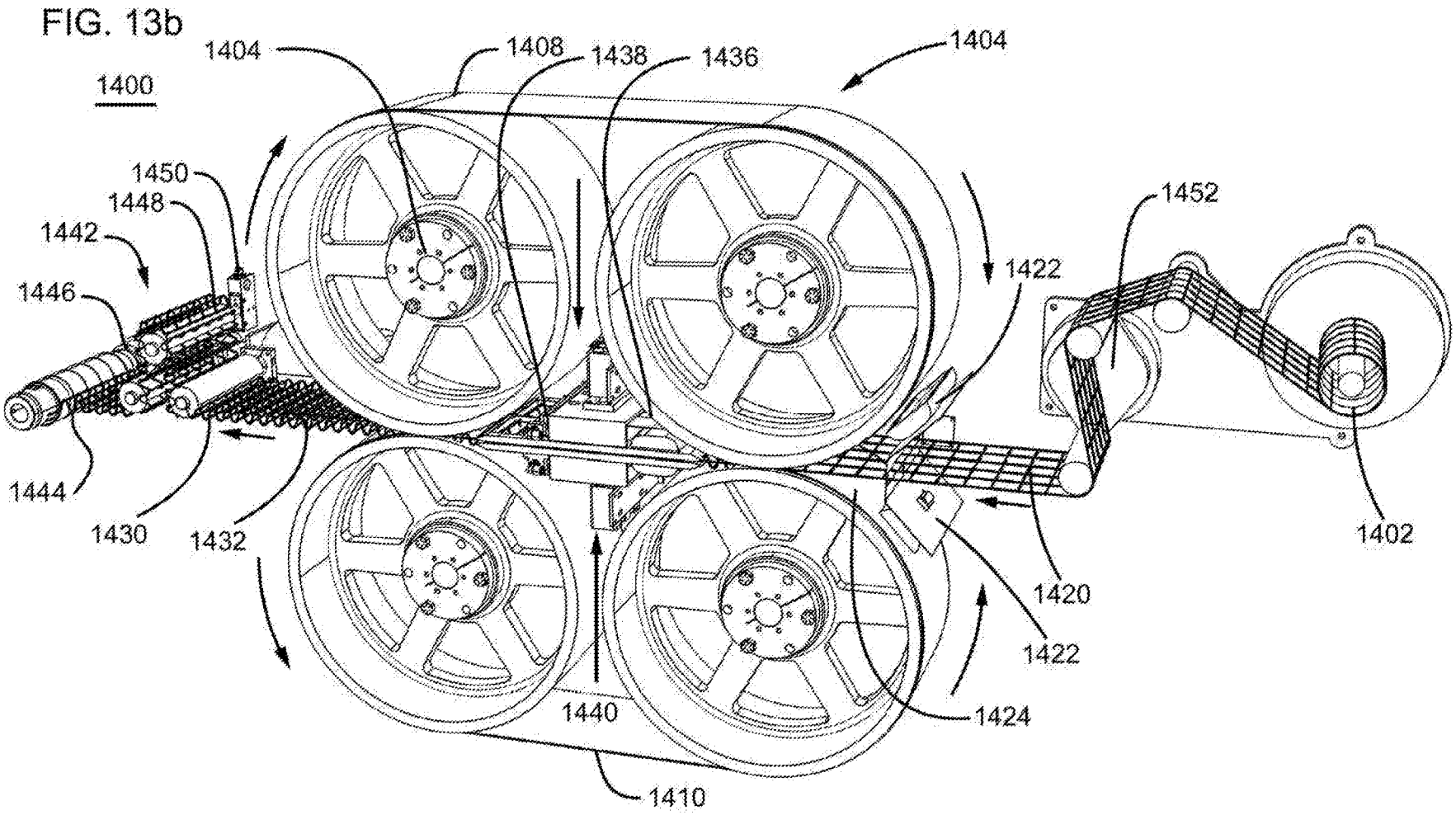
Figure 13C:
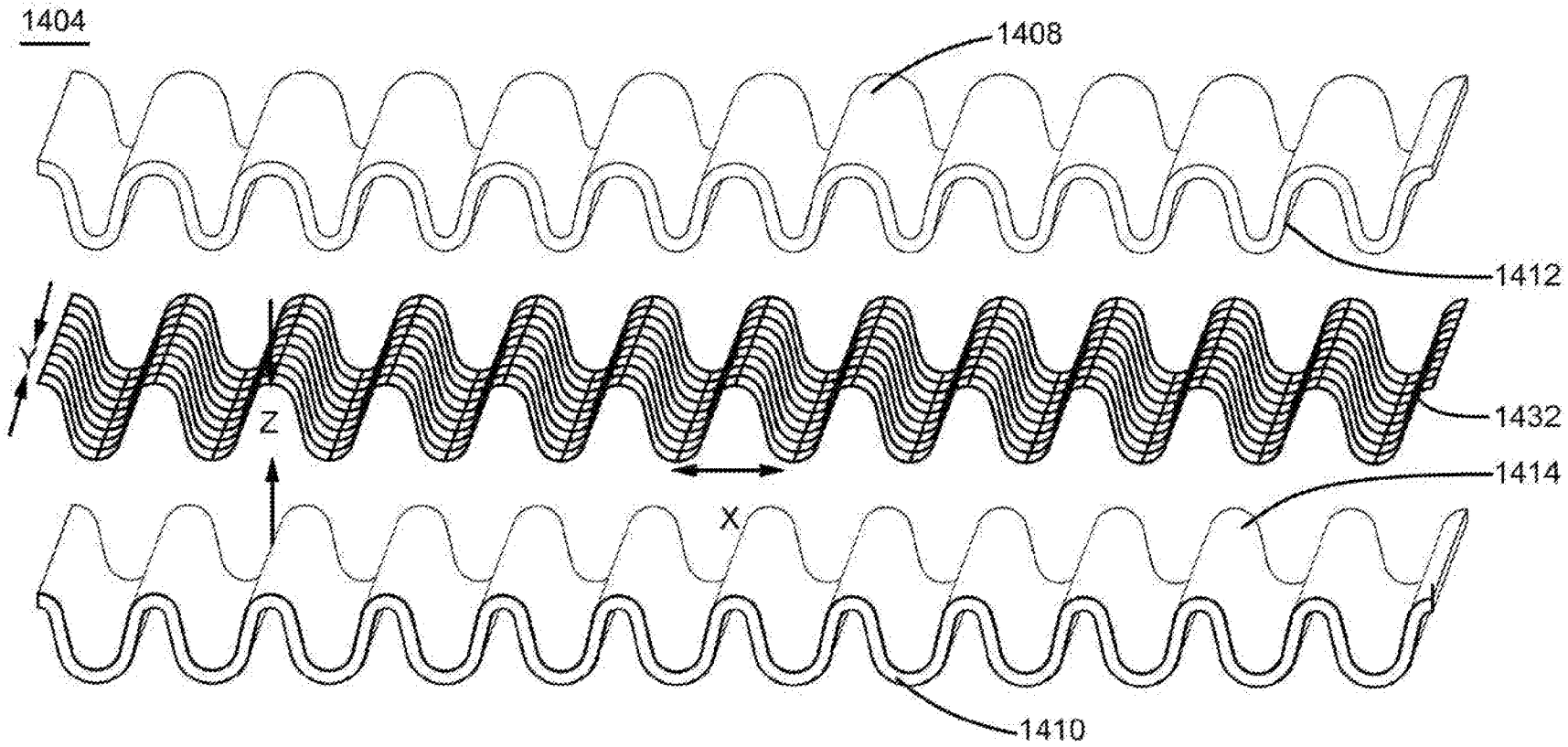
Figure 13D:
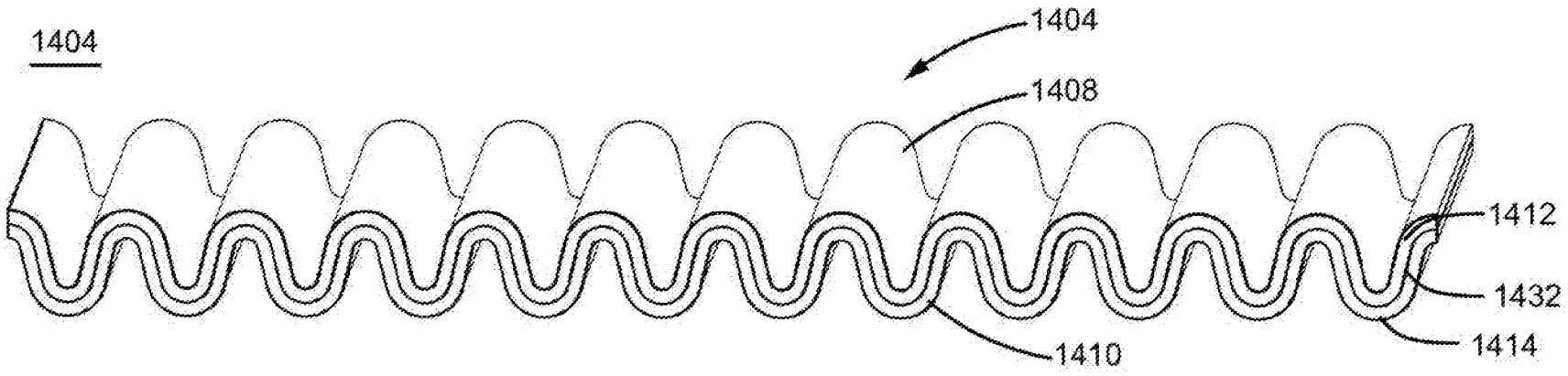

FIG. 12 illustrates a perspective view of one layer 1302 of separator 1300. Separator 1302 may be a corrugated netting 1304 formed of a thermoplastic material, such as, for example, polypropylene or polyethylene. Persons of ordinary skill in the art would appreciate that corrugated netting 1304 may be formed of any other suitable thermoplastic material. Corrugated netting 1304 preferably has a weight of less than 3 lbs/1,000 $ft^2$ and, more preferably, less than 1.5 lbs/1,000 $ft^2$. Utilizing a thermoplastic material to form corrugated netting 1304 may be advantageous because thermoplastic materials may be resistant to most forms of corrosion, which may allow for operation in air streams containing corrosive chemicals. Further, thermoplastic materials may be compatible with most forms of heat and vapor membranes.

Corrugated netting 1304 may include a first plurality of filament members 1306 extending along a first plane (the X-plane) in a sinusoidal pattern. Corrugated netting 1304 may also include a second plurality of filament members 1308 that may extend along a second plane transverse or at an angle to the first plane (the Y-plane) and connect to the first plurality of filament members 1306. The second plurality of filament members 1308 preferably may be substantially straight and connect to the first plurality of filament members 1306 at 90° angles relative to the X-plane. Separator structure 1300 provides appropriate spacing between membrane 1206 layers.

Sinusoidal filament members 1306 may include an amplitude Z. Amplitude Z may define a discrete fluid flow channel within the passageways of the exchanger. In some embodiments, amplitude Z may be 0.8 mm for a type "F" flute at 125 flutes per foot. In other embodiments, amplitude Z may be 1.6 mm for a type of "E" flute at 95 flutes per foot. Additionally, amplitude Z may be 3.2 mm for a type of "B" flute at 49 flutes per foot. Further, amplitude Z may be 4.0 mm for a type of "C" flute at 41 flutes per foot. The size of apertures 1310 of corrugated netting 1304 formed between the filament members 1306, 1308 may be selected depending on the desired vapor transmission, pressure drop, and separator strength.

For example, decreasing the distance between adjacent sinusoidal filament members 1306 and/or the distance between adjacent connector filament members 1308 may reduce the size of the apertures 1310 and increase the structural strength of the separator 1300. The reduced size of the apertures 1310 may, however, restrict a desired vapor transmission across membrane 1206 and may contribute to a higher pressure drop of fluid, such as air, flowing through the passageways of the exchanger. Increasing the distance between adjacent sinusoidal filament members 1306 and/or the distance between adjacent connector filament members 1308 may increase the size of apertures 1310. The increased size of apertures 1310 may accommodate a desired vapor transmission across membrane 1206 and may result in a lower pressure drop of fluid flowing through the passageways of exchanger. The increased size of apertures 1310 may, however, decrease the structural strength of separator 1300.

In a preferred embodiment, Y-axis filament members 1308 may be of similar distance and strength as X-axis filaments 1306. Filament connections may occur at the apex of each curve. Strand thickness may range between 4-20 mil. Separator 1300 may withstand 12 inches of wg pressure differential at 72° F.

Separator 1300 may be used in any appropriate heat and moisture exchanger design. Corrugated netting 1304 of separator 1300 may be produced through an extrusion process. Corrugated netting 1304 of thermoplastic material may be preferably biaxial oriented, which may be lighter in weight and more flexible than extruded square mesh. Orientation "stretches" extruded square mesh in X and Y directions under controlled conditions, which may produce strong, flexible, and light weight netting. Biaxial-oriented corrugated netting 1304 may have improved performance over known heat and water vapor separator materials and techniques.

Apertures 1310 of corrugated netting 1304 may provide more membrane surface area to the air stream, and in some applications, may facilitate faster vapor transfer over separators formed of corrugated sheet materials, such as foils, plastics, or paper. In addition, water vapor within an air stream flowing through a passageway of exchanger separated with corrugated netting 1304 may on average travel a shorter distance to interact with membrane 1206 compared to a passageway with a corrugated sheet separator. Further, biaxial-oriented corrugated netting 1304 may facilitate fluid movement in both the X and Y plane directions. Airflow entering a corrugated sheet separator, however, may travel only in a straight-line path. Bi-directional airflow provided by biaxial-oriented corrugated netting 1304 may allow for a broader range of geometric shapes within the context of heat and moisture exchangers. Corrugated netting 1304 may also utilize less material than corrugated sheet separators, which may achieve both cost reduction and better performance in smoke/fire testing.

An exemplary process for manufacturing separator 1400 according to the present disclosure will now be described with reference to FIGS. 13*a*-13*d*. A roll of thermoplastic netting material 1402 may be continuously delivered to corrugation chamber 1404. Corrugation chamber 1404 may include housing 1406 enclosing first continuous belt 1408 and second continuous belt 1410. First continuous belt 1408 includes first corrugated surface 1412 having corrugation crests and valleys, and second continuous belt 1410 includes second corrugated surface 1414 having corrugation crests and valleys. The corrugation crests of first corrugated surface 1412 may mate with the corrugation valleys of second corrugated surface 1414, and corrugations crests of the second corrugated surface 1414 may mate with the corrugation valleys of first corrugated surface 1412. Corrugation chamber 1404 may further include first drive unit 1416 configured to drive first continuous belt 1408 and second drive unit 1418 configured to drive second continuous belt 1410 in synchronous operation. Each of drive units 1416, 1418 may include one or more pulleys or rollers 1426, 1428 rotatably driven by a suitable power source, such as, for example, a motor. Continuous belts 1408, 1410 may be trained over pulleys 1426, 1428, and pulleys 1426, 1428 and may rotate and drive continuous belts 1408, 1410, mating together first and second corrugated surfaces 1412, 1414.

In some embodiments, rollers 1426, 1428 may be at least 0.5 meters in diameter. Corrugated belts 1408, 1410 may have amplitudes of between 1.5 mm and 6 mm and widths between 250 mm and 1000 mm. Continuous belts 1408, 1410 may first be formed with the sinusoidal profile and then precisely cut to length at the apex of a flute.

Continuous belts 1408, 1410 may be welded end-to-end to form a continuous loop using micro-laser welding techniques. In certain embodiments, the alignment and corrugation intervals may be maintained through the micro-laser weld utilizing fixturing to maintain tolerances while micro-welding. Maintaining an acceptable interval pattern and tolerances may prevent cutting or breaking of the biaxial netting. In other embodiments, welding methods may include WIG, plasma, electron beam or laser welding. Continuous belts 1408, 1410 may be made from a 17-7 or 17-4 stainless steel with a high tolerance to repeated flexural and fatigue resistance. Infeed web tension may be maintained between 5 and 20 pounds per linear foot. Higher web tensions may result in a thinner sinusoidal strand. Residence time between inlet and outlet nips is between 5 and 30 seconds depending on thickness of strands.

As netting material 1420 is fed through first and second continuous belts 1408, 1410 netting material 1420 may be pressed between first and second corrugated surfaces 1412, 1414 of continuous belts 1408, 1410. Heat and pressure from continuous belts 1408, 1410 may corrugate netting material 1420 and form sinusoidal members 1306 of separator 1300. Heat may be applied on portions of continuous belts 1408, 1410 where netting material 1420 enters. For example, a heat source, such as heat lamps 1422, may be positioned proximate an entry portion 1424 of continuous belts 1408, 1410 to heat corrugated surfaces 1412, 1414 as they initially contact and press the sheeting structure 1420. Additionally, or alternatively, pulleys 1426, 1428 proximate the entry portion 1424 of continuous belts 1408, 1410 may be heated, via, for example, heating element within the core of pulleys 1426, 1428, and may transfer heat to corrugated surfaces 1412, 1414 of continuous belts 1408, 1410. In some embodiments, corrugated surfaces 1412, 1414 may be heated to approximately 240° F. to 260° F. for polypropylene and 180° F. to 220° F. for polyethylene.

Persons of ordinary skill would understand that other combinations of time, pressure, temperature, and line speed may also be used to form the netting of the present disclosure. Any such combinations of parameters are appropriate which may enable separator 1430 to be formed into the desired shape and substantially to hold this shape through subsequent processing, assembly, and use.

Corrugated netting material 1432 may be released and collected as material 1432 exits output portion 1434 of continuous belts 1408, 1410. Corrugated netting material 1432 may be cooled proximate output portion 1434 of continuous belts 1408, 1410 to set the corrugations. In some embodiments, cooling source 1438, such as, for example, one or more air knives, may be positioned proximate output portion 1434 of continuous belts 1408, 1410 to cool corrugated netting material 1432. One or more air knives may direct air at the top and bottom surfaces of corrugated netting material 1432 at an ambient temperature or cooler, such as, for example, 80° F. to 120° F. Additionally, or alternatively, pulleys 1426, 1428 proximate output portion 1434 of continuous belts 1408, 1410 may be cooled, via, for example, a cooling element within the core of pulleys 1426, 1428, and may remove heat from the corrugated netting material 1432.

As corrugated netting material 1432 is cooled and released from continuous belts 1408, 1410, corrugated netting material 1432 may be collected by collector 1442. Collector 1442 may include a number of rollers or festoon 1448 that may deliver corrugated netting material 1432 to rewinder 1446 configured to wind corrugated netting material 1432 into roll 1444. Rollers 1448 and rewinder 1446 of collector 1442 may be configured to apply a constant tension on corrugated netting material 1432 as corrugated netting material 1432 is wound into roll 1444. The tension applied on the corrugated netting material 1432 may be approximately less than 0.5 pounds per linear foot. Collector 1442 may apply tension on corrugated netting material 1432 to prevent surface irregularities, such as, for example, crinkles, and to maintain the alignment of the sinusoidal members 1306 along a longitudinal axis of corrugated netting material 1432.

The process for manufacturing separator 1432 according to the present disclosure may provide numerous advantageous and improvements over known processes for manufacturing corrugated netting materials. Known processes may employ corrugated rollers to form a corrugated profile on a material fed between the rollers. These known processes, however, may have limitations associated with the surface area provided by the corrugated rollers for corrugating a netting material. Continuous belts 1408, 1410 of the present disclosure may provide a larger corrugation surface compared to known corrugated rollers. The larger corrugation surface area of continuous belts 1408, 1410 may accommodate a greater output rate of corrugated netting material and may improve the uniformity and alignment of the corrugated profile of the corrugated netting. Continuous belts 1408, 1410 may also accommodate a larger heating surface area for forming the corrugations on the netting material. The larger heating surface area may allow continuous belts 1408, 1410 to heat a greater area of netting material and at a wider range of temperatures.

For example, a higher temperature profile and area may improve the setting of corrugations on netting material, permit a higher amplitude of corrugations, and strengthen corrugations against deformation (i.e., increase the shape memory of the corrugations). Moreover, continuous belts 1408, 1410 may provide a dwell section between the heating portion and the cooling portion that may facilitate setting corrugated netting material. Continuous belts 1408, 1410 may also produce corrugated netting material 1432 with thicker sinusoidal and connection members 1306, 1308 compared to a corrugated netting material 1432 manufactured by known corrugated rollers. The disclosed process may afford a much longer dwell time in which the filaments can be fully heated and then fully cooled before being released, unlike a conventional corrugation roller system. Furthermore, the tension applied to corrugated netting material by collector 1442 may maintain the alignment of sinusoidal members 1306 and may improve the uniformity of corrugated netting material 1432.

Figure 14A:
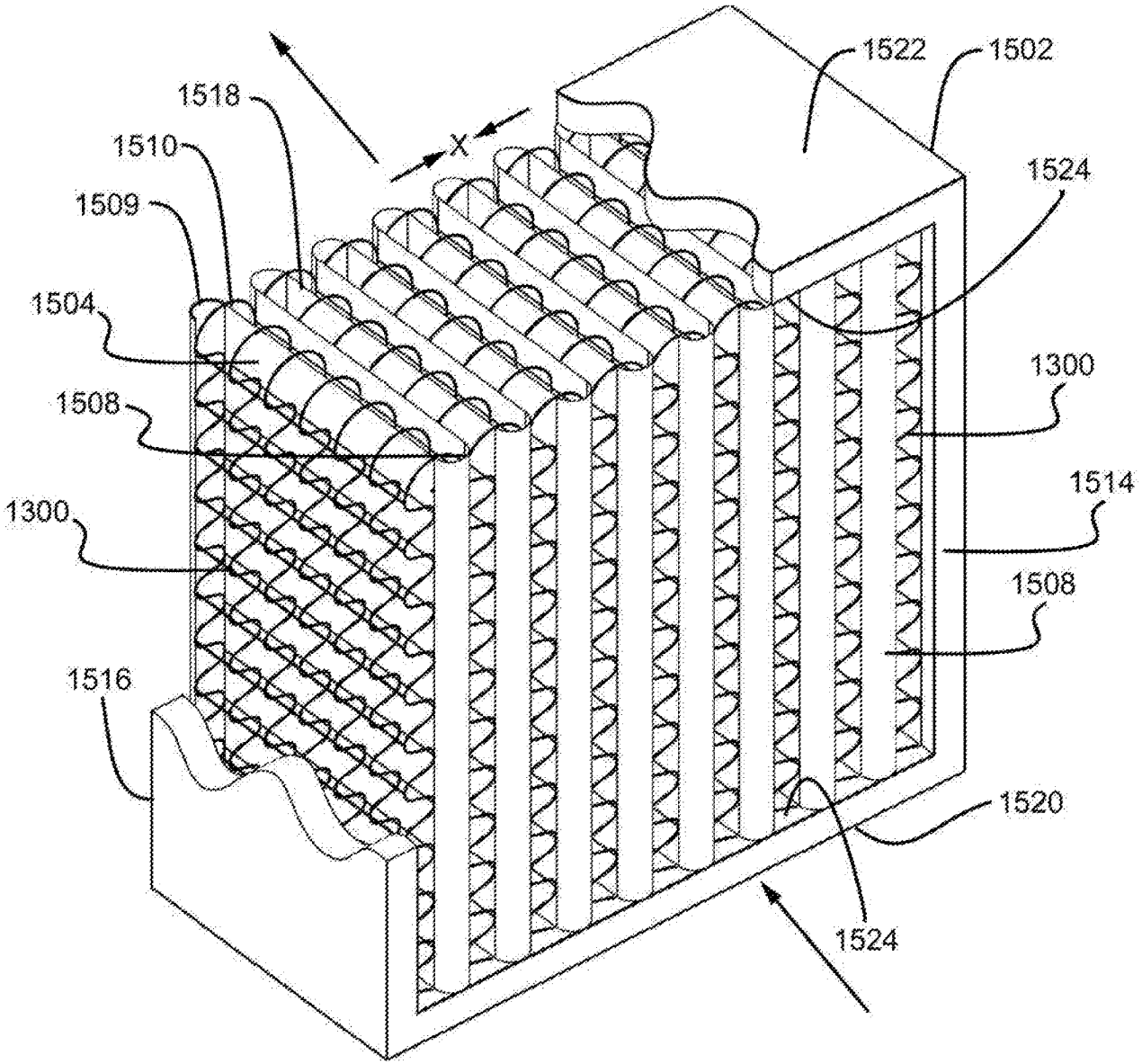
FIGS. 14*a*-14*c* illustrate perspective views of air filters with a separator, according to an exemplary disclosed embodiment.
Figure 14B:
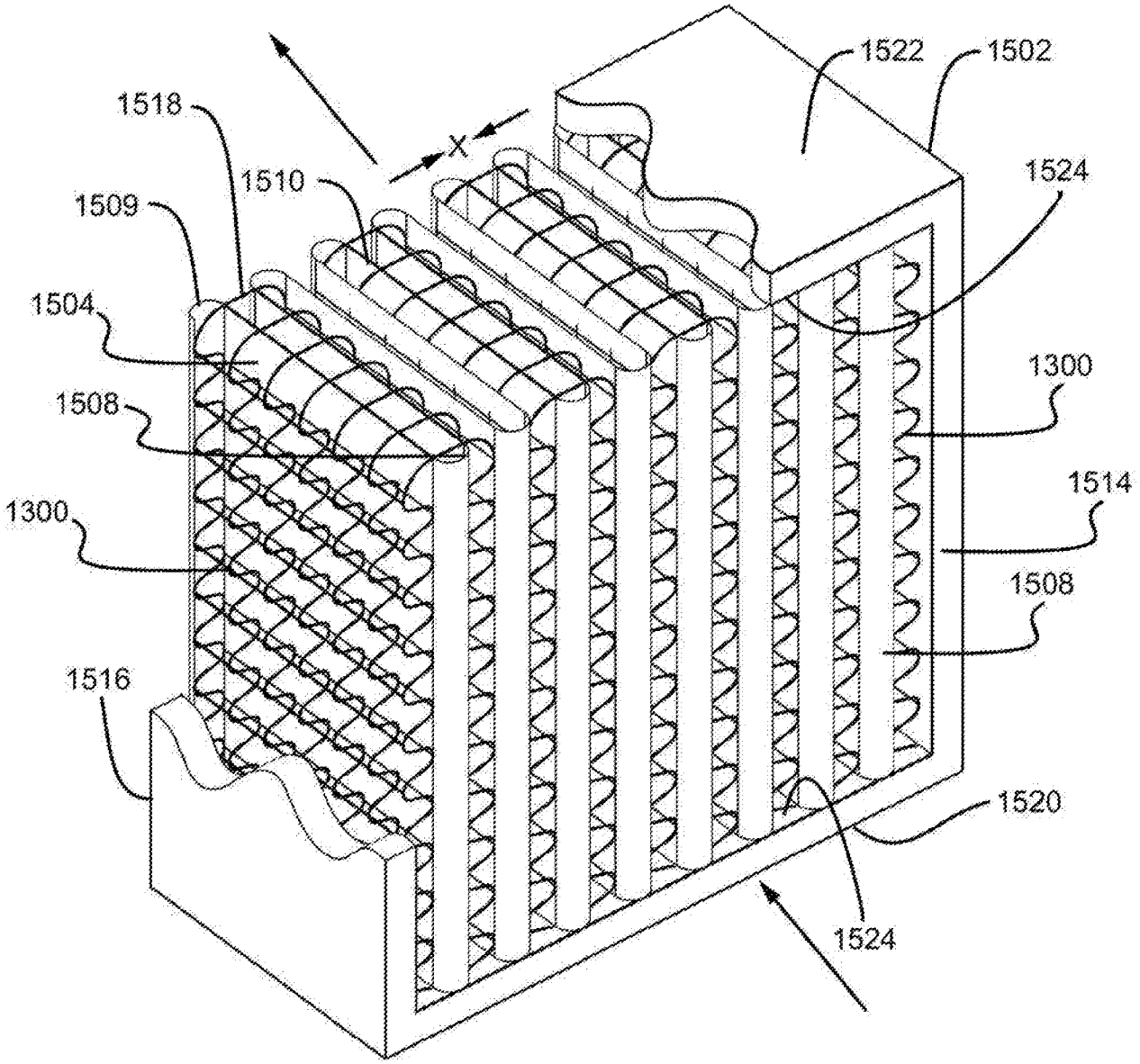
Figure 14C:
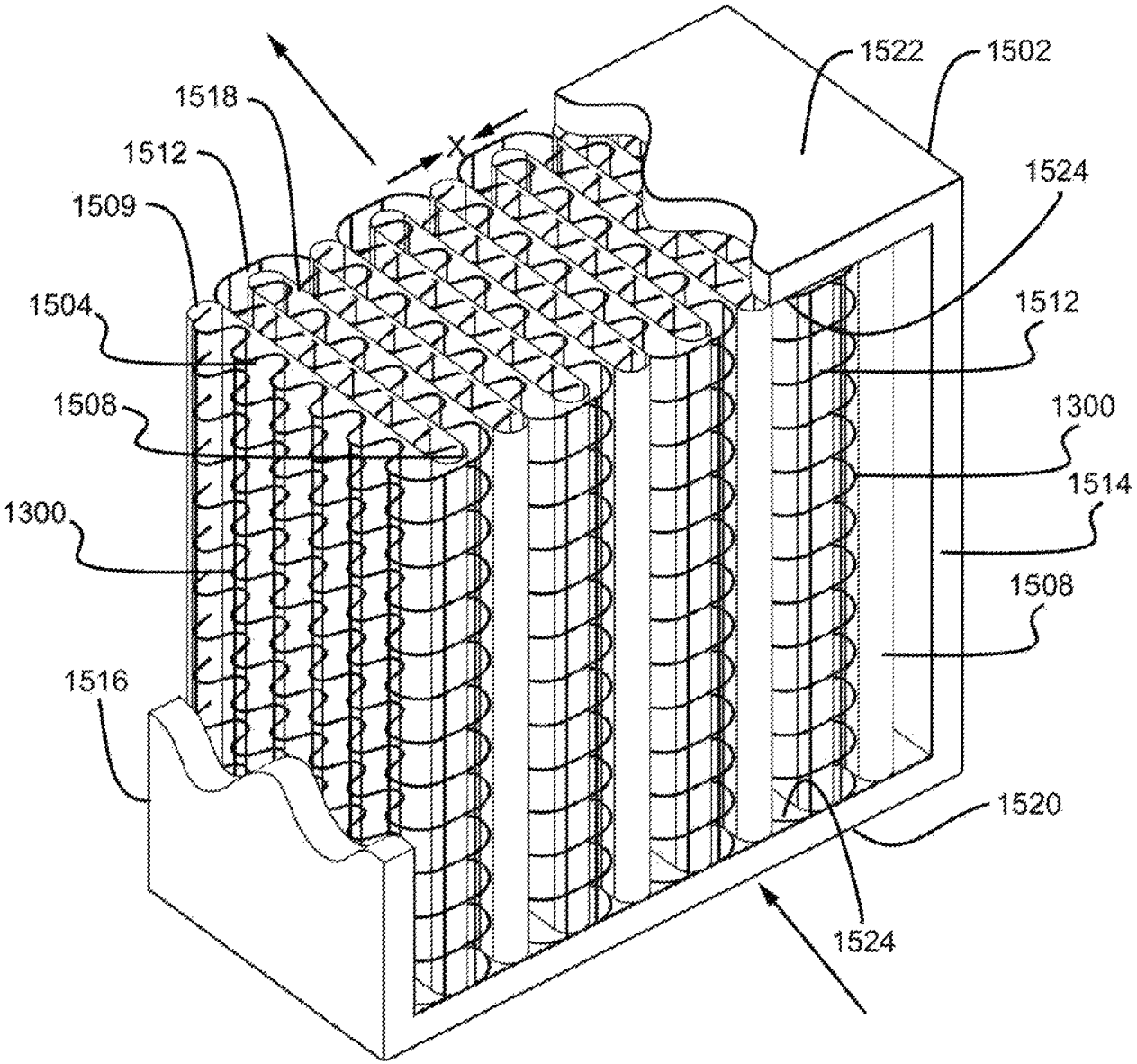

While separator 1432 of the present disclosure has been described in applications as a separation structure for membrane layers of heat and moisture transfer bodies, such as enthalpy exchangers, persons of ordinary skill in the art would appreciate that separator 1432 may be utilized as a separation structure in various other applications. For example, in some applications, the separator 1432 may serve as a separation structure for air filters known in the art. As shown in FIGS. 14*a*-14*c*, air filter 1500 may include filter material 1504, such as, for example, any suitable fibrous material that may remove solid particulates, including, dust, pollen, mold, and bacteria, from the air. In some embodiments, filter material 1504 may include membrane 1206 discussed above. Air filter 1500 may include input side 1514 for receiving air to be filtered and output side 1516 from which filtered air may exit air filter 1500. The filter material 1504 may be folded to form a plurality of pleats 1508. As shown in FIGS. 14*a*-14*c*, air filter 1500 may also include separator 1300 positioned on output side 1516 of air filter 1500 and folded with pleats 1508 of filter material 1504.

Air filters with separator 1300 according to the present may provide numerous advantageous and improvements over known air filters. Existing air filters may employ a plurality of bridge structures that may space out and connect adjacent pleats of the filter material via an adhesive or weld. The bridge structures generally may be positioned on the input side of the air filter. This configuration may restrict air flow through the air filter and reduce the filtering performance of the air filter. Separator 1300 of the present disclosure, may provide improved air flow through the air filter. Corrugated netting material 1304 of separator 1300 may be more open than existing bridge structures, which may accommodate more air flow through the filter material. For example, 97-98% of the surface area of corrugated netting material 1304 may be open and provide unrestricted air flow. Moreover, the sinusoidal and connecting members 1306, 1308 of corrugated netting material 1304 may be thinner than existing bridge structures to further minimize restrictions to air flow. In some embodiments, for example, the sinusoidal and connecting members 1306, 1308 may be approximately 1/16 of an inch thick. Separator 1300 may also be less dense than existing bridging structures and may provide a spacing structure that may be lighter in weight and smaller in size.

The compressible property of separator 1300 may also improve the performance of the air filter. As the input side of the air filter receives air, the pleats of the filter material may fan out or open to increase the capacity of the filter material to filter particulates from the input air. Separator 1300 disposed on the output side of the air filter may receive the load from the pleats opening up on the input side and compress.

As discussed above, an enthalpy exchanger may be formed of membrane 1206 and separator 1300. For example, membrane 1206 and separator 1300 may form enthalpy exchangers as described in U.S. application Ser. No. 13/426,565, which is incorporated herein by reference.

Air Conditioner Modules and Systems

FIGS. 15*a*-15*h* illustrate perspective views of an evaporative cooling and/or steam regenerating liquid desiccant air conditioner module 1600 and its related components according to the present embodiment. The present disclosure may be directed to an air conditioning module and system configured to perform various air treatment operations. Such air treatment operations may include, but are not limited to: (1) changing the moisture and/or heat content of the air being processed; (2) absorbing carbon dioxide ($CO_2$), formaldehyde, and other volatile organic compounds (VOC) from the air being processed; (3) regeneration of weak solutions of the liquid desiccant being processed; (4) regeneration of spent liquid sorbents of the reversibly binding aqueous solution being processed; (5) recovery of moisture and/or heat content between two remote air streams; and (6) changing the heat content of a working liquid using indirect/direct evaporative cooling.

Air conditioner module 1600 may comprise exchanger housing 211 and exchanger 213. The entirety of exchanger 213 may be contained inside exchanger housing 211. Exchanger 213 may be formed of membrane 1206 comprising a thermoplastic sheet embedded with gamma alumina. Exchanger 213 may comprise a plurality of plates 1615 with a plurality of intermittently sealed plate edges 1620 arranged in a successively stacked configuration. Portions of plates 1615 may be spaced apart to provide a first series of discrete alternating passages 1613 and a second series of discrete alternating passages 1614.

A first air stream 1680 may be passed through first series of passages 1613 and a second air stream 1681 may be passed through second series of passages 1614 in a counterflow configuration with respect to first air stream 1680. First and second air streams 1680, 1681 may be maintained physically separate from one another, while maintaining thermal contact between them to allow heat to freely pass therebetween. Air conditioner module 1600 may include first liquid supply conduit 1622 secured in first liquid threaded inlet 1636 and second liquid supply conduit 1624 secured in second threaded inlet 1638. First liquid 1626 and second liquid 1628 may be feed into first liquid supply conduit 1622 and second liquid supply conduit 1624, respectively. First liquid 1626 and second liquid 1628 may pass through to adjoining air conditioner module 1600 via first liquid return conduit 1623 and second liquid return conduit 1625, respectively.

First liquid 1626 may exit air conditioner module 1600 through first liquid threaded outlet 1640, and second liquid 1628 may exit air conditioner module 1600 through second liquid threaded outlet 1642. These return conduits may facilitate a plurality of air conditioning modules being supplied with first liquid 1626 and second liquid 1628 and may be used to flush module 1600 of impurities that may build up. With appropriate modifications such as the, The air conditioner of the present disclosure may be adapted by, for example, selecting first and second air stream and type of delivered liquids, for using the air conditioner in various applications, including, but not limited to, indirect evaporative cooling, direct evaporative cooling, liquid desiccant dehumidification, carbon dioxide scrubbing, VOC scrubbing, hot water liquid desiccant regeneration, indirect steam liquid desiccant regeneration, hot water regeneration of scrubbing reversibly binding aqueous solutions, indirect steam regeneration of scrubbing reversibly binding aqueous solutions, and the like.

Conduits 1622, 1623, 1624, and 1625 may extend through a liquid distribution system comprising a stacked configuration of plates including first distribution headers 1632 and second distribution headers 1634. FIGS. 15*d*-15*h* illustrate perspective views of first and second distribution headers 1632, 1634 and their related components according to the present disclosure. In some embodiments, the distribution headers 1632 and 1634 may be made of silicone, urethane, thermoplastics, vital, Teflon, or other non-corroding sealing material. Headers 1632 and 1634 may include silicone leaves having porous members 1630. First and second distribution headers 1632 and 1634 may be sealed together by compression plates 1645 tied together by compression rods 1644 passing through headers 1632 and 1634.

Figure 15A:
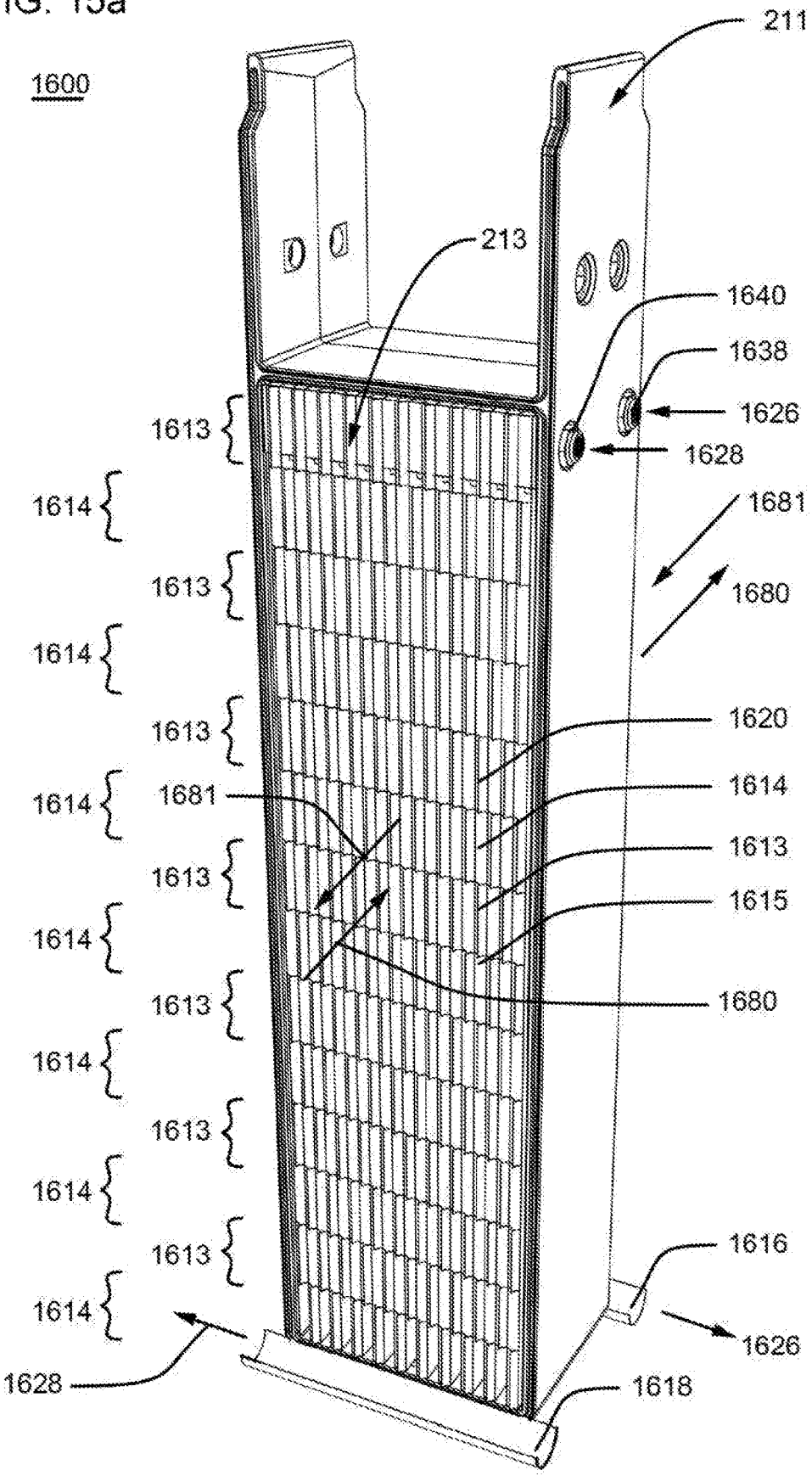
FIGS. 15*a*-15*c* illustrate perspective views of an evaporative cooling and/or steam regenerating liquid desiccant air conditioner module, according to an exemplary disclosed embodiment.
Figure 15B:
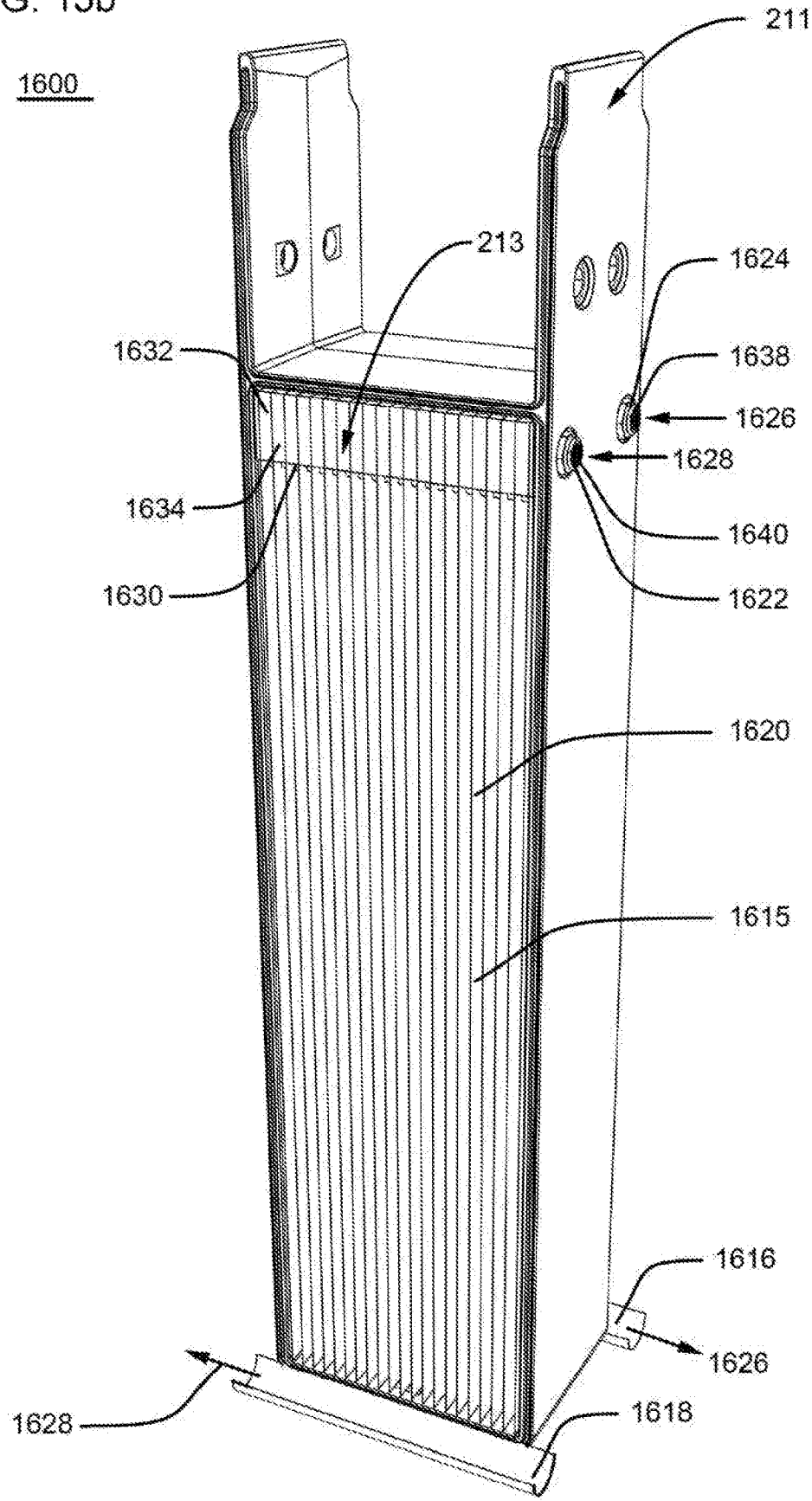
Figure 15C:
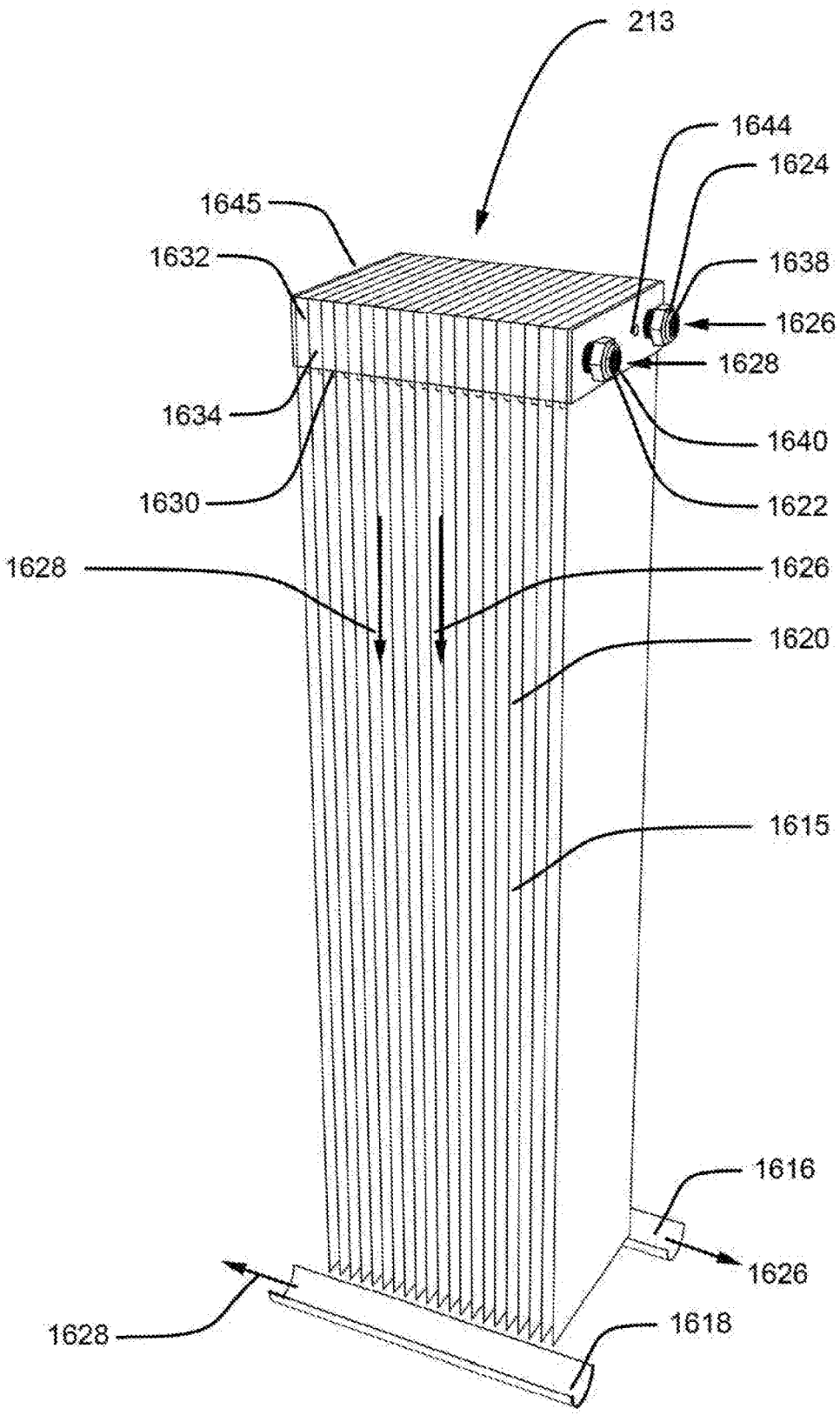
Figure 15D:
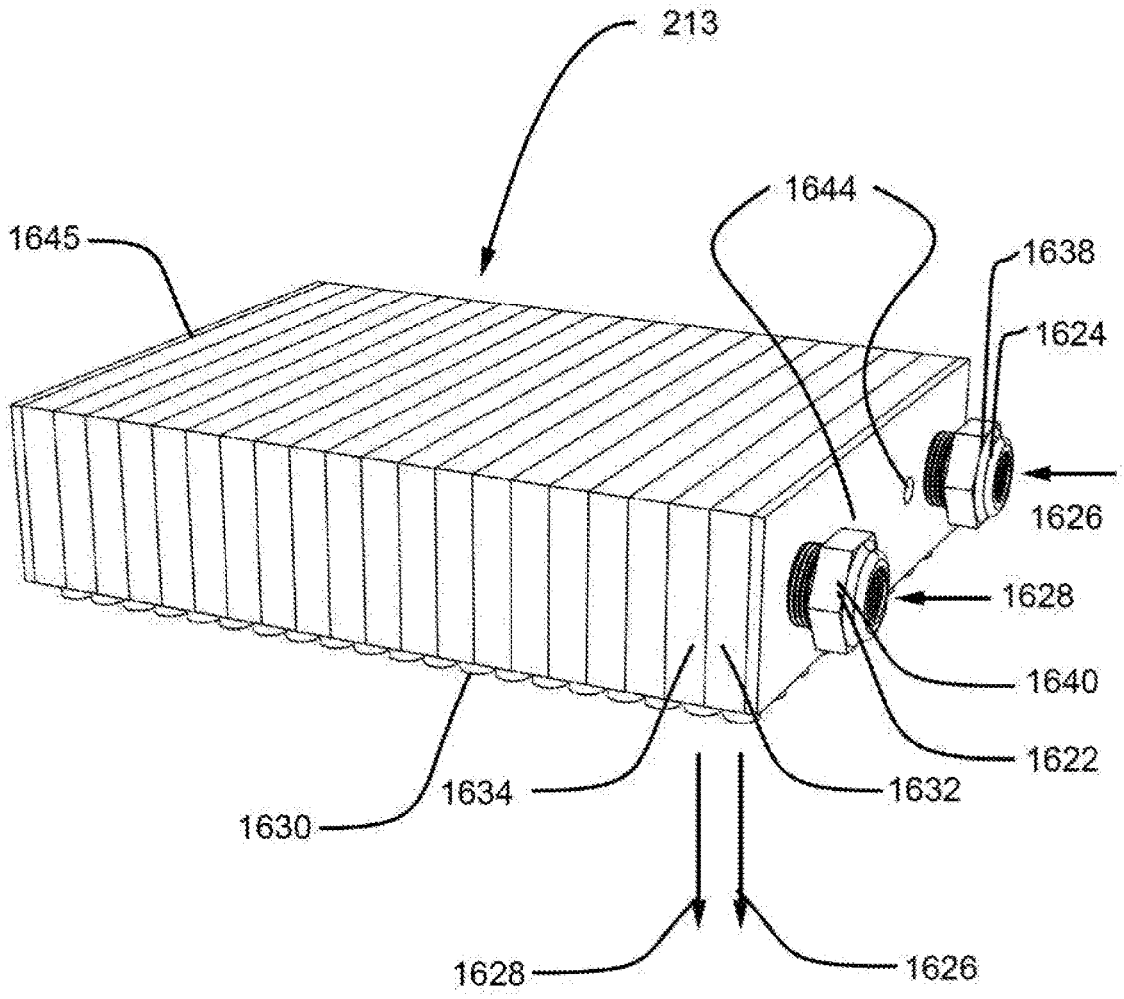
FIGS. 15*d*-15*h* illustrate perspective views of a liquid distribution system including first and second distribution headers and related components, according to an exemplary disclosed embodiment.
Figure 15E:
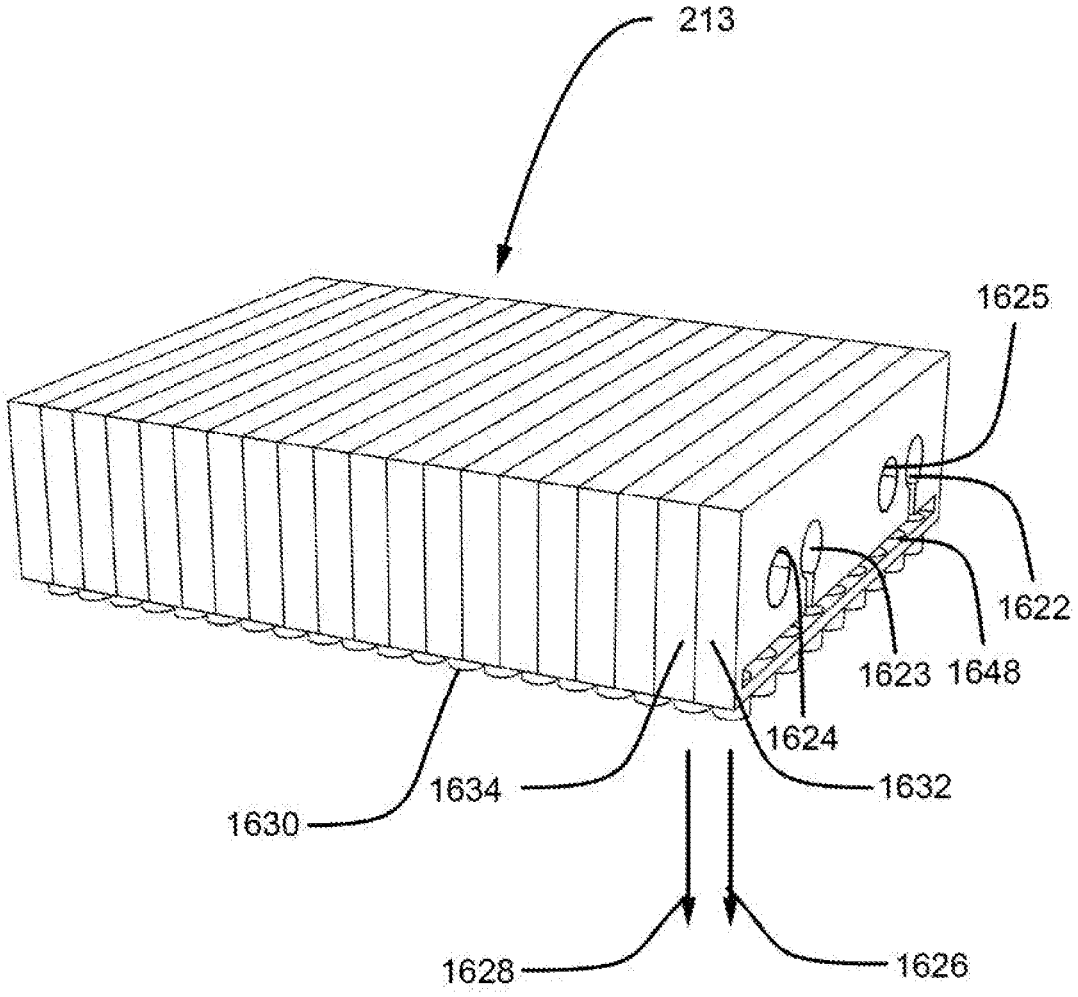
Figure 15F:
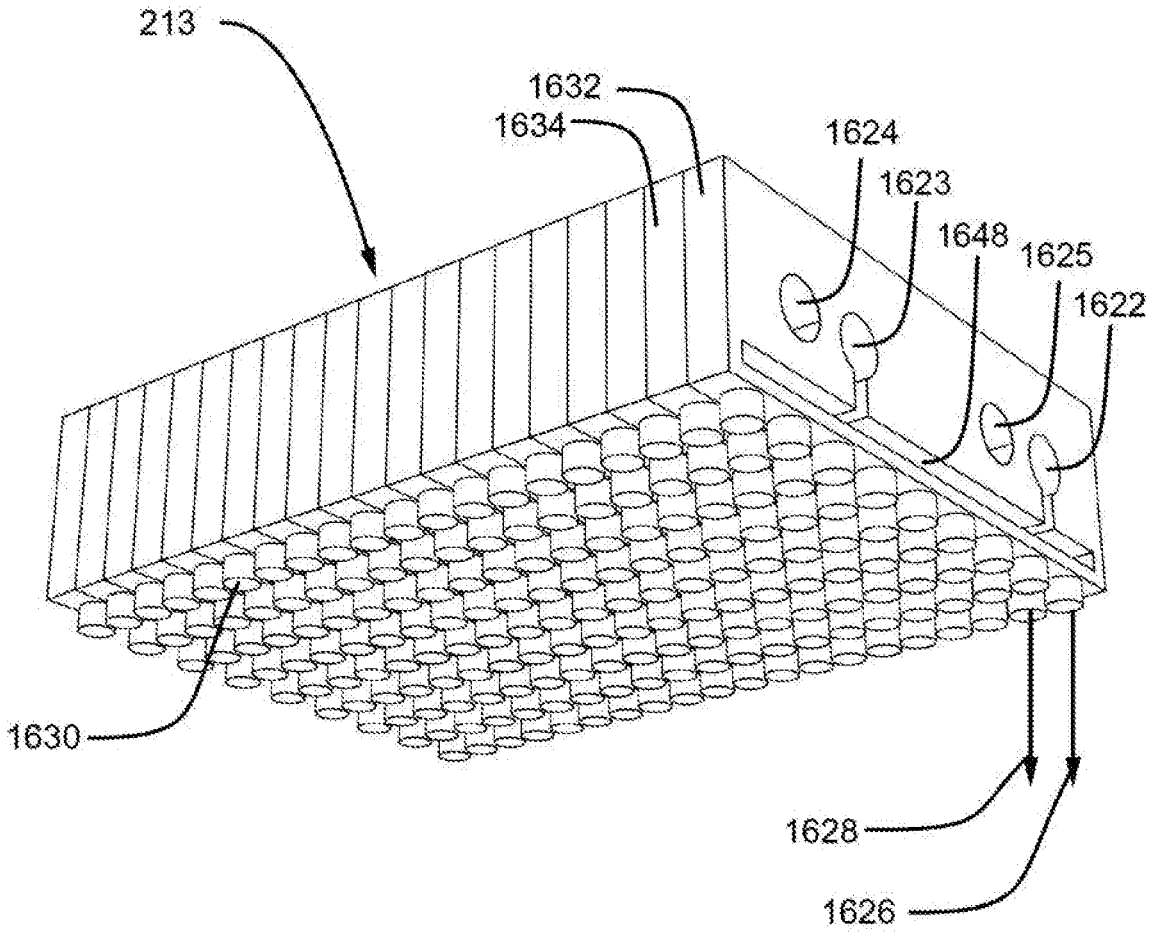
Figure 15G:
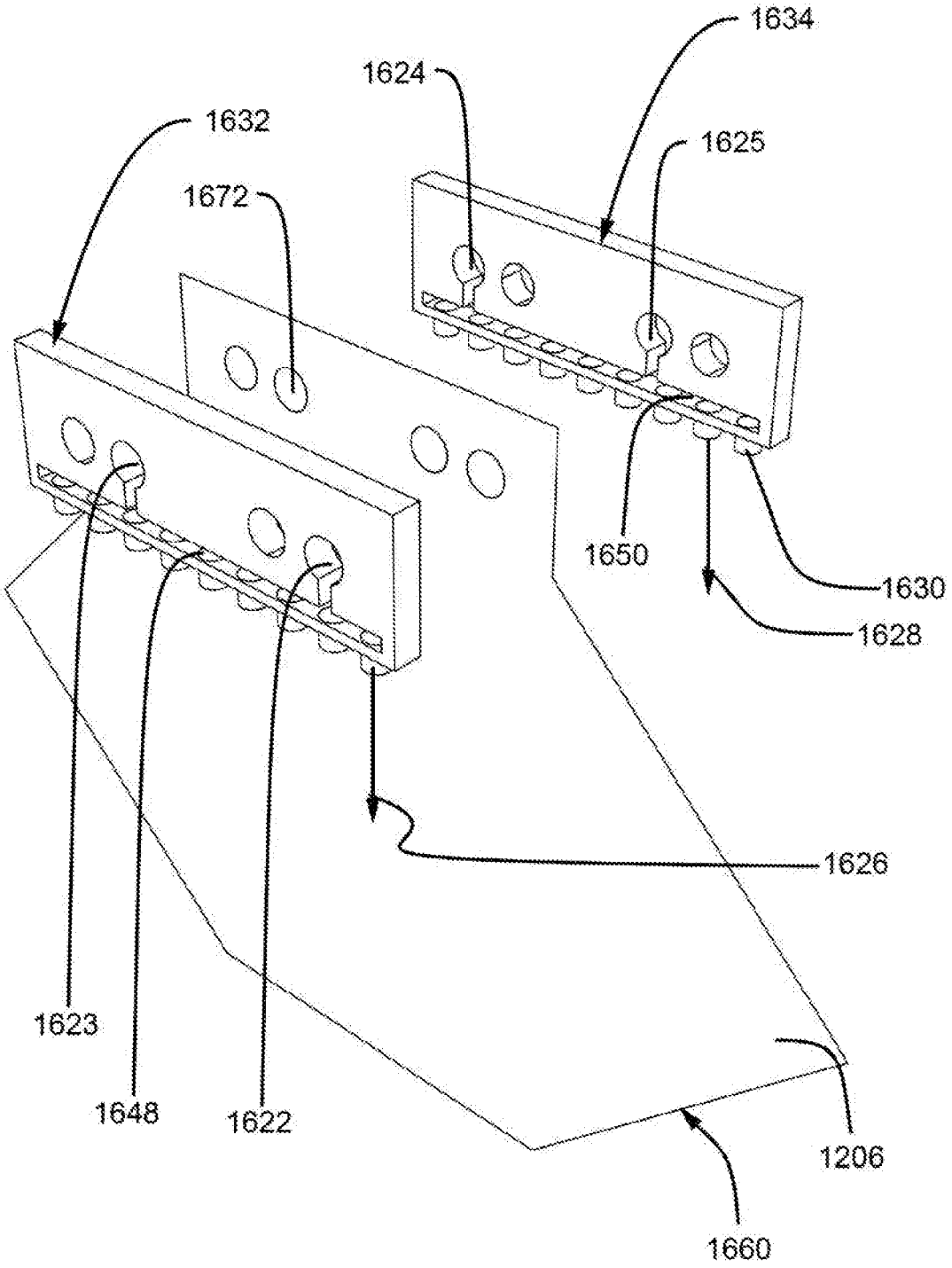

As illustrated in FIG. 15*g*, for example, membrane 1206 of exchanger 213 may be positioned between first distribution headers 1632 and second distribution headers 1634. Membrane 1206 may also include a plurality of membrane conduit holes 1672 aligning with conduits 1622, 1623, 1624, and 1625. First liquid 1626 may be delivered into first distribution headers 1632 and may be discharged through conduit 1622 or 1623 and onto membrane 1206 through membrane conduit holes 1672 aligned with conduit 1622 or 1623. Second liquid 1628 may be delivered into second distribution headers 1634 and may be discharged through conduit 1624 or 1625 and onto membrane 1206 through membrane conduit holes 1672 aligned with conduit 1624 or 1625. A suitable alignment mechanism, for example, a tine, may be coupled to headers 1632 and 1634, membrane conduit holes 1672, and exchanger housing 211 holes 1640 and 1638 to maintain the alignment and registration of the components of the liquid distribution system.

First distribution header 1632 may comprise first liquid feeder channel 1648 and a plurality of feeder holes 1652. Porous members 1630 may be inserted into feeder holes 1652 by, for example, a press-fit. Porous members 1630 may be, for example, porous wicks or pipette-shaped porous inserts for delivering liquids to membrane 1206 of exchanger 213. Porous members 1630 may be in direct contact with the inside membrane surfaces of the first series of fluid passages 1613. Second distribution header 1634 may comprise second liquid feeder channel 1650 and a plurality of feeder holes 1652. Porous members 1630 may also be inserted into feeder holes 1652 of second distribution header 1634. First and second liquids 1626, 1628 may be dispensed directly to membrane surfaces of first and second passages 1613, 1614 via porous members 1630 with the liquids maintaining intimate contact in the transition from feeder holes 1652 to membrane surfaces.

Liquids may be dispersed without creating microdroplets which may become entrained within the air streams. Microdroplet entrainment may occur through unrestrained transition between feeder holes 1652 and membrane surfaces without porous members 1630. Porous members 1630 may provide protection from the aerodynamic forces posed by flowing airstreams at the exit of liquids from feeder holes 1652. These porous members 1630 may be advantageous for strong hygroscopic liquid desiccants and strong carbon dioxide absorbing alkylamine solutions. Strong liquid desiccants may be highly polar by nature, which may make then even more susceptible to entrainment absent porous members 1630 to maintain fluid flow at the transition to the membrane surfaces. Small amounts of alkylamine solutions entrained into an air stream may create an unpleasant amine smell inside building enclosures.

Dispensing liquids via porous members 1630 may be accomplished without spanning or bridging of liquids across the respective airstreams along the inside surfaces of first and second fluid passages 1613, 1614. Spanning or bridging may occur through unrestrained transition between feeder holes 1652 and membrane surfaces absent porous members 1630. Porous members 1630 may provide protection from the aerodynamic forces posed by flowing airstreams. Aerodynamic forces may arbitrarily focus the flow into various concentrated streams upon wetting of membrane surfaces. Absent porous members 1630, aerodynamic forces from flowing airstreams may favor one of the two inside surfaces of fluid passages 1613,1614 causing uneven flow and reducing performance. The strong polarity of many liquids may further exacerbate the spanning and bridging phenomena.

Dispensing liquids via porous members 1630 may also be accomplished, without variance in flow rates, through a plurality of feeder holes 1652. Flow variance may occur through unrestrained transition inside feeder holes 1652 because of variability in entrance/exit effects, diameter, length, or wall friction. Porous members 1630 may deliver liquids to the membrane surface in a uniform manner across a plurality of feeder holes 1652. This uniform resistance may ensure that each feeder hole 1652 has the same volume of liquid flowing through it. Porous members 1630 may reduce distribution header pressure and related pump energy. Distribution headers 1632, 1634 may operate below 1 psi while still affording full control of variable flow rates. Furthermore, precise dispensing of liquids via porous members 1630 may promote uniform wetting characteristics on the inside membrane surfaces of passages 1613, 1614. Distribution headers 1632 and 1634 and porous members 1630 may be fluidly connected to one of the six sides of exchanger 213. Liquid dispensing may be accomplished without blocking or interfering with first or second air streams 1680, 1681.

Porous members 1630 may include inlet 1654 passing through the walls of first distribution header 1632 and into first liquid feeder channel 1648. Porous members 1630 may also include outlet 1656 passing through the walls of first distribution header 1632 and positioned outside first distribution header 1632. First liquid 1626 may enter the pores of porous members 1630 at inlet 1654. First liquid 1626 may pass through the porous members 1630 and exit the pores of porous members 1630 at outlet 1656 in direct contact with the inside membrane surfaces of first passages 1613. Porous members 1630 may provide a continuous flow of first fluid 1626 from first end to second end of the first passages 1613 while the first fluid 1626 is in contact with the first air stream 1680.

Second liquid 1628 may enter the pores of porous members 1630 at inlet 1654. Second liquid 1628 may pass through porous members 1630 and exit the pores of porous members 1630 at outlet 1656 in direct contact with the inside membrane surfaces of second passages 1614. Porous members 1630 may provide a continuous flow of second liquid 1628 from first end to a second end of second passages 1614 while second liquid 1628 is in contact with second air stream 1681.

Porous members 1630 may include any suitable material capable of capillary action, including, for example ceramic, metal, or plastic such as polypropylene or polyethylene. Porous members 1630 may have an average controlled pore size of between 25 and 60 microns, and preferably 30 microns. Porous members 1630 may comprise microporous particles selected from: porous titania; transition alumina; silica gel; molecular sieve; zeolite; activated carbon; porous polypropylene; or porous polyethylene. Porous members 1630 may also include a width substantially equal to the spacing between the plates 1615 to facilitate direct contact and capillary action on the inside walls of plates 1615. The motion of liquid flow may be controlled by the porous link between headers 1632, 1634 and membrane walls 1206, whereby the continuous flow of liquid may avoid the formation of droplets by blowing air currents that may be entrained in passing air streams 1680, 1681.

Headers 1632, 1634 of the present disclosure may provide continuous liquid flow through porous members 1630 by a combination of capillary action, surface tension, adhesion, and little to no additional head pressure beyond given fluid column height and with the porous members 1630 being in intimate contact with the membrane walls 1206. Liquid may pass through porous members 1630 via a tortuous path, which may result in a uniform deposition of flow characteristics regardless of where an individual porous member 1630 is located within the system.

Figure 15H:
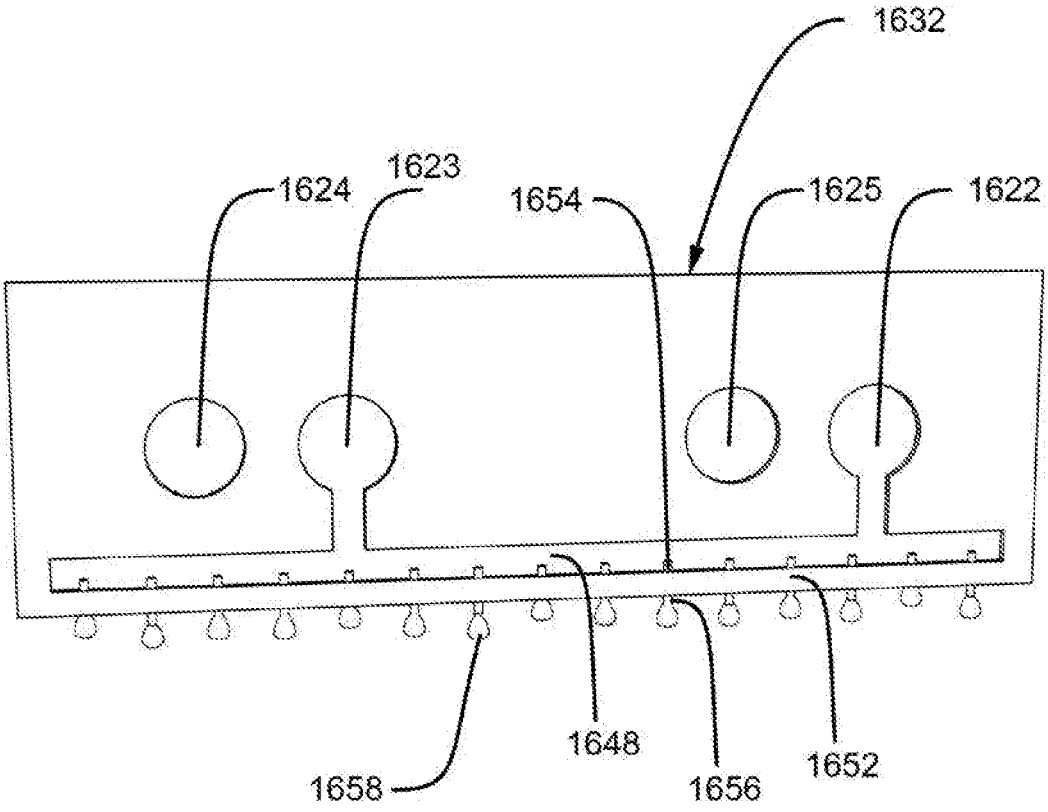

As shown in FIG. 15*h*, headers 1632 and 1634 may be formed of silicone leaves. Porous members 1630 may be pressed into the silicone leaves and may provide controlled delivery of liquid onto membrane walls 1206. The components of first and second distribution headers 1632, 1634 may provide for a low flow of liquids under low pressure. First and second distribution headers 1632, 1634 may deliver continuous flow 1658 of liquid at a time onto the membrane walls 1206 of first and second passages 1613 and 1614, thereby affording an ultra-low flow conditioner. Continuous flow 1658 of liquid may flow down membrane walls 1206 of first and second passages 1613 and 1614 in a direction perpendicular to first and second air streams 1680 and 1681. The headers 1632 and 1634 may be integrated into the exchanger 213 during the folding or layering process of membrane 1206. In one embodiment, for example, header 1632 may be positioned on a layer of membrane 1206 after each folding or layering step of membrane 1206. Headers 1632 and 1634 may be positioned on the layers of membrane 1206 manually or by an automated process, such as, for example, a 3D printing step between folding steps.

Membrane 1206 of exchanger 213 may be formed of a thermoplastic sheet comprising porous material, such as, for example, gamma alumina, disposed along at least a portion of the inside surfaces of the first and/or second series of passages 1613 and 1614. The thermoplastic sheet comprising porous material on both sides may be about 4 to 7 mils thick. The porous material of membrane 1260 may draw up liquid from the porous members 1630 via capillary action and may provide uniform flow of first and second liquids 1626 and 1628 via gravity from first and second distribution headers 1632 and 1634 to first and second ends of plurality of plates 1615. As discussed above, the surfaces of the thermoplastic sheet coated with porous material, such as, for example, gamma alumina, may form membrane 1206 and may be highly wettable because the porous material, like gamma alumina, may facilitate large quantities of liquid to flow within its pore structure and adsorb large quantities of moisture. This may also provide a greater surface area for heat transfer within first and second plurality of passageways 1613 and 1614 and improved cooling of first and second air streams 1680 and 1681. Furthermore, wettable membrane 1206 and the delivery of liquid provided by alternating first and second header array 1632 and 1634 may promote hugging of the liquid to membrane walls and inhibit entrainment of undesired liquids into airstreams 1680 and 1681.

Air conditioner module 1600 may also comprise a liquid collection system for collecting first liquid 1626 and second liquid 1628 flowing out of the plurality of first passages 1613 and plurality of second passages 1614. The liquid collection system may include first liquid drain conduit 1616 for collecting the flowing first liquid 1626 from first passages 1613 and second liquid drain conduit 1618 for collecting the flowing second liquid 1628 from second passages 1614.

First and second liquid drain conduits 1616, 1618 may be located entirely outside of the exchanger 213 and may be adjacent to the second ends of the plurality of plates 1615. By being wholly outside the exchanger 213, first and second liquid drain conduits 1616, 1618 may facilitate lower manufacturing costs and a compact form factor and may be readily and efficiently inspectable. External liquid drain conduits 1616, 1618 may be optimized (e.g., by size and/or number) given the desired number of air conditioner modules 1600 implemented and the anticipated fluid flows corresponding to given building design conditions. The reservoir-less design may also reduce costs and weight, may require less sealing, and may reduce potential mold growth.

Although not depicted, a suitable system may be coupled to exchanger 213 to collect, treat, and recycle the cooling medium and liquid desiccant delivered through exchanger 213. For example, water or water vapor from first passageways 1612 may be collected and recycled through suitable outlet ducts. In some embodiments, the collected water may be further cooled via a refrigerant or the like before being delivered to exchanger 213. In addition, the cool weak liquid desiccant from second plurality of passageways 1614 may be collected and passed through suitable outlet ducts to regenerator, such as, for example, a boiler. Strong liquid desiccant from regenerator may then be recycled back to exchanger 213. In some embodiments, exchanger 213 may be used as the regenerator, rather than a conventional boiler.

Exchanger 213 may comprise at least one separator 1300 disposed on each of the inside surfaces of first and second passages 1613 and 1614 for maintaining the space therebetween. Separator 1300 may be formed of a high temperature thermoplastic able to withstand high temperatures (e.g., between 212° F. and 300° F.) in applications where the exchanger 213 is used in a steam regenerating liquid desiccant module. In some embodiments, separator 1300 height may be 0.062 inches to ensure no bridging of fluids and optimize heat transfer. First and second distribution headers 1632 and 1634 may deliver an interchangeable plurality of first and second liquids 1626 and 1628, such as, for example, strong liquid desiccant, weak liquid desiccant, directly evaporating water, indirectly evaporating water, hot water, cooling tower water, steam condensate, antimicrobial cleaner, or combinations thereof. Delivered liquids may also include those that absorb or adsorb certain air contaminants, such as, for example, carbon dioxide scavengers, formalydyde absorbers, materials that absorb other contaminants, and combinations thereof.

Air conditioner module 1600 may provide an interchangeable plurality of air conditioning effects to first and second air streams 1680 and 1681. The air streams may be conditioned by air conditioner module 1600 to provide, for example: (1) dehumidified or humidified process air; (2) sensibly cooled or heated process air; (3) indirectly and/or directly evaporatively cooled process air; (4) indirectly and/or directly evaporatively cooled working liquid using outside air; (5) remote heat and/or moisture recovery between exhaust air and outside air; (6) steam and/or hot water regeneration of a weak desiccant; and (7) direct and/or indirect fired air regeneration of a weak desiccant.

In some embodiments, exchanger 213 may be utilized in evaporative liquid desiccant air conditioning applications. For example, exchanger 213 may be used in air handling modules described in FIG. 8*a* and air conditioner module described in the FIG. 15*a*-15*h*. In such applications, exchanger 213 may be used in the modules that may provide an evaporative cooling and steam heating air conditioner.

Membrane 1206 of the exchanger 213 may be formed of a thermoplastic sheet embedded with gamma alumina. First air stream 1680 may pass through first plurality of passageways 1613 of exchanger 213. First air stream 1680 may be, for example, outside air, and may undergo direct evaporative cooling within first plurality of passageways 1613. To that end, a cooling medium, such as, for example, water, may flow on membrane walls defining first plurality of passageways 1613. The cooling medium may cool outside air 1680. The outside air 1680 may evaporate the cooling medium and may be released from the first plurality of passageways 1613 as cool moist air.

Second air stream 1681 may pass through second plurality of passageways 1614 of exchanger 213. Second air stream 1681 may be supply air and may be dehumidified as it passes through second plurality of passageways 1614.

In some embodiments, fresh supply air stream 1681 may be super dry air exiting the second plurality of passageways 1614 and may be directed through a direct evaporation device to bring it to supply conditions using vapor compression-based cooling of 55° F. and 100% humidity. In other embodiments, supply air stream 1681 may be cooled, moist air exiting first plurality of passageways 1613 and redirected through second plurality of passageways 1614. In further embodiments, supply air stream 1681 may be a separate stream of air, such as, for example, recirculated air from the system, such as from a building. In such embodiments, cool moist air from first plurality of passageways 1613 may indirectly cool the recirculation supply air stream 1681, whereby cool moist air may remove heat from recirculation supply air stream 1681 through membrane walls 1206. To remove moisture from supply air stream 1681, liquid desiccant, such as, for example, lithium chloride, may flow onto membrane walls 1206 defining second plurality of passageways 1614. Lithium chloride flowing wholly within the porosity of the gamma alumina embedded in membrane 1206, may dehumidify the supply air stream 1681 by adsorbing moisture from supply air stream 1681.

As discussed above and described in FIGS. 15*d*-15*h*, exchanger 213 may also include first and second liquid distribution headers 1632 and 1634 configured to deliver cooling medium and liquid desiccant onto internal membrane walls 1206 forming first and second plurality of passageways 1613, 1614 of exchanger 213. First liquid distribution headers 1632 may deliver cooling medium, such as, for example, water, along first plurality of passageways 1613. Porous members 1630 may deliver a continuous flow of water onto internal membrane walls 1206 forming first plurality of passageways 1613, and the water may flow down membrane walls 1206 in a direction perpendicular to outside air flow 1680.

Second liquid distribution headers 1634 may deliver liquid desiccant, such as, for example, lithium chloride, along second plurality of passageways 1614. Porous members 1630 may deliver a continuous flow of lithium chloride onto the internal membrane walls 1206 forming second plurality of passageways 1614, and the lithium chloride may flow down membrane walls 1206 in a direction perpendicular to supply air flow 1681. In some embodiments, flow of water delivered by the headers 1632 may be 1/16 of an inch, and flow of lithium chloride delivered by headers 1634 may be 1/16 of an inch.

Air conditioner module 1600 with exchanger 213 and first and second liquid distribution headers 1632, 1634 may also be configured to provide indirect evaporative cooling. In such a configuration, a liquid cooling medium, such as water, may be delivered onto internal membrane walls 1206 of both first and second plurality of passageways 1612, 1614. As a result, supply air stream 1681 may be cooled but relatively humid.

In some embodiments, air conditioner module 1600 may function as a highly-efficient liquid desiccant regenerator. First liquid 1626 delivered to air conditioner module 1600 may be a weak liquid desiccant, such as, for example, lithium chloride. The lithium chloride may contact first air stream 1680, which may be atmospheric air. Second air stream 1681 may be directly heated and physically separate from first air stream, while maintaining thermal contact to allow heat to freely pass therebetween and directly warm the lithium chloride through membrane walls 1206. Heating the lithium chloride may drive off part of the water vapor previously absorbed in the evaporatively cooled module, thus regenerating it. The regenerated liquid desiccant may be returned to conditioner module 1600 to again remove moisture. Water vapor may be discharged from the regenerator module 1600 to the atmosphere.

Regenerator module 1600 may implement one or more sources of energy to heat second air stream 1681. In one embodiment, steam from a boiler may be applied directly to second air stream 1681 in a closed loop to provide uniform heat (e.g., 212° F.) across membrane walls 1206. Steam condensate forming and flowing down the membrane walls may be collected and reheated. Steam may provide a uniform thermal heating across the entire membrane surface, thereby creating ideal regeneration conditions for driving water molecules out of the lithium chloride.

In another embodiment, hot water between 160° F. and 210° F., may be employed within regenerator module 1600 to regenerate lithium chloride. Hot water may be distributed via second distribution header 1634 directly warming the lithium chloride through membrane walls 1206. In some embodiments, hot water may be used in conjunction with steam heat depending upon the available energy available at a given time period. In other embodiments, second air stream is heated via direct fire combustion to between 200° F. and 300° F., thereby regenerating the lithium chloride.

The previously described desiccant regenerator module 1600 may present a substantial surface area flowing with weak lithium chloride to the rejecting atmospheric air stream. This large surface area serves to lower required thermal temperatures and reduce energy use compared to existing regeneration boilers. Furthermore, exchanger 213 comprises the same materials and components and, therefore, allows the regenerator module 1600 to change modes of operation and provide a different function for the building altogether (e.g., during a different season).

In a preferred embodiment of an air handling system, a further air handling module comprised of a sensible air-to-air plate exchanger (not depicted) may preheat the first air stream to further enhance the rejection of water molecules out of the liquid desiccant and may also pass back through the said sensible air-to-air plate exchanger. This embodiment advantageously reduces the amount of thermal energy lost to the atmosphere from first air stream 1680.

Although not depicted, a suitable system may be coupled to exchanger 213 to collect, treat, and recycle the cooling medium and liquid desiccant delivered through exchanger 213. For example, water or water vapor from first passageways 1613 may be collected and recycled through suitable threaded ports. In some embodiments, the collected water may be further cooled via a refrigerant or the like before being delivered to exchanger 213. In addition, the cool weak liquid desiccant from second plurality of passageways 1614 may be collected and passed through suitable threaded ports to a regenerator, such as, for example, a boiler. The strong liquid desiccant from the regenerator may then be recycled back to the exchanger.

Multiple functions and multiple modes may be alternated between, depending on the driving requirements of the conditioned building space. Exchanger 213 with alternating header arrays 1632 and 1634 and supply system may be instantly configured to provide indirect evaporative cooling. In such a configuration, a liquid cooling medium, such as water, may be delivered onto membrane walls of both first and second plurality of passageways 1613 and 1614.

Evaporative liquid desiccant air conditioner modules 1600 may be adjacently stacked in a vertical orientation to form an evaporative liquid desiccant air conditioner system. With reference to FIG. 8*a*, for example, each module 812*a*, 812*b*, and 812*c* may air conditioner modules 1600 may contain the components of air conditioner module 1600 described in FIGS. 15*a*-15*h*.

Figure 15I:
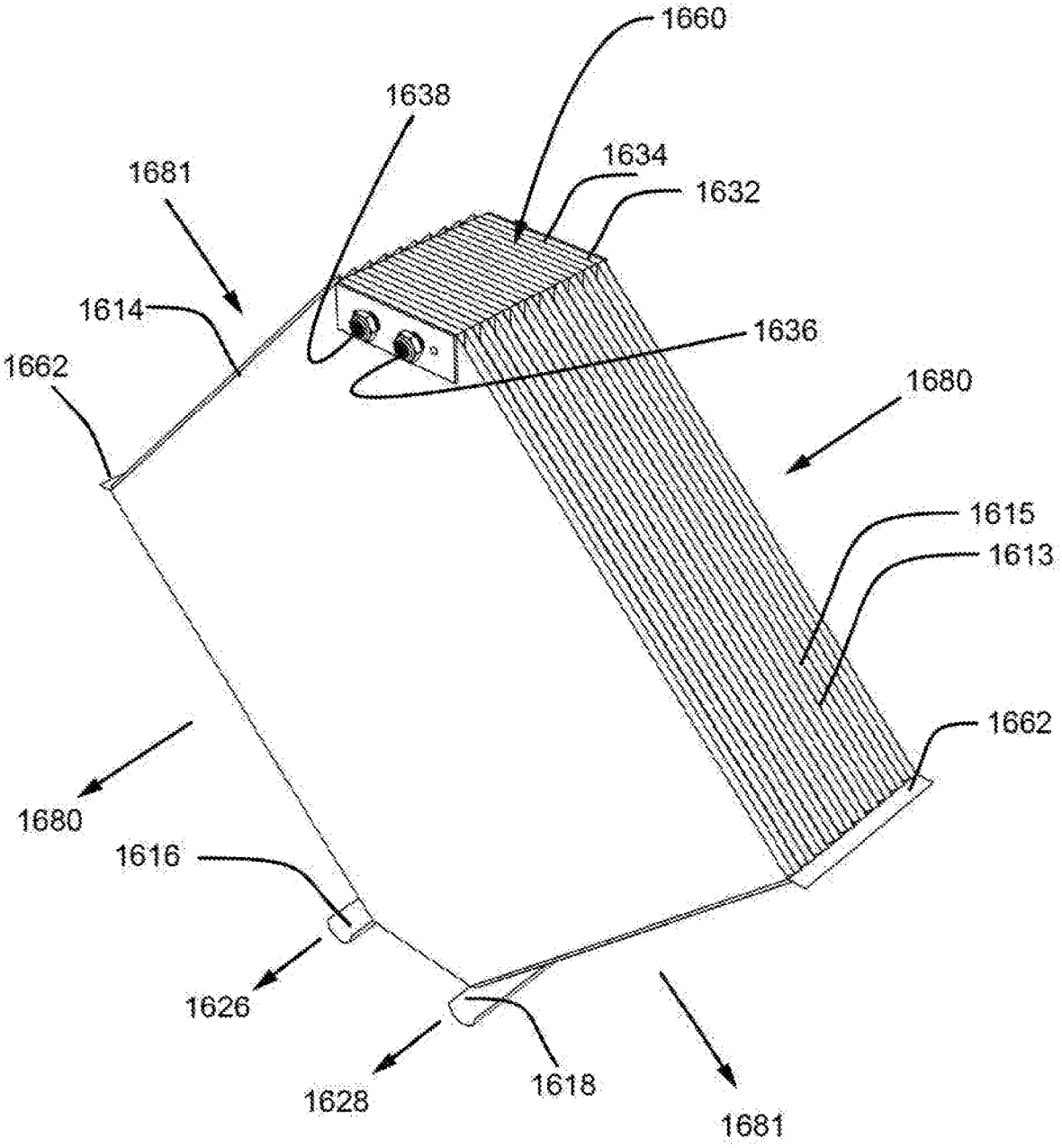
FIGS. 15*i* and 15*j* illustrate perspective views of exemplary configurations of an evaporative liquid desiccant hex shaped exchange module, according to an exemplary disclosed embodiment.

FIG. 15*i* illustrates a perspective view of an evaporative liquid desiccant hex shaped exchange module 1660 according to the present disclosure. Exchange module 1660 may accommodate airflows in a counterflow configuration. Exchange module 1660 may comprise a plurality of plates 1615 having a plurality of intermittently sealed plate edges 1620 and arranged in a successively stacked configuration. Portions of plates 1615 may be spaced apart to provide first series of discrete alternating passages 1613 and second series of discrete alternating passages 1614. A first air stream 1680 may be passed through first series of passages 1613 and a second air stream 1681 may be passed through second series of passages 1614 in a counterflow configuration with respect to the first air stream 1680. Exchange module 1660 may include an air stream divider 1662 to separate the first and second air streams 1680, 1681.

Exchange module 1660 may include first liquid supply conduit 1622 secured in first liquid threaded inlet 1636 and second liquid supply conduit 1624 secured in second threaded inlet 1638. First liquid 1626 and second liquid 1628 may be fed into first liquid supply conduit 1622 and second liquid supply conduit 1624, respectively. First liquid distribution headers 1632 may deliver first liquid 1626 from first liquid supply conduit 1622 to first series of passages 1613. Second liquid distribution headers 1634 may deliver second liquid 1628 from second liquid supply conduit 1624 to second series of passages 1614. First and second liquid distribution headers 1632, 1634 may be positioned within first and second passages 1613, 1614 of plates 1615. Positioning first and second liquid distribution headers 1632, 1634 within first and second passages 1613, 1614 may provide a compact shape and may maintain a hexagonal shape compatible with applications utilizing existing hex counterflow plate-type exchangers.

Exchange module 1660 may also include a liquid collection system for collecting first liquid 1626 and second liquid 1628 flowing out of the plurality of first passages 1613 and plurality of second passages 1614. The liquid collection system may include first liquid drain conduit 1616 for collecting flowing first liquid 1626 from first passages 1613 and second liquid drain conduit 1618 for collecting flowing second liquid 1628 from second passages 1614. First and second liquid drain conduits 1616, 1618 may be located entirely outside of exchanger 213 and may be adjacent to the second ends of the plurality of plates 1615.

Figure 15J:
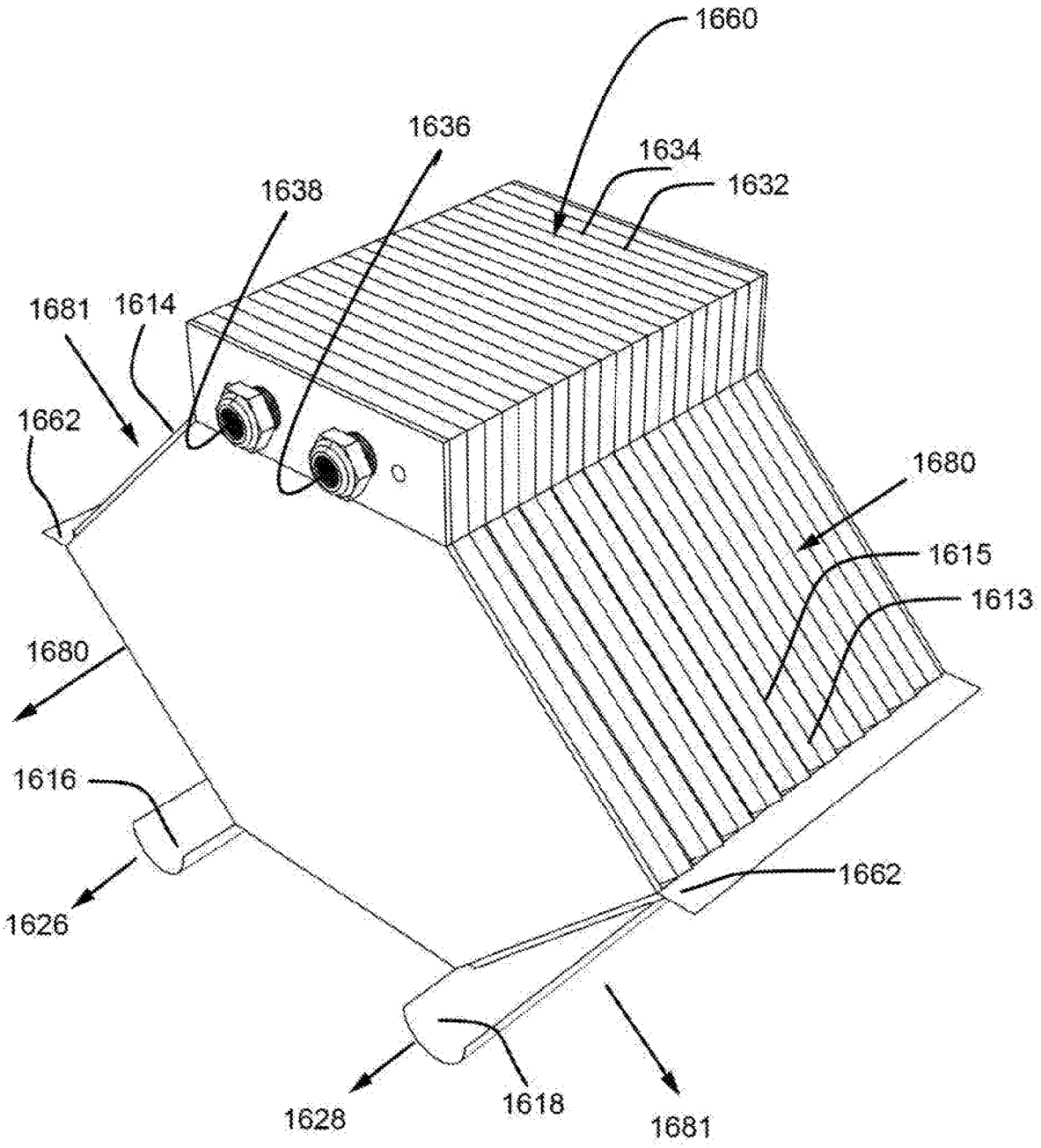

FIG. 15*j* illustrates a perspective view of another configuration of evaporative liquid desiccant hex shaped exchange module 1660 according to the present disclosure. As shown in FIG. 15*j*, first and second liquid distribution headers 1632, 1634 may be positioned outside of first and second passages 1613, 1614 of plates 1615. Positioning first and second liquid distribution headers 1632, 1634 outside of first and second passages 1613, 1614 may provide an obstruction-free pathway for counterflowing first and second air streams 1680 and 1681.

Figure 15K:
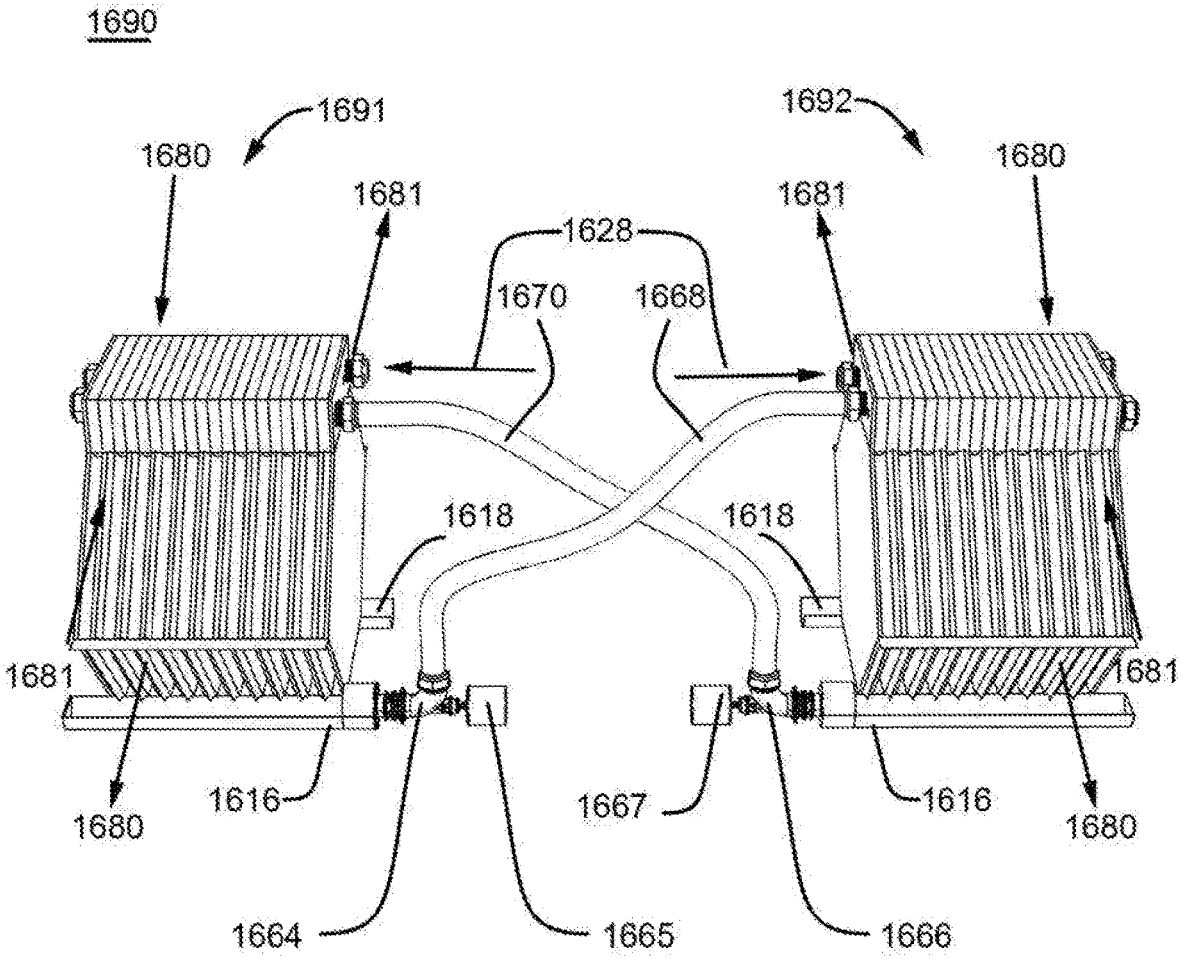
FIG. 15*k* illustrates a perspective view of a multiple function remote energy recovery system, according to an exemplary disclosed embodiment.
Figure 15I:
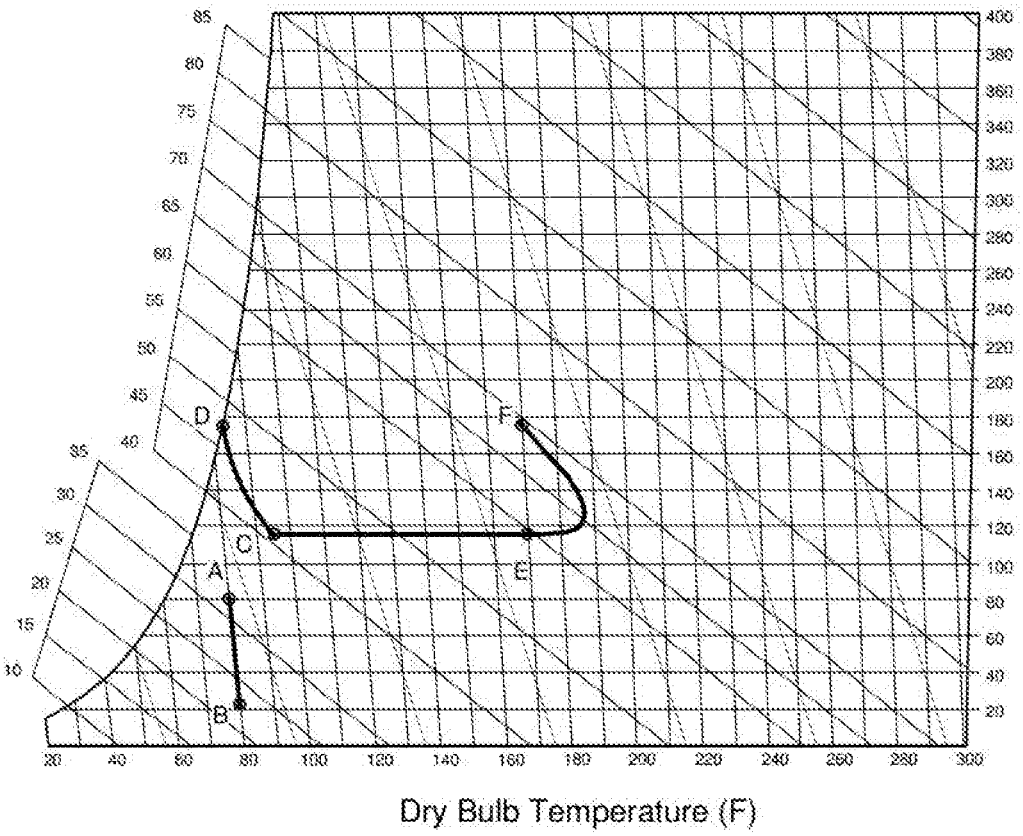

The present disclosure contemplates a multiple function remote energy recovery system. With reference to FIG. 15*k*, in some embodiments, a system 1690 may be implemented for multiple function remote energy recovery. System 1690 may be configured to recover heat and moisture between two or more detached airstreams. System 1690 may comprise first liquid desiccant recovery exchange module 1691 and second liquid desiccant recovery exchange module 1692. First and second liquid desiccant recovery exchange modules 1691, 1692 may embody exchange module 1660 described in FIGS. 15*i* and 15*j*.

First air stream 1680, which may be, for example, process supply air to a building, may pass through first liquid desiccant recovery exchange module 1691 and may be dehumidified and cooled by first liquid 1626, which may be, for example, a strong desiccant, and may be cooled by second liquid 1628, which may be, for example, water evaporating into a second air stream 1681, such as, for example, atmospheric air, passed through first liquid desiccant recovery exchange module 1691.

With respect to the second liquid desiccant recovery exchange module 1692, first air stream 1680, which may be, for example, exhaust air from the building, may pass through module 1692. First liquid 1626, which may be a weak desiccant, may remotely extract energy from the exhaust air, while second liquid 1628, which may be, for example, water evaporating into second air stream 1681, such as, for example, atmospheric air, passed through second liquid desiccant recovery exchange module 1692, may simultaneously cool the exhaust air.

First liquid desiccant recovery exchange module 1691 may be connected to second liquid desiccant recovery exchange module 1692 via conduit pipes and an enthalpy pump may facilitate flow of liquid desiccant between modules 1691, 1692. First liquid drain conduit 1616 on first exchange module 1691 may collect weak desiccant. The weak desiccant may be pumped to second exchange module 1692 via weak desiccant pump 1664 powered by motor 1665. Weak desiccant may be delivered to second exchange module 1692 via weak desiccant conduit 1668.

First liquid drain conduit 1616 on second exchange module 1692 may collect strong desiccant. Strong desiccant may be pumped to first exchange module 1691 via strong desiccant pump 1666 powered by motor 1667. Strong desiccant may be delivered to first exchange module 1691 via strong desiccant conduit 1670. Second liquid drain conduits 1618 connected to each of first and second exchange modules 1691, 1692 may collect excess water that may not be evaporated, and the excess water may be returned back to liquid distribution headers 1632, 1634 of modules 1691, 1692.

In some embodiments, an evaporatively cooled liquid desiccant air handling unit of the present disclosure may process outdoor air at a temperature of about 86° F. and a humidity ratio of 135 grains. The liquid desiccant used may be a 45% lithium chloride solution. Six hundred cfm may be passed through air handling unit having 0.063" gaps between plates. The resulting supply air exiting the unit may have a temperature of 80° F. and a humidity ratio of 35 grains.

Water or salt water, such as lithium chloride, may be the most common solvent used to remove inorganic contaminants, such as formaldehyde and other VOCs. In some embodiments, the disclosed evaporative cooling and steam regenerating module 1600, may, independently or concurrently, function as a regenerable scrubber system.

In some embodiments, and with reference to FIG. 15*k*, air handling system 1690 may be implemented for controlling carbon dioxide ($CO_2$), formaldehyde, and volatile organic compound (VOC) emissions from a building enclosure. $CO_2$ liquid sorbent may flow within the exchanger and may be regenerated by thermal means to release and capture the absorbed $CO_2$. Amines are well-known for their reversible reactions with $CO_2$, which may make them ideal for $CO_2$ capture from several gas streams, including flue gas. Systems for controlling and eliminating the $CO_2$ from a breathable air supply may be utilized in submarines, space vehicles, space suits, and various types of building enclosures. In this respect, selective $CO_2$ absorption by aqueous alkanolamines may be energy intensive and the absorbant may be corrosive.

Physical absorption of pollutant molecules may depend on properties of the gas stream and liquid solvent, such as density and viscosity, as well as specific characteristics of the pollutant(s) in the gas and the liquid stream, including diffusivity and equilibrium solubility. For most regenerative sorbents, these properties may be temperature dependent. Lower temperatures may generally favor absorption of gases by the solvent. Absorption may be enhanced by greater contact surface area, higher liquid gas ratios, and higher concentrations in the gas stream. Chemical absorption may be limited by the rate of reaction, although the rate-limiting step may be typically the physical absorption rate, not the chemical reaction rate. Cold solutions of alkylamines may bind $CO_2$, but the binding may be reversed at higher temperatures. The integrated, indirect evaporation of the present disclosed may cool the amines solution, while the integrated secondary air flow path filled with steam indirectly may heat the amines solution. This may create a large enough temperature differential to remove the majority of carbon dioxide continuously from a process air stream. This may be done in concert with the lithium chloride water vapor removal, reducing the need for outside air.

Carbon dioxide from a process air stream may be absorbed by a solution of an amine, with the amine solution subsequently being regenerated by heating, and the resulting desorbed carbon dioxide may be rejected to a second gas stream. The concentrated gas stream may subsequently be discharged to the atmosphere or solidified by a combination of compression and low temperature condensation.

Amines and other organics may be frequently coated in thin layers but may be found subject to physical losses by carry over or entrainment as vapor or liquid. The dispensing of amines may be accomplished without the creation of microdroplets which may become entrained within the air streams. During an absorption cycle, a parallel portion of excess water vapor of the air may in turn be absorbed by a mixture of aqueous solutions of alkylamines and lithium chloride. It may be advantageous to perform the absorption portion of the cycle at the wet bulb temperature of the atmosphere. Indirect evaporation in summer conditions and indirect free airside cooling in winter conditions may bring a low energy utilization to carbon dioxide scrubbing. Air passing through the absorber may then be returned or supplied to the building, with only a small amount of its original carbon dioxide and water vapor content.

For the purposes of regeneration for reuse, the exchanger may be indirectly heated to a temperature at or slightly above 200° F. via hot water or steam. The carbon dioxide, formaldehydes, VOC compounds, and chemically absorbed water contained in the reversibly binding aqueous solutions may be driven off. The warm aqueous solutions of alkylamines may be subsequently cooled by indirect evaporation and process air. A liquid-to-liquid heat exchanger (not depicted) may be used to preheat solution contained within conduit 1668 and pre-cool solution contained within conduit 1670. The liquid-to-liquid heat exchanger may be made of a material compatible with corrosive salts and strong alkylamine solutions, including, for example, polymers, stainless steel, nickel, titanium, or carbon.

System 1690 of the present disclosure may be used to absorb the carbon dioxide and to desorb into a separate gas stream in a higher concentrated form. By this application, carbon dioxide may be rejected from an enclosed environment to the atmosphere, but the resulting concentrated air stream may afford other opportunities and uses. The system 1690 of the present disclosure may help occupants improve their wellness, productivity, and comfort, improve performance of mental and/or physical tasks, increase their alertness, quality of life and pleasure, reduce their drowsiness, and aid in curing and preventing disease by decreasing the percentage of carbon dioxide in the enclosed space to a beneficial and safe level.

Formaldehyde is a common indoor pollutant that is an irritant and has been classified as a carcinogen. Adsorption technology may be safe and stable and may remove formaldehyde efficiently but its short life span and low adsorption capacity may limit its indoor application. The system 1690 of the present disclosure may remove unwanted air pollutant molecules via absorption into liquid solvent, reaction with a sorbent or reagent solution, or by inertial or diffusional impaction.

System 1690 of the present disclosure may remove inorganic fumes, vapors, and gases (e.g., chromic acid, hydrogen sulfide, ammonia, chlorides, fluorides, and $SO_2$); volatile organic compounds (VOC); and particulate matter (PM), including PM less than or equal to 10 micrometers (μm) in aerodynamic diameter ($PM_{10}$), PM less than or equal to 2.5 μm in aerodynamic diameter ($PM_{2.5}$), and hazardous air pollutants (HAP) in particulate form ($PM_{HAP}$).

Absorption may be used as a raw material and/or product recovery technique in separation and purification of gaseous streams containing high concentrations of VOC, especially water-soluble compounds, such as methanol, ethanol, isopropanol, butanol, acetone, and formaldehyde. Hydrophobic VOC can be absorbed using an amphiphilic block copolymer dissolved in water. However, as an emission control technique, it may be more commonly employed for controlling inorganic gases than for VOC. When using absorption as the primary control technique for organic vapors, the spent solvent must be easily regenerated or disposed of in an environmentally acceptable manner per Environmental Protection Agency regulations.

The suitability of gas absorption as a pollution control method may generally be dependent on the following factors: (1) availability of suitable solvent; (2) required removal efficiency; (3) pollutant concentration in the inlet vapor; (4) capacity required for handling waste gas; and (5) recovery value of the pollutant(s) or the disposal cost of the unrecoverable solvent.

Air handling and scrubbing system 1690 may maintain the indoor air quality at an acceptable level within various enclosed spaces by providing comfortable and healthy conditions and cleanliness. HVAC systems may constitute a significant part of a building's energy budget, particularly in extreme climates. System 1690 of the present disclosure may provide a practical, modular, and scalable system for removing contaminants from the circulating air in an HVAC system, utilizing regenerable absorbent materials and a continuous absorption-desorption cycle being isothermally cooled and isothermally heated, respectively.

Treating large volumes of indoor air having low concentrations of organic and inorganic contaminants may require bringing large volumes of absorbent materials into intimate contact with large volumes of circulating indoor air. It may also be advantageous to use air treatment systems, such as air handling unit 100, that are scalable and relatively compact in size so as to be readily installed in existing buildings by human operators. Furthermore, different buildings may have different air flow requirements and contaminant levels. To efficiently and practically manufacture and deploy air treatment systems adaptable to a wide variety of buildings, it may be advantageous to provide a modular air treatment system design, based on one size that is easily manufactured and combined to provide scalable solutions for different building sizes and air quality requirements. It may also be advantageous to make air treatment systems that are easily integrated with existing HVAC systems rather than replacing existing infrastructure.

A building according to the present disclosure may include, without limitation, an office building, residential building, store, mall, hotel, hospital, restaurant, airport, train station and/or school. A vehicle according to the present disclosure may include, without limitation, an automobile, ship, train, plane, or submarine.

Scrubbing system 1690 of the present disclosure may be configured to remove unwanted gases, vapors, and contamination, including, without limitation, volatile organic compounds (VOC) and CO2 produced within human-occupied space by human occupants. Other contaminants that may be removed include without limitation carbon monoxide, sulfur oxides and/or nitrous oxides.

With reference to FIG. 15*k*, multiple function air handling and scrubbing system 1690 may be configured to remove carbon dioxide. System 1690 may comprise first carbon dioxide scrubbing module 1691 and second regeneration module 1692. First and second modules 1691, 1692 may embody exchange module 1660 described in FIGS. 15*i* and 15*j*.

First air stream 1680, which may be, for example, process supply air to a building, may pass through first carbon dioxide scrubbing module 1691 and carbon dioxide may be removed and cooled by first liquid 1626, which may be, for example, an aqueous solution of alkylamines, and may, in turn, be cooled by second liquid 1628, which may be, for example, water evaporating into a second air stream 1681, such as, for example, atmospheric air, passed through first carbon dioxide scrubbing module 1691.

With respect to the second regeneration module 1692, first air stream 1680, which may be, for example, atmospheric air, may pass through module 1692. First liquid 1626, which may be a carbon dioxide saturated alkylamine, may release carbon dioxide, while air stream 1681 may be, for example, steam saturated running in a closed loop (not shown), and may simultaneously heat the saturated alkylamine.

First carbon dioxide scrubbing module 1691 may be connected to second regeneration module 1692 via conduit pipes and a liquid pump may facilitate flow of alkylamine between the modules 1691, 1692. First liquid drain conduit 1616 on first exchange module 1691 may collect saturated alkylamine. The saturated alkylamine may be pumped to second regeneration module 1692 via saturated alkylamine pump 1664 powered by motor 1665. Saturated alkylamine may be delivered to second regeneration module 1692 via saturated alkylamine conduit 1668.

First liquid drain conduit 1616 on second exchange module 1692 may collect regenerated alkylamine. The regenerated alkylamine may be pumped to first exchange module 1691 via regenerated alkylamine pump 1666 powered by motor 1667. The regenerated alkylamine may be delivered to first exchange module 1691 via a regenerated alkylamine conduit 1670. Second liquid drain conduits 1618 connected to each of the first and second exchange modules 1691, 1692 may collect excess water that may not be evaporated, and the excess water may be returned back to liquid distribution headers 1632, 1634 of modules 1691, 1692.

FIG. 15*l* illustrates a psychrometric chart corresponding to the operation of the evaporative cooling and/or steam regenerating liquid desiccant air conditioner module of the present disclosure. FIG. 15*l* depicts a first airstream of outside air (OA) to supply air (SA), a second airstream of return air (RA) to exhaust air (EA), and a third regeneration airstream. The first airstream may traverse points C and D, the second airstream may traverse points A and B, and the third airstream may traverse points C, E, and F. FIG. 15*a* charts the estimated temperatures and humidity levels for the first, second, and third airstreams as they traverse these points.

The first airstream and the second airstream may flow through the heat exchanger in a counterflow orientation. Point A may represent a summer return air condition from a conditioned space. The second airstream may enter an entry port of the heat exchanger at point A of FIG. 15L and may flow through the heat exchanger to point B. The second airstream may be exposed to a liquid desiccant solution which may flows along the membrane surfaces of the heat exchanger. The liquid desiccant may act to dehumidify the second airstream. The first airstream may flow simultaneously through the heat exchanger from point C to point D in a counterflow orientation in relation to the second airstream. As the second airstream flows through the heat exchanger from point A to point B and the first airstream flows through the heat exchanger from point C to point D, heat content may transfer from the second airstream to the first airstream. The third regeneration airstream may be heated by a heat source from point C to point E and may draw moisture from liquid desiccant solution from point E to point F which may flow along the membrane surfaces of the heat exchanger. Drawing moisture from the liquid desiccant solution from point E to point F may re-concentrate the liquid desiccant solution.

The exchanger 213 of the present disclosure may be used in various types of heat and water vapor exchangers. For example, as mentioned above, exchanger 213 can be used in energy recovery ventilators for transferring heat and water vapor between air streams entering and exiting a building. This may be accomplished by flowing the streams on opposite sides of the counter-pleated exchanger 213. Membrane 1206 of exchanger 213 may allow the heat and moisture to transfer from one stream to the other while substantially preventing the air streams from mixing or crossing over. Other potential applications for exchanger 213 may include, but are not limited to, the applications described in U.S. application Ser. No. 13/426,565, which is incorporated herein by reference.

Rotationally-Molded Hollow Shells

FIGS. 16*a*-16*d* illustrates a perspective view of a rotationally molded shell 1700 according to the present disclosure. Shell 1700 may comprise interstitial space 1701 filled with insulating material 1702. Insulating material 1702 may include powdered metal oxides, powdered inorganic oxides, silica powder, fumed silica powder, and/or aerogel powder. Powdered ceramic may be superior to conventional urethane foams, as foams degrade in their thermal performance as the inert gases trapped inside their pore structure leak out over time. Powdered ceramic may provide insulation and prevent heat build-up.

Walls of shell 1700 may be rotationally molded (rotomolded). Shell 1700 may be formed of cross-linked or non-cross-linked polyolefins, including, for example, polyethylene (PE), polypropylene, filled polypropylene, polybutylene (PB), cross-linked polyethyene (PEX), polyam ides, polysuphones, poly-ether ketones, polyethylene terephthalate (PET), and mixtures thereof. Walls of rotationally-molded shell 1700 may be furthermore modified with additives, fillers, and reinforcements, including, for example, boron fibers, carbon fibers, glass fibers, Kevlar fibers, silanes, titanates, chlorides, bromines, phosphorous, metallic salts, calcium carbonate, silicas, clays, chromates, carbon black, pigments, or combinations thereof. In certain embodiments, the outer and inner walls of shell 1700 may be formed of a non-brittle thermoplastic, such as polypropylene. The polypropylene may also be carbon-impregnated to provide UV protection and heat deflection.

In some embodiments, interstitial space 1701 of shell 1700 may be under a vacuum to provide further insulation and may be filled with unmolded, loose, powdery insulating material 1702. Thermal conductivity of less than 0.010 W/(m*K) may be measured, and preferably less than 0.004 W/(m*K), under vacuum.

In certain embodiments, filled shell 1700 may be used to make building components, such as, for example, wall panel 1703. A typical wall using two-by-four wall studs may be 3.5 inches thick, with an inside of ½ inch thick drywall and ½ inch thick exterior plywood and/or siding, for a total wall thickness of 4.5 inches. Assuming four inches of modest vacuum insulation, wall panel 1703 formed from filled shell 1700 may provide an R value of 100 or greater.

In other embodiments, the air handling module, the energy recovery module, and the dehumidification module of the present disclosure may be insulated by forming the components of the modules with the filled rotationally molded shell 1700. Components of the modules, including, for example, the exchanger housing, the air director, manifolds, fan boxes, access panels, and electrical access panels, may be rotationally molded (rotomolded). The rotationally-molded components may include outer wall, inner wall, and hollow interstitial space between the outer and inner walls. The hollow interstitial space may be filled with appropriate insulation material including, for example, a powdered ceramic, such as fumed silica or preferably aerogel powder. The rotomolded components of the modules may be lighter than existing components of air handling and conditioning systems. As a result, the modules of the present disclosure may readily be moved and transported by an operator without employing heavy machinery and the like.

Shells 1700 may also be useful in construction of building walls, building basements, building roofs, airplane shells, automobile enclosures, HVAC air handling modules, energy recovery ventilators, and air ducts. It may be advantageous to have molded features allowing for a plurality of interconnected hollow shells to snap or otherwise structurally seal in these applications.

As shown in FIGS. 16*a*-16*d*, wall panel 1703 may be formed of rotationally molded shell 1700 having interstitial space 1701 filled with insulating material 1702. Wall panel 1703 may include an electrical wire conduit, a communication bus conduit, electrical outlets, water piping, hot water piping, window wells, skylight wells, shelves, structural supports, and wall hangers.

Wall panel 1703 may comprise inside surface 1704, outside surface 1705, interconnecting left side 1706, interconnecting right side 1707, interconnecting top side 1708, and interconnecting bottom side 1709. In some embodiments, interstitial space 1701 may be under a vacuum while insulating material 1702 may provide the compressive structure necessary to keep inside surface 1704 and outside surface 1705 from collapsing inward. Wall panel 1703 may be manufactured under a vacuum, whereby shell 1700 may be free of all defects and manufactured from thermoplastics that inhibit molecules to pass or leak in. The interstitial space 1701 of wall panel 1703 may be linked, through a plurality of sealed, interconnected ports to a centralized vacuum generator. Furthermore, a partial vacuum may be maintained throughout the lifetime of the building structure during which age, wear, and tear may generate microfractures or penetrations into wall panel 1703 reducing or eliminating the original partial vacuum.

A partial vacuum, controlled by the centralized vacuum generator, may be adjusted given the temperature gradient between the inside and outside of the building. During times of extreme cold or extreme heat, a greater vacuum may be desirable while during times of more moderator environmental temperatures a lesser vacuum or no vacuum may be desirable. The ability to maintain and/or change the thermal resistance of structure's wall may be advantageous by optimizing the energy characteristics at a specific site with specific environmental conditions.

In certain embodiments, wall panel 1703 may include hydronic distribution and collection system 1710. The hydronic distribution and collection system 1710 may employ a plurality of interconnecting ports on horizontal, vertical, and sides of wall panel 1703. The ports may serve as interchangeable attachment points for a plurality of structures, including, for example, a hot water pipe, a potable water pipe, a refrigerant line pipe, a sewer/septic pipe, a liquid desiccant pipe, a chilled water conduit, a steam pipe, vacuum lines, and/or other fluidly connected hydronic components found within a commercial, residential, or industrial building. Furthermore, the port may be threaded and/or incorporate gasketed seals. The ports may also readily attach and detach to a plurality of appliances, including, for example, sinks, bathtubs, toilets, washers, dishwashers, boilers, condensers, and evaporators.

Hydronic distribution and collection system 1710 may be positioned along a bottom portion of wall panel 1703 and may include a sewer conduit with at least two ports disposed on each end and at least one port therebetween. For example, first sewer water edge port 1717 may be positioned on left side 1706, second sewer water edge port 1717 may be positioned on the right side 1707, and third inside port 1719 may be positioned on inside surface 1704. A sewer water pipe 1718 may be freely disposed of within sewer conduit and may allow for the proper pipe angle to facilitate gravitational draining.

Wall panel 1703 may include hot water pipe 1713 comprising interconnecting first and second edge ports 1712 and inside port. Wall panel 1703 may also include potable water pipe 1715 including interconnecting first and second edge ports 1714 and inside port 1716. These ports may be threaded and/or may incorporate gasketed seals between a plurality of wall panels 1703 to maintain seals between liquids, pressure, and vacuum conditions. In some embodiments, the ports may be threaded in accordance with British Standard Parallel Pipe (BSPP) standards with integrated sealing washers to ensure international compatibility with National Taper Pipe (NPT), American Standard Straight Pipe for Mechanical Joints (NPSM), American Standard Straight Pipe (NPS), and British Standard Tapered Pipe (BSTP) standards.

The present disclosure contemplates any suitable number of pipes and ports for wall panel 1703, and ports may be arranged on any suitable location of the wall panel 1703, including, for example, lateral, upper, and lower surfaces. The conduit and hermetically sealed port connections of the hydronic distribution and collection system 1710 may additionally serve as the means of evacuating the interstitial space 1701 of wall panel 1703 linked to a centralized vacuum generator.

In certain embodiments, wall panel 1703 may include communication bus 1720. Communication bus 1720 may employ a plurality of interconnecting ports on horizontal, vertical, and sides of wall panel 1703. Interconnecting ports may serve as attachment points for a plurality of communication wire types, including, for example, electrical wire, communication bus wire, sensor probe wire, wire harness connectors, TV cable, DSL/internet cable, telephone cable, security/camera wire, and combinations thereof. Communication bus 1720 may include communication bus conduit 1723 including interconnecting first and second edge ports 1722 and inside port 1724.

The present disclosure contemplates any suitable number of bus bars and bus ports for wall panel 1703, and ports may be arranged on any suitable location of wall panel 1703, including, for example, lateral, upper, and lower surfaces. The conduit and hermetically sealed port connections of communication bus 1720 may additionally serve as the means of evacuating interstitial space 1701 of wall panel 1703 linked to a centralized vacuum generator.

In some embodiments, wall panel 1703 may include electrical power distribution 1730. Electrical power distribution 1730 may employ a plurality of interconnecting ports on horizontal, vertical, and sides of wall panel 1703. Interconnecting ports may serve as attachment points for a plurality of electrical wire types, including, for example, AC power wires, DC power wires, grounding wires, light switches, appliance outlets, and electrical wire harness connectors. Electrical power distribution 1730 may include a receptacle conduit 1733 including interconnecting first and second edge ports 1732 and inside port 1734. Electrical power distribution 1730 may also include lighting conduit 1736 comprising interconnecting first and second edge ports 1735 and inside port 1737.

The present disclosure contemplates any suitable number of power conduits and ports for wall panel 1703, and ports may be arranged on any suitable location of wall panel 1703, including, for example, lateral, upper, and lower surfaces. The conduit and hermetically sealed port connections of electrical power distribution system 1730 may additionally serve as the means of evacuating the interstitial space 1701 of wall panel 1703 linked to a centralized vacuum generator.

In certain embodiments, wall panel 1703 may include an air distribution system 1740. Air distribution system 1740 may employ a plurality of interconnecting ports having ducts. The interconnecting ports of air distribution system 1740 may be positioned on horizontal, vertical, and sides of wall panel 1703. The interconnecting ports serve as attachment points for a plurality of structures, including, for example, diffuser vents, return vents, supply and exhaust fans, metal ducts, access panels, and/or other fluidly connected components of an HVAC system. A first air duct 1761 may have at least two duct ports 1742 disposed on each end of air duct 1761 and at least one inside port 1743 therebetween. Second air duct 1762 may have at least two duct ports 1744 disposed on each end of air duct 1762 and at least one inside port 1745 therebetween. A third air duct 1763 may have at least two duct ports 1746 disposed on each end of air duct 1763 and at least one inside port 1747 therebetween.

An evaporative liquid desiccant air conditioner module 1600, 1660 may be positioned between first and second air ducts 1761, 1762 and may connect first air duct 1761 with second air duct 1762 to provide sensible cooling, dehumidification, heating, humidification, and ventilation to an enclosure, such as a building. Air conditioner module 1600, 1660 may be connected to and powered via first fluid port 1748 and second fluid port 1749.

By way of example, a first portion of air duct 1761 may carry outside air through air conditioner module 1600, 1660, and first portion of air duct 1762 may deliver conditioned outside air to a space through inside air duct port 1745. A second portion of air duct 1761 may draw return air through inside air duct port 1743 and through air conditioner module 1600, and stale air may be exhausted through second portion of air duct 1762. First fluid port 1748 may flow a strong lithium chloride salt to dry outside air while second fluid port 1749 may flow water for indirect evaporative cooling of the outside air using return air.

Although not shown, one or more air moving systems may be coupled via the hermetically sealed ducts to a centralized system. Additionally, natural ventilation and natural buoyancy of air may provide the means of delivering conditioned outside air into a building or enclosure. In some embodiments, the size of air conditioner module 1600, 1660 may encompass most, if not all, of the interstitial space of wall panel 1703 depending on specific site requirements. The present disclosure contemplates any suitable number of air ducts and ports for wall panel 1703, and ports may be arranged on any suitable location of wall panel 1703, including, for example, lateral, upper, and lower surfaces. The ducts and hermetically sealed port connections of air distribution system 1741 may additionally serve as the means of evacuating interstitial space 1701 of wall panel 1703 linked to a centralized vacuum generator.

In certain embodiments, wall panel 1703 may comprise structural connector 1750 including a plurality of interconnecting ports and tabs on horizontal and vertical sides of said wall panel. The interconnecting ports and tabs may align and attach a plurality of adjacent wall panels 1703 and may include, for example, structural anchor bolts, module interconnectivity clamps, module seals, tongue-and-groove hermetic seals, and combinations thereof. For example, male interconnecting tabs 1752 on interconnecting left side 1706 may be structurally and hermetically sealed to female interconnecting tabs 1753 on right side 1707. A plurality of structural pin holes 1754 may structurally lock wall panels 1703 in place and may keep the panels 1703 from coming loose. These structural pin holes 1754 may be slotted to facilitate expansion and contraction of the panels 1703 given changing environmental conditions. The interconnecting ports and structural tabs of structural connector 1750 may additionally serve as the means of evacuating the interstitial space 1701 of wall panel 1703 linked to a centralized vacuum generator.

The present disclosure contemplates any suitable types of interior textures or colors 1771 applied to inside surface 1704 during the molding process. Drywall found in typical building wall construction may be eliminated. Furthermore, surfaces of wall panel 1703, molded out of polypropylene, for example, may have their surface color changed after manufacturing/installation by using primers specific for low surface energy plastics.

Figure 16A:
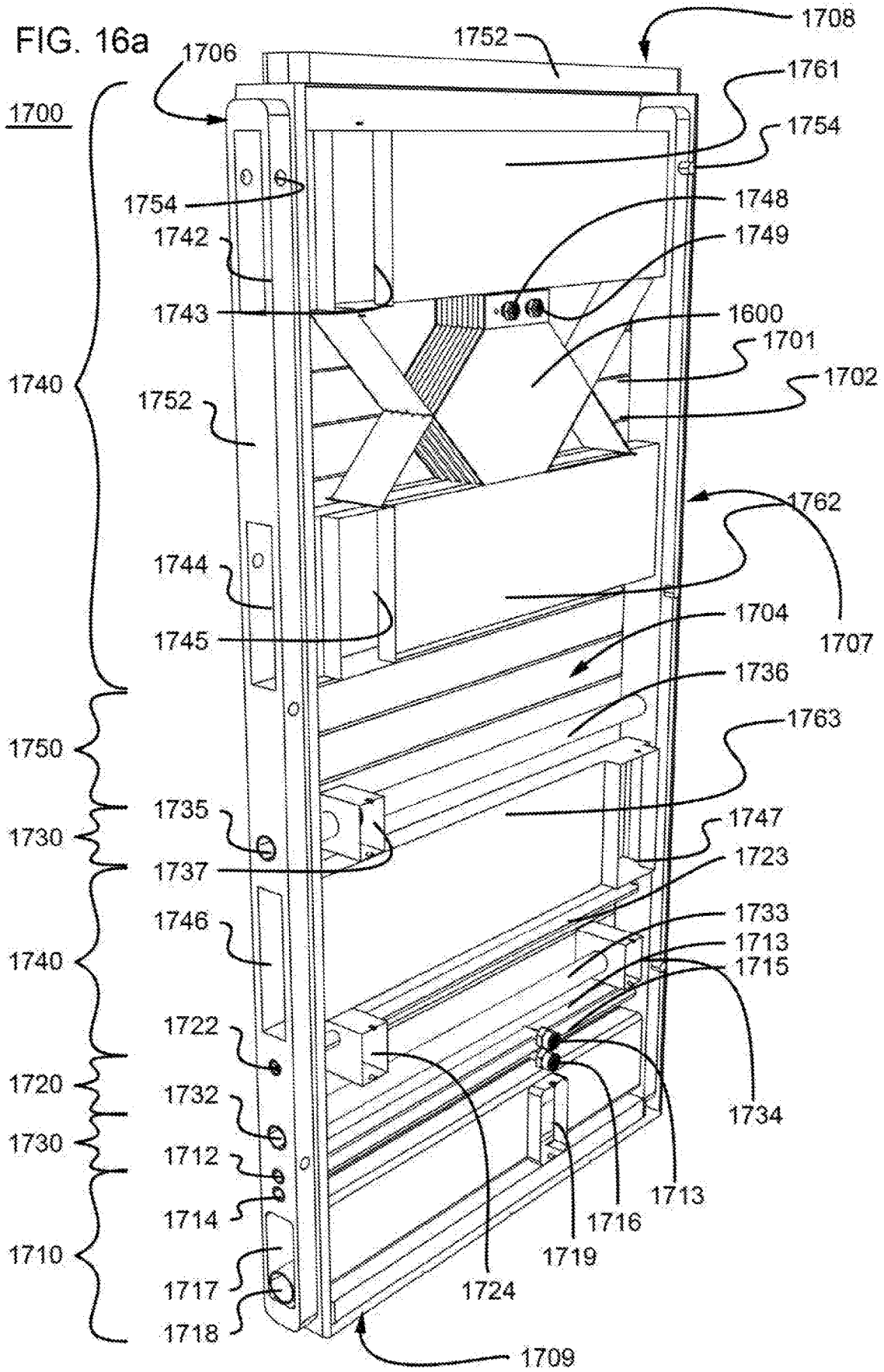
FIGS. 16*a*-16*d* illustrate perspective views of a wall panel formed of a rotationally molded shell, according to an exemplary disclosed embodiment.
Figure 16B:
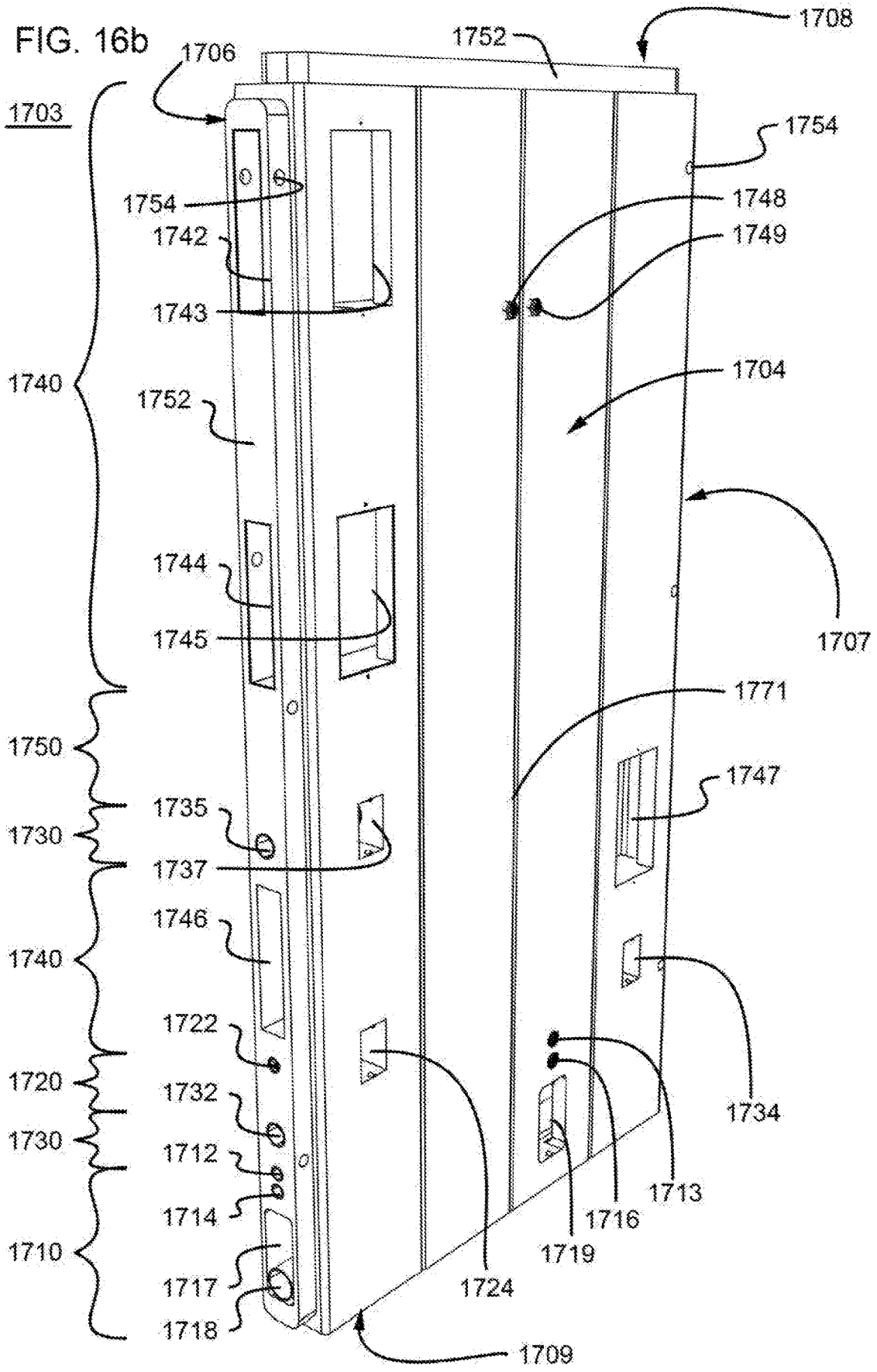
Figure 16C:
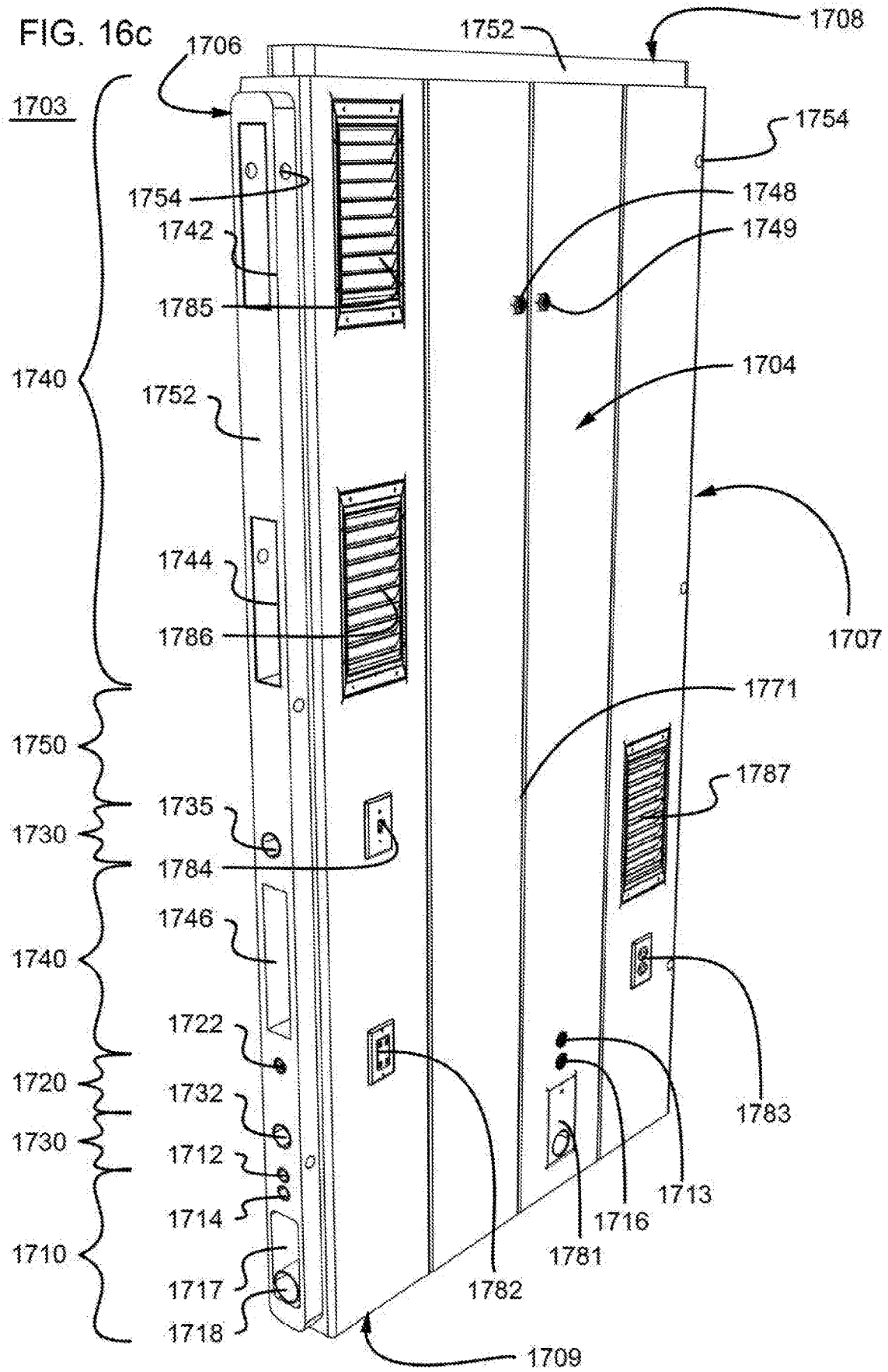

As shown in FIG. 16*c*, a number of components may be installed on wall panel 1703 to create a finished interior look and function. For example, sewer cover plate 1781 may attach over sewer water inside port 1719. Communications cover plate 1782 may attach over communication bus inside port 1724. Receptacle cover plate 1783 may attach over receptacle inside port 1734. Lighting cover plate 1784 may attach over lighting inside port 1737. First HVAC grill 1785 may attach over first air duct inside port 1743. Second HVAC grill 1786 may attach over second air duct inside port 1745. Third HVAC grill 1787 may attach over third air duct inside port 1747.

Figure 16D:
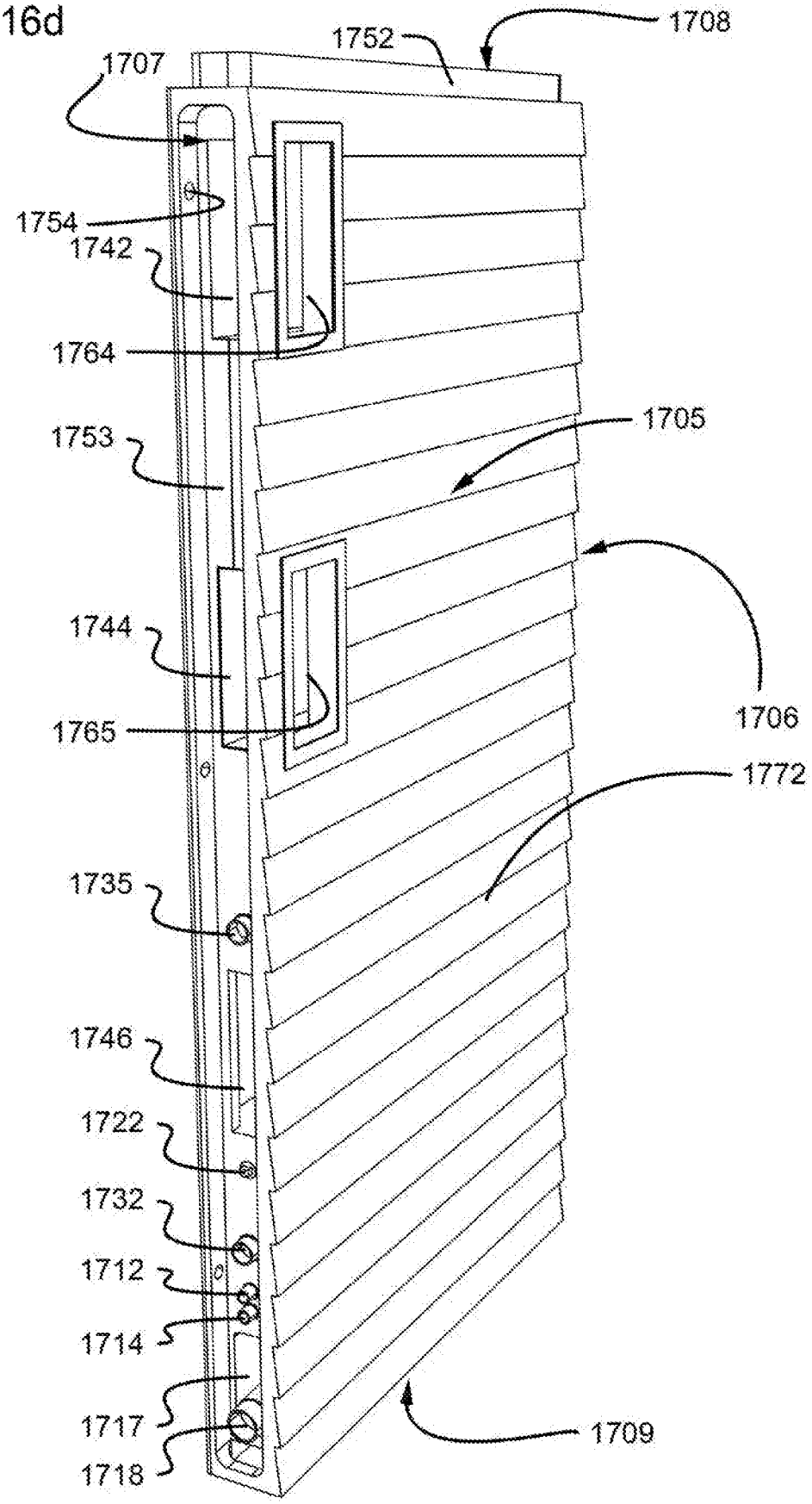

As shown in FIG. 16*d*, the present disclosure contemplates any suitable types of exterior textures or colors 1772 to outside surface 1705 of wall panel 1703. Exterior siding, trim, stucco, and various other elements typically found in exterior building wall construction may be eliminated. Furthermore, surfaces of wall panel 1703, molded out of polypropylene, for example, may have their surface color changed after manufacturing/installation by using primers specific for low surface energy plastics.

A first air duct outside port 1764 may connect to first air duct 1761 with first air duct port 1742 on ends of first air duct 1761. A second air duct outside port 1765 may connect to second air duct 1762 with second air duct port 1744 on ends of second air duct 1744. The present disclosure contemplates any suitable number of exterior components to facilitate the purpose and intent of specific building types or enclosures.

Figure 16E:
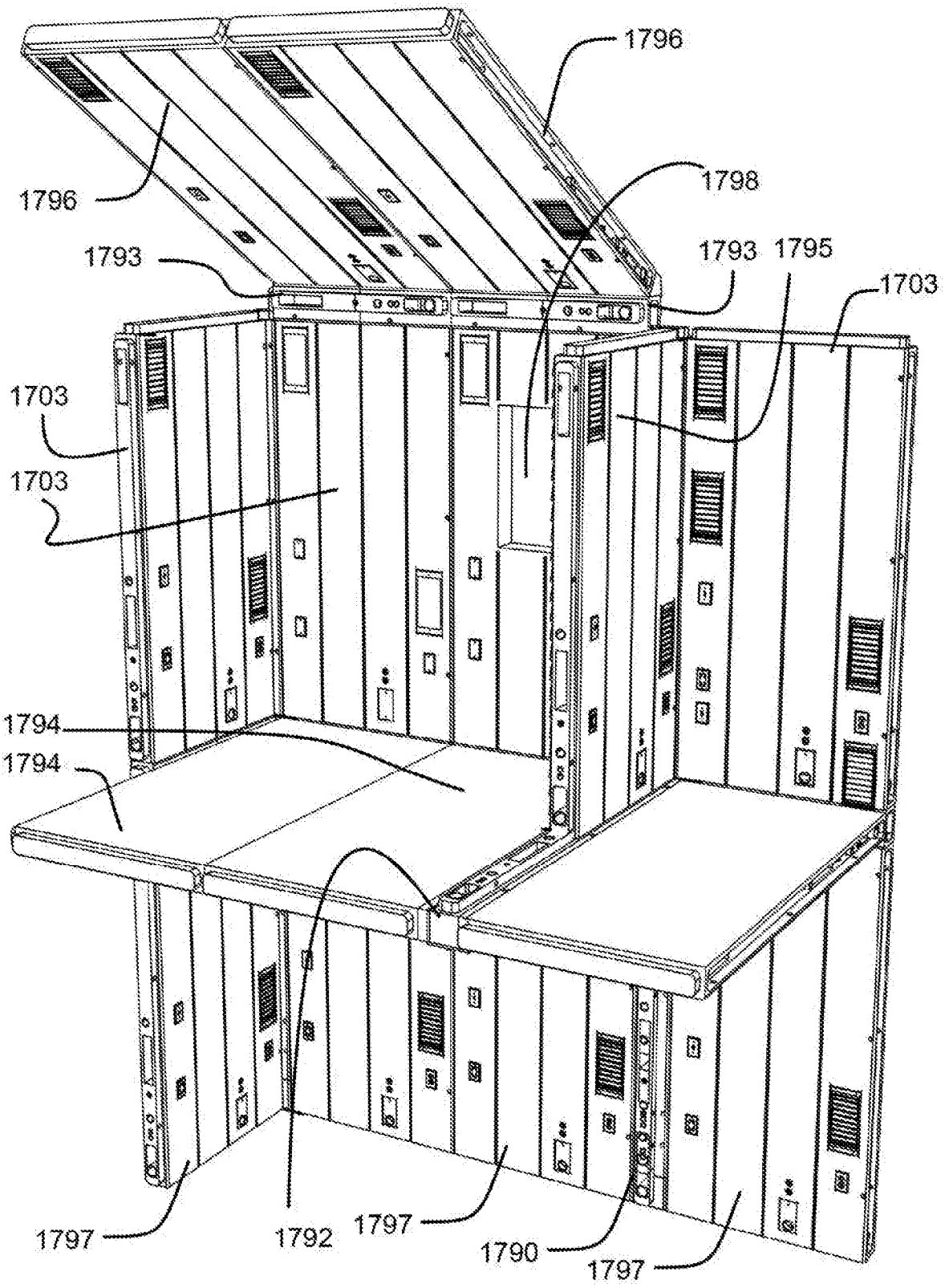
FIGS. 16*e* and 16*f* illustrate perspective views of interior and exterior surfaces of a building formed of building panels made of rotationally molded shells, according to an exemplary disclosed embodiment.

As shown in FIG. 16*e*, the present disclosure contemplates the use of rotationally molded hollow shells 1700 on all interior and exterior surfaces of building enclosures using interlocking structural tabs and a plurality of interconnecting ports. For example, a plurality of basement wall panels 1797 may attach horizontally to a plurality of three-way wall connectors 1790. Wall panel 1703 may be positioned in a substantially horizontal orientation to form a roof of a commercial, residential, or industrial building. In such a configuration the roof may be formed of the lightweight and durable panel 1703 and may accommodate all types of weather conditions, including hail. Textures, colors, and port locations may be selected to provide underfloor air distribution and underfloor utility distribution.

A plurality of floor panels 1794 may attach horizontally to a plurality of three-way floor connectors 1792. A plurality of wall panels 1703 may attach vertically to a plurality of three-way roof connectors 1793. A plurality of interior wall panels 1795 may attach to a plurality of three-way wall connectors 1790. A plurality of roof panels 1796 may connect vertically to a plurality of three-way roof connectors 1793. All interconnecting ports may be preserved through the transition between various types of rotationally molded hollow shells 1700. Structural additives, such as, for example, carbon fiber, may be added to subterranean basement panels 1797 or roof panels 1796 to accommodate high structural loading. Numerous modifications and variations in the combination of these wall panel types may be readily apparent to persons skilled in the art and may be combined to form a wide range of building shapes and sizes.

Figure 16F:
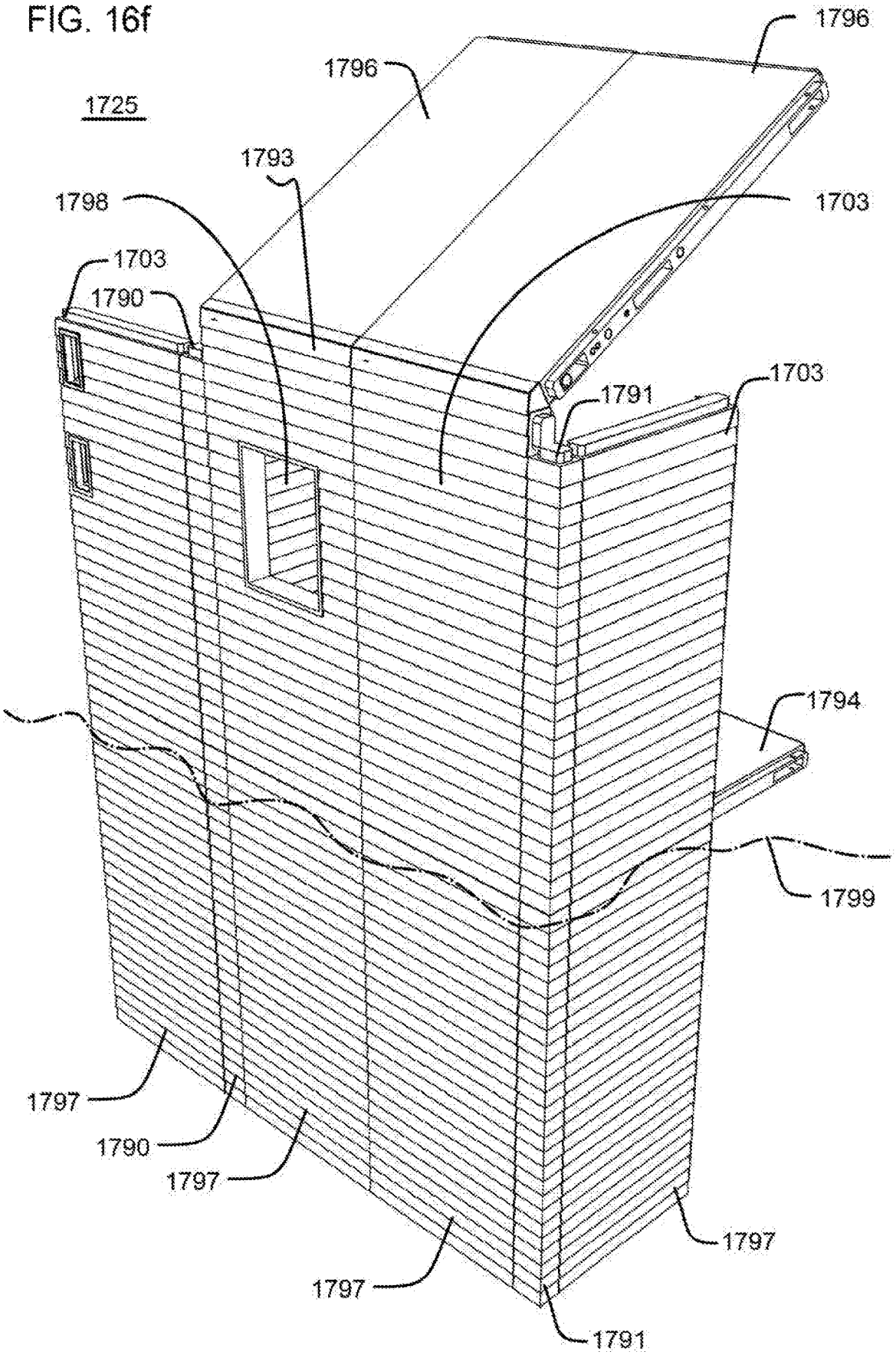

FIG. 16*f* illustrates an exterior perspective view of building system 1725 comprising a plurality of rotationally molded hollow shells 1700 having interstitial space 1701 filled with insulating material 1702. As shown in FIG. 16*f*, a ground line 1799 provides reference to molded hollow shells 1700 being particularly advantageous in their use in subterranean environments. A corner wall connector 1791 may attach to a plurality of wall panels 1703 to form an exterior corner. The present disclosure contemplates any suitable types of exterior structures, such as, for example, windows, doors, intake vents, basement window wells, and exhaust vents. A window panel 1798 may attach to a plurality of wall panels 1703. Numerous modifications and variations in the combination of these wall panel types may be readily apparent to persons skilled in the art and may be combined to form a wide range of building shapes and sizes.

Figure 16G:
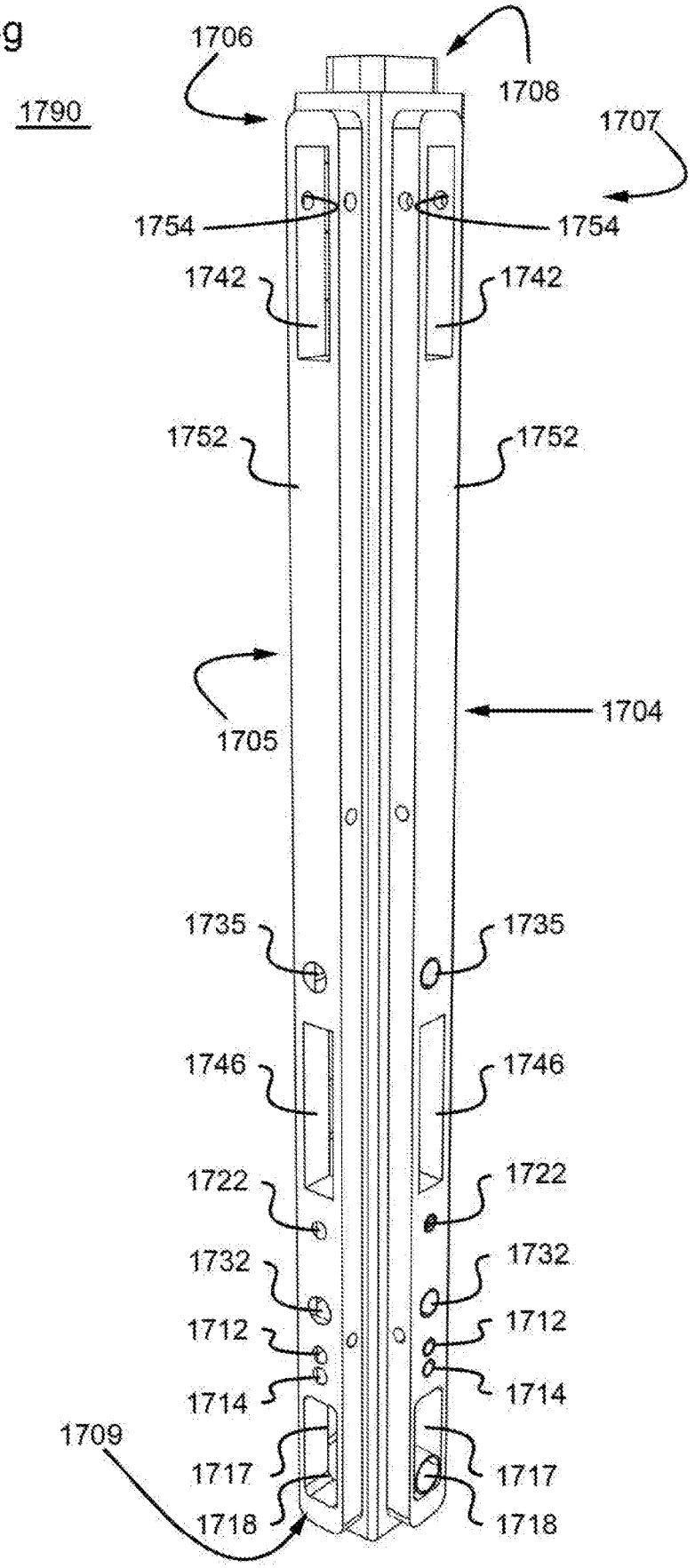
FIG. 16*g* illustrates a perspective view of a three-way wall connector formed of a rotationally molded shell, according to an exemplary disclosed embodiment.

As shown in FIG. 16*g*, three-way wall connector 1790 may be formed from a rotationally molded hollow shell 1700 having interstitial space 1701 filled with insulating material 1702. Three-way wall connector 1790 may include interconnecting inside surface 1704, outside surface 1705, interconnecting left side 1706, interconnecting right side 1707, interconnecting top side 1708, and interconnecting bottom side 1709. All interconnecting ports may be preserved through the transition between various types of rotationally molded hollow shells 1700 facilitated by three-way wall connector 1790.

Figure 16H:
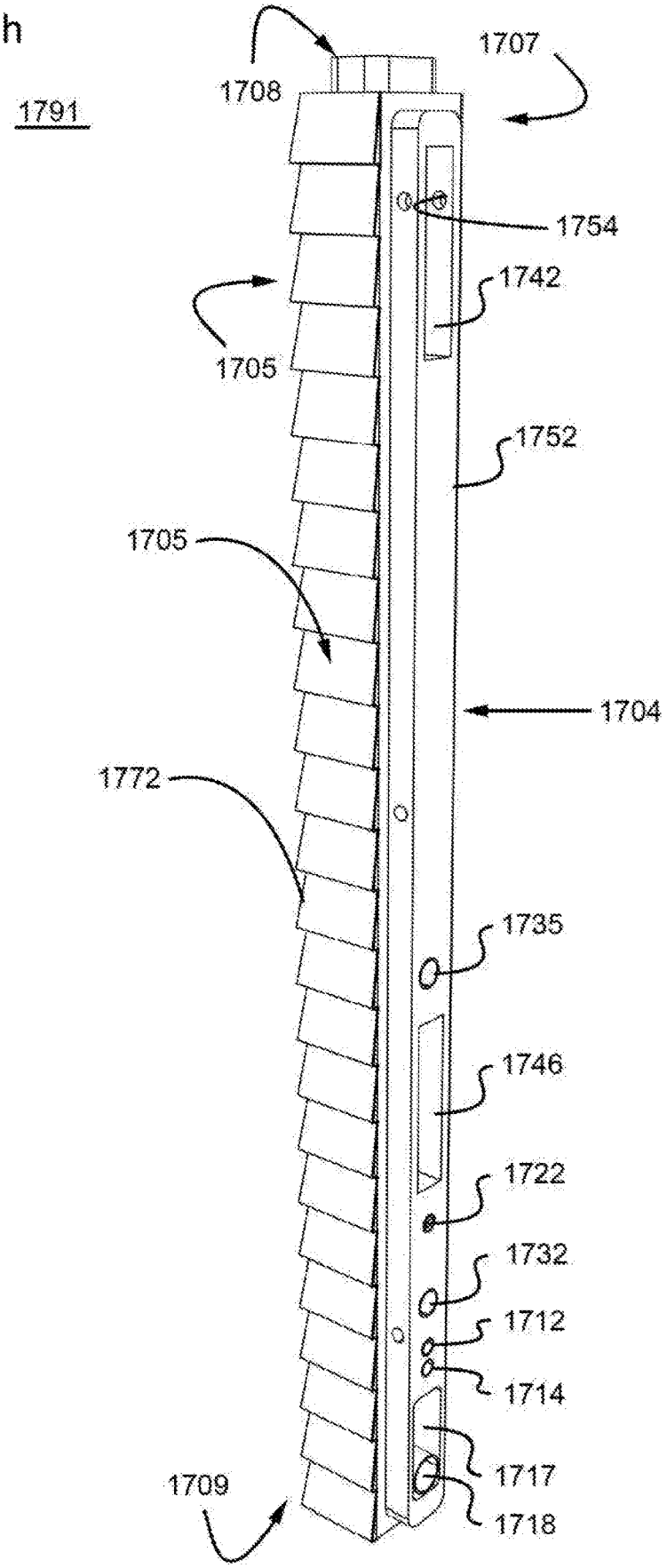
FIG. 16*h* illustrates a perspective view of a corner wall connector formed of a rotationally molded shell, according to an exemplary disclosed embodiment.

As shown in FIG. 16*h*, corner wall connector 1791 may be formed from a rotationally molded hollow shell 1700 having interstitial space 1701 filled with insulating material 1702. Corner wall connector 1791 may include two outside surfaces 1705, interconnecting left side 1706, interconnecting right side 1707, interconnecting top side 1708, and interconnecting bottom side 1709. All interconnecting ports may be preserved through the transition between various types of rotationally molded hollow shells 1700 facilitated by corner wall connector 1791.

Figure 16I:
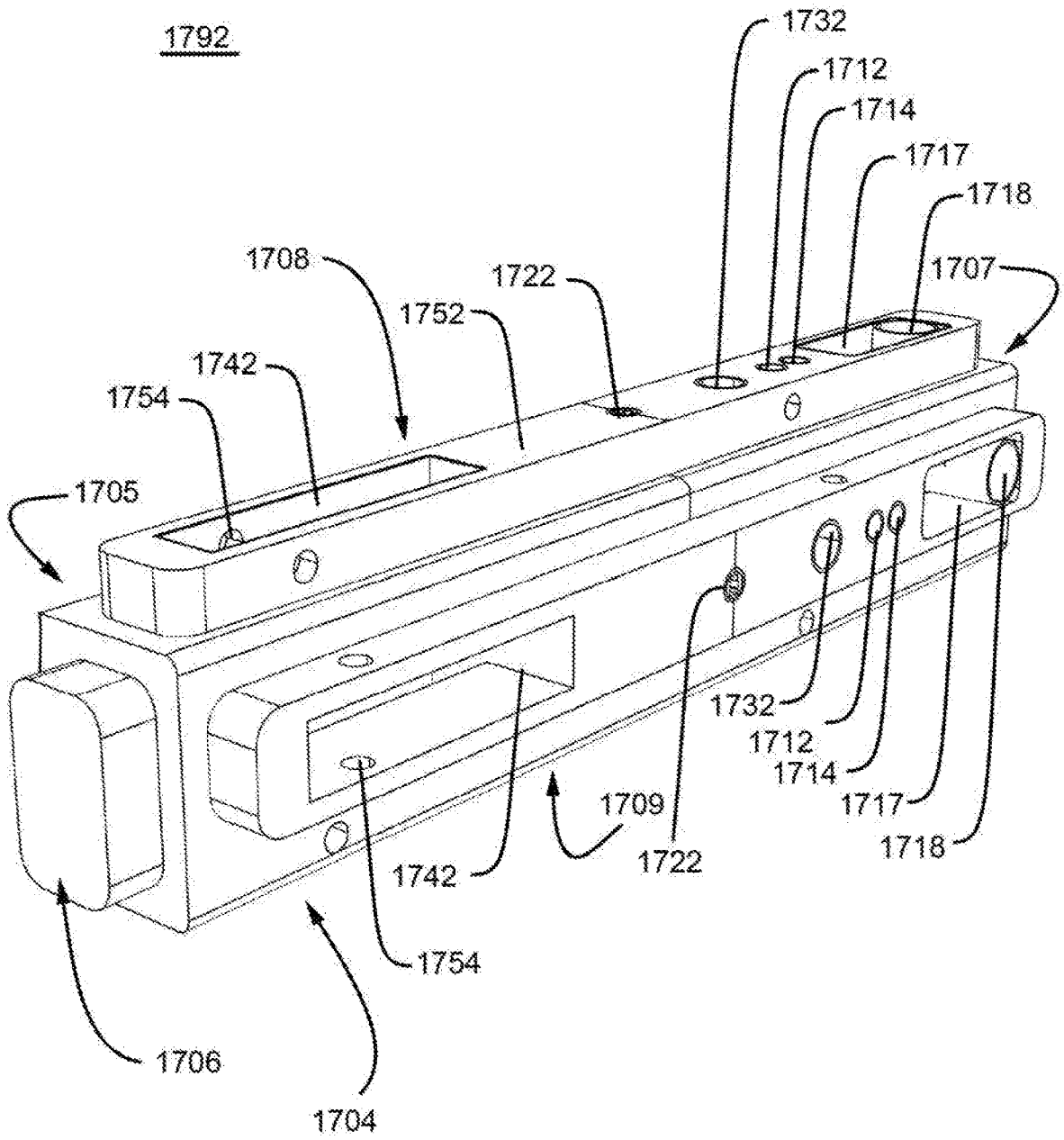
FIG. 16*i* illustrates a perspective view of a three-way floor connector formed of a rotationally molded shell, according to an exemplary disclosed embodiment.

As shown in FIG. 16*i*, three-way floor connector 1792 may be formed from a rotationally molded hollow shell 1700 having interstitial space 1701 filled with insulating material 1702. Three-way floor connector 1792 may include outside surfaces 1705, interconnecting inside surface 1704, interconnecting left side 1706, interconnecting right side 1707, interconnecting top side 1708, and interconnecting bottom side 1709. All interconnecting ports may be preserved through the transition between various types of rotationally molded hollow shells 1700 facilitated by three-way floor connector 1792.

Figure 16J:
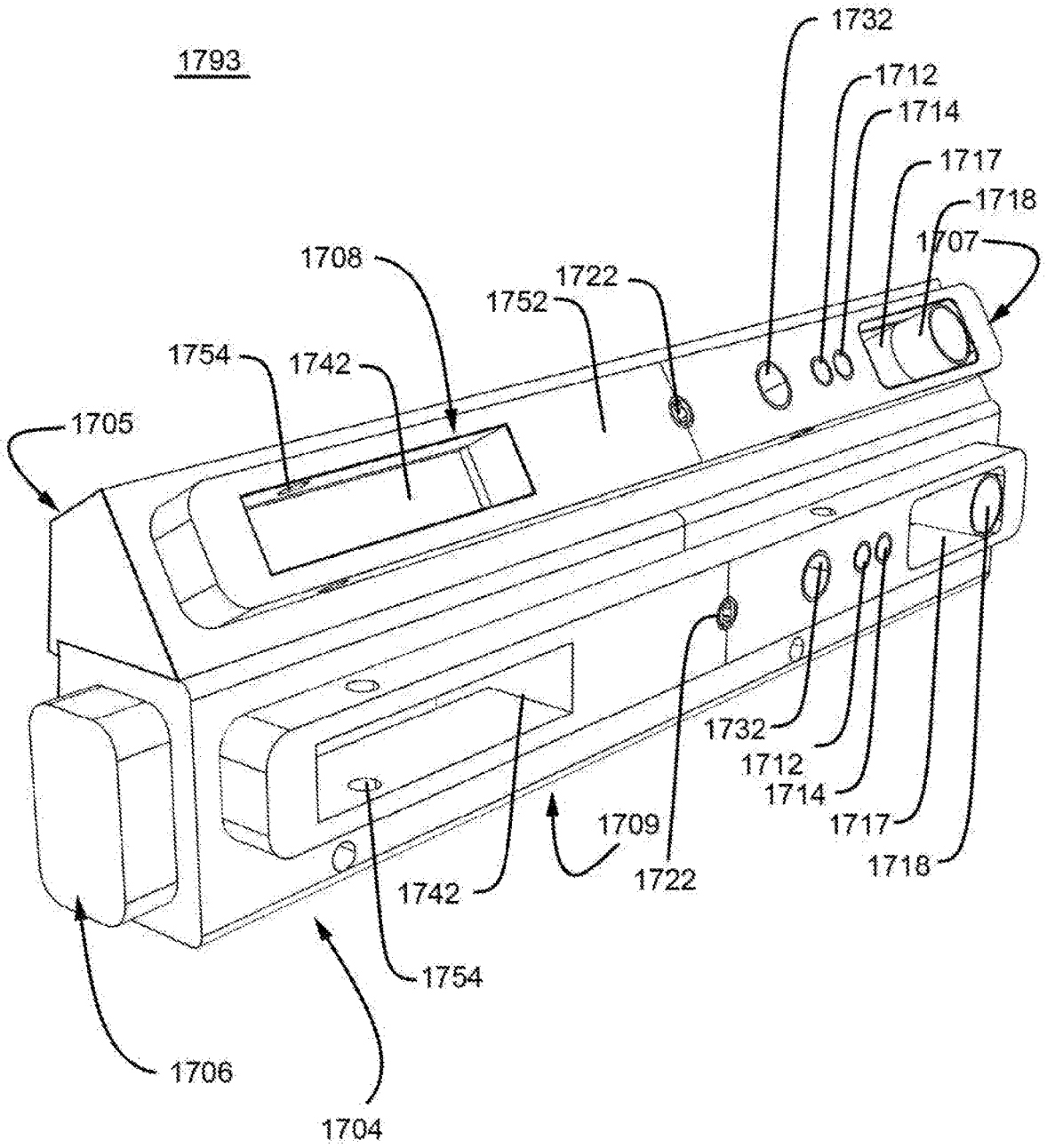
FIG. 16*j* illustrates a perspective view of a three-way roof connector formed of a rotationally molded shell, according to an exemplary disclosed embodiment.

As shown in FIG. 16*j*, three-way roof connector 1793 be formed from a rotationally molded hollow shell 1700 having interstitial space 1701 filled with insulating material 1702. Three-way roof connector 1793 may include extended outside surfaces 1705, interconnecting inside surface 1704, interconnecting left side 1706, interconnecting right side 1707, interconnecting top side 1708, and interconnecting bottom side 1709. All interconnecting ports may be preserved through the transition between various types of rotationally molded hollow shells 1700 facilitated by three-way roof connector 1793.

Numerous modifications and variations will readily occur to persons skilled in the art. The present disclosure is not limited to the exact construction and operation illustrated and described. All suitable modifications and equivalents may be resorted to, falling within the scope of the present disclosure.

What is claimed is:

1. An air handling module, comprising:

a housing;

an exchanger contained within the housing;

a first manifold positioned on a first side of the housing and comprising first air ports further comprising two or more ports disposed on a first end of the first manifold and second air ports further comprising two or more ports disposed on a second end of the first manifold, wherein each air port of the first air ports and second air ports of the first manifold is configured to interchangeably attach a structure to the air handling module;

a second manifold positioned on a second side of the housing and comprising first air ports further comprising two or more ports disposed on a first end of the second manifold and second air ports further comprising two or more ports disposed on a second end of the second manifold, wherein each air port of the first air ports and the second air ports of the second manifold is configured to interchangeably attach a structure to the air handling module;

the first air ports of the first manifold are in fluid communication with the first air ports of the second manifold to transfer air through the exchanger and between the first and second manifolds;

the second air ports of the first manifold are in fluid communication with the second air ports of the second manifold to transfer air through the exchanger and between the first and second manifolds;

at least one rotary damper disposed in one of the first or second manifolds, wherein the rotary damper is configured to rotate to selectively deliver airflow within the air handling module; and the air handling module is configured to be coupled to one or more additional air handling modules, the air handling module and the one or more additional air handling modules configured to operate in parallel with each other to achieve a combined conditioning effect greater than a conditioning effect of the air handling module.

2. The air handling module of claim 1, wherein the structure attached to each port is selected from the group consisting of: an access panel; a cap; a duct, a damper, a rotary damper, a valve, a fan, a fan box, a weather hood, or a roof curb.

3. The air handling module of claim 1, wherein the rotary damper includes a rotatable semi-cylindrical member and is configured to deliver airflow in directions along a rotational axis of the semi-cylindrical member and deliver airflow in directions normal to the rotational axis.

4. The air handling module of claim 1, further comprising a hydronic distribution and collection system including a plurality of internal and external threaded ports.

* * * * *